US010689720B2

(12) United States Patent
Larsen

(10) Patent No.: US 10,689,720 B2
(45) Date of Patent: Jun. 23, 2020

(54) DRYING UNIT FOR ACCOMMODATING A PLURALITY OF ELONGATED HOLLOW PELT BOARDS

(71) Applicant: MINKPAPIR A/S, Holstebro (DK)

(72) Inventor: Johnny Larsen, Aalborg (DK)

(73) Assignee: MINKPAPIR A/S, Holsterbro (DK)

( * ) Notice: Subject to any disclaimer, the term of this patent is extended or adjusted under 35 U.S.C. 154(b) by 39 days.

(21) Appl. No.: 16/068,486

(22) PCT Filed: Jan. 6, 2017

(86) PCT No.: PCT/EP2017/050253
§ 371 (c)(1),
(2) Date: Jul. 6, 2018

(87) PCT Pub. No.: WO2017/118721
PCT Pub. Date: Jul. 13, 2017

(65) Prior Publication Data

US 2019/0017127 A1 Jan. 17, 2019

(30) Foreign Application Priority Data

| | | |
|---|---|---|
| Jan. 8, 2016 | (EP) | 16150675 |
| Mar. 30, 2016 | (EP) | 16162910 |
| Aug. 26, 2016 | (EP) | 16185953 |

(51) Int. Cl.

| | |
|---|---|
| ***C14B 1/58*** | (2006.01) |
| ***C14B 15/06*** | (2006.01) |
| *C14C 3/22* | (2006.01) |

(52) U.S. Cl.
CPC ..... *C14B 1/58* (2013.01); *C14B 15/06* (2013.01); *C14C 3/22* (2013.01)

(58) Field of Classification Search
CPC ..... C14B 1/58; C14B 15/06
See application file for complete search history.

(56) References Cited

U.S. PATENT DOCUMENTS

| | | | | |
|---|---|---|---|---|
| 1,954,697 A * | 4/1934 | Gibbs | ..... | C14B 1/26 69/19.2 |
| 2,231,903 A * | 2/1941 | Graham | ..... | C14B 1/26 69/19.2 |

(Continued)

FOREIGN PATENT DOCUMENTS

| | | |
|---|---|---|
| EP | 2573479 | 3/2013 |
| EP | 2578957 | 4/2013 |

(Continued)

OTHER PUBLICATIONS

International Search Report on corresponding PCT application (PCT/EP2017/050253) from International Searching Authority (EPO) dated May 19, 2017.

(Continued)

*Primary Examiner* — Shaun R Hurley
(74) *Attorney, Agent, or Firm* — Klein, O'Neill & Singh, LLP

(57) ABSTRACT

A pelt processing system includes a plurality of pelt boards, each of which is operable between an expanded state and a non-expanded state by moving a connecting element relative to the bottom of the pelt board. The system further includes a holding unit, configured to hold a plurality of pelt boards, that includes a top plate having a number of apertures, each of the apertures accommodating a connecting element of a pelt board; and a blowing unit including a bottom plate spaced from the top plate, a gas inlet configured for receiving a stream of gas, and a sidewall in a fluid-tight connection with the top and bottom plates, whereby an inner space is established between the top plate, the bottom plate, the gas inlet, and the sidewall; and a release mechanism configured for causing the pelt boards held by the holding unit to assume the non-expanded state.

20 Claims, 54 Drawing Sheets

(56) References Cited

U.S. PATENT DOCUMENTS

| | | | | |
|---|---|---|---|---|
| 2,362,062 | A * | 11/1944 | Fishbeck | C14B 1/26 69/19.2 |
| 4,381,654 | A * | 5/1983 | Baldridge | C14B 15/06 69/19.2 |
| 7,690,228 | B2 * | 4/2010 | Hedegaard | C14B 1/26 69/19.1 |
| 10,351,919 | B2 * | 7/2019 | Larsen | C14B 1/58 |
| 2016/0102373 | A1 * | 4/2016 | Pedersen | C14B 15/06 69/22 |

FOREIGN PATENT DOCUMENTS

| | | |
|---|---|---|
| EP | 2913410 | 9/2015 |
| WO | WO2005/026394 | 3/2005 |
| WO | WO2005/028682 | 3/2005 |
| WO | WO2007/085269 | 8/2007 |
| WO | WO2015/062559 | 5/2015 |
| WO | WO2015/144774 | 10/2015 |
| WO | WO2015/154729 | 10/2015 |

OTHER PUBLICATIONS

Written Opinion on corresponding PCT application (PCT/EP2017/050253) from International Searching Authority (EPO) dated May 19, 2017.

* cited by examiner

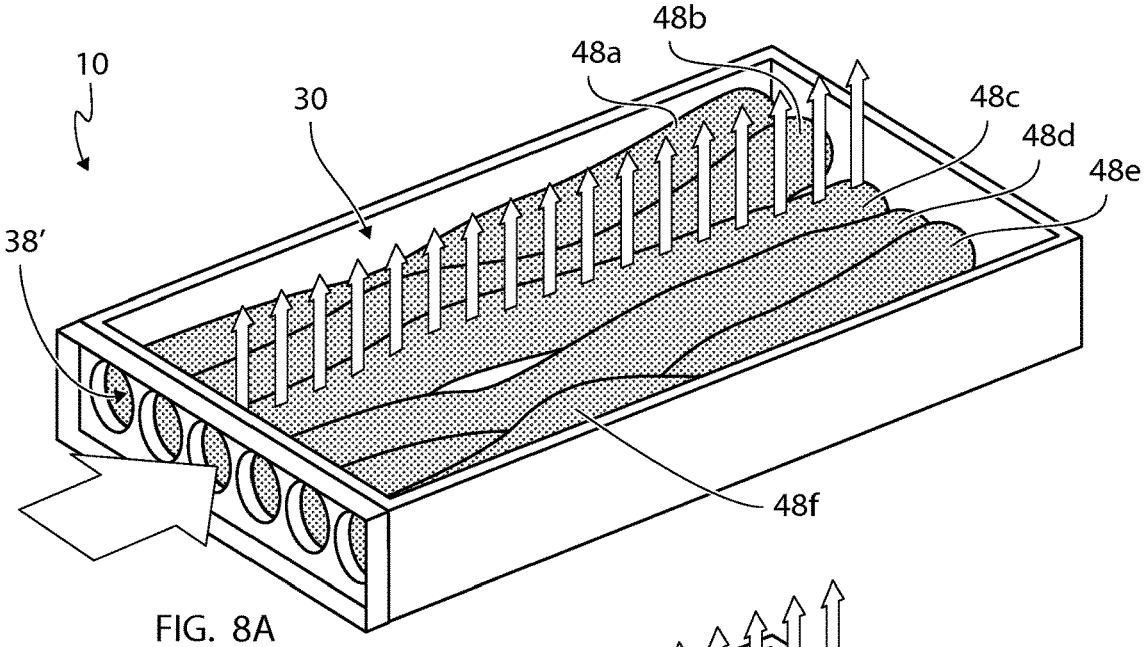
FIG. 8A
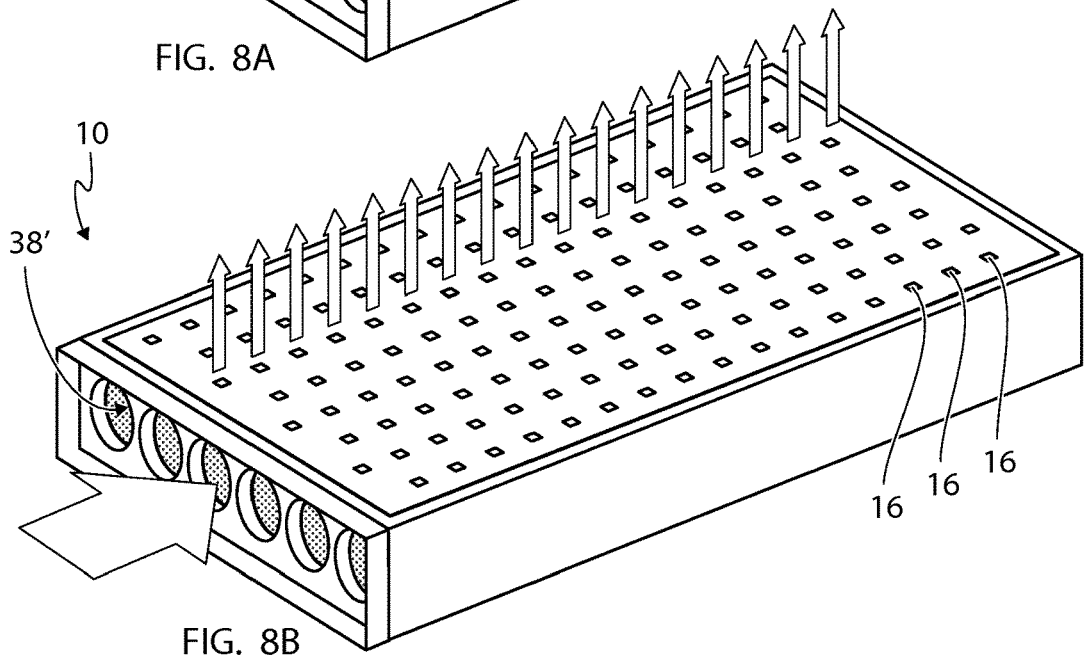
FIG. 8B
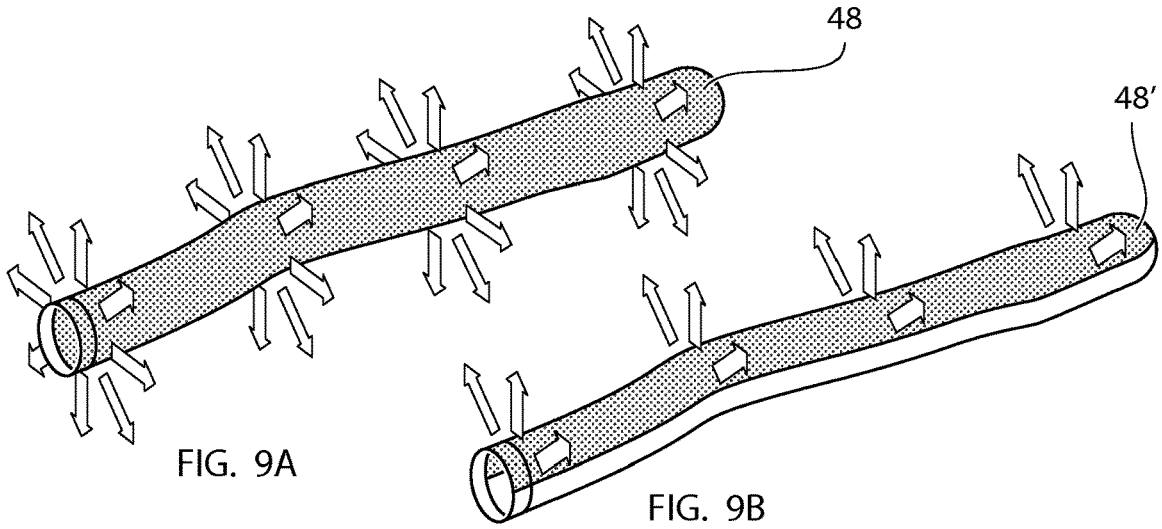
FIG. 9A
FIG. 9B

DRYING UNIT FOR ACCOMMODATING A PLURALITY OF ELONGATED HOLLOW PELT BOARDS

CROSS-REFERENCE TO RELATED APPLICATIONS

This application is the national phase entry, under 35 U.S.C. Section 371(c), of International Application No. PCT/EP2017/050253, filed Jan. 6, 2017, claiming priority from European Patent Application Nos. 16150675.3, filed Jan. 8, 2016, 16162910.0, filed Mar. 30, 2016, and 16185953.3, filed Aug. 26, 2016. The disclosures of the International Application and the European Applications from which this application claims priority are incorporated herein by reference in their entirety.

FEDERALLY SPONSORED RESEARCH OR DEVELOPMENT

Not Applicable

The present invention relates to a drying unit for accommodating a plurality of elongated hollow pelt boards, and associated methods of drying a pelt by providing a drying unit.

BACKGROUND

Pelt boards and drying units are used in the pelt industry in the process of tanning pelts. The pelts, such as pelts from smaller mammals, preferably minks, foxes or the like, are stretched onto a pelt board for drying. Historically such pelt boards were made from solid wood, however, recently hollow pelt boards made of plastic have been used. Such hollow pelt boards are often made from two elongated half parts which together form a convex surface about a central axis. The half parts may be movable relative to one another for allowing the pelt board to collapse in order to simplify the removal of the pelts after drying. The pelt boards typically have a slightly conical shape from a bottom end to a top end. The pelts are stretched onto the pelt boards such that the cranium end of the pelt is located at the top end of the pelt board and the tail end of the pelt is located at the bottom end of the pelt board.

The pelt boards are often used together with a layer of fat absorbing material such as paper for absorbing fat from the pelt. The moist of the pelt is however removed using a drying unit for drying the pelts by means of a flow of air. For this purpose, the pelt board has a plurality of openings or apertures for allowing drying air to pass through the pelt board. Drying air is received at the bottom part of the pelt board and passes via the inside of the hollow pelt board through the pelt board and pelt. The drying air thus actively removes moist and water from the pelts and thus the total drying time is significantly reduced compared to using wooden pelt boards.

The pelt boards are typically placed in a drying unit for drying. The drying unit comprises a shallow box shaped unit defining an inner space and a blowing unit. The drying unit defines a top surface having a number of apertures. The pelt boards have a connecting element at the bottom end. The connecting element is received and arrested in the apertures. The blowing unit forces an airflow into the inner space and into the bottom end of the pelt boards via the apertures. Each drying unit typically has in the range of 25-100 apertures allowing a corresponding number of pelt boards and associated pelts to be dried. The drying units are often movable simplifying the transport of a plurality of pelt boards and allowing the drying to take place in a room having an increased ex-change of air.

Examples of such drying units may be found in the applicants own international applications WO 2005/026394 A1 and WO 2007/085269 A1, disclosing a method and drying unit for drying out the leather side of a pelt stretched out and fixed in this position on a pelt board, and, a device for performing complete—or partial emptying/filling of a drying aggregate with upstanding expansion pelt boards, respectively.

The use of forced convection in the form of a blower generating a stream of drying air through the pelts reduces the total drying time significantly compared to drying by means of solid pelt board relying entirely on natural convection. The drying time may be improved further by increasing the capacity of the blower to generate a more powerful stream of drying air. However, the applicant has found out that increasing the intensity of the drying air stream may lead to a too fast drying or over-drying of the pelt which may lead to a reduced quality of the pelt and/or formation of spots or marks on the pelt. There is thus a need for drying units capable of drying the pelts at a suitable drying intensity and leaving a small amount of residual moist.

Further, the applicant has found out that the classic drying units do not necessarily deliver the same amount of drying air through all of its apertures. By increasing the capacity of the blower and thereby increasing the flow velocities, the difference between the apertures becomes even more apparent. Having approximately the same flow of air is important since it will allow all of the pelts of a drying unit to be appropriately dried out. Otherwise the problem will arise where some of the pelts of a drying unit are over-dried while some are still moist. Thus, it is an object of the present invention to achieve technologies for allowing more efficient drying of pelts using a drying unit and to avoid the above-mentioned problem.

SUMMARY OF THE INVENTION

The above need and the above object is according to the teachings of the present invention achieved in a first aspect of the present invention by a drying unit for accommodating a plurality of elongated hollow pelt boards, each of the pelt boards having a pelt board top, a pelt board bottom and a connecting element at the pelt board bottom, the drying unit defining:

- a top plate having a number of apertures, each of the apertures being adapted for accommodating the connecting element,
- a bottom plate being parallel to and spaced apart from the top plate,
- a gas inlet for receiving a stream of gas, preferably air, and
- a sidewall interconnecting the top plate and the bottom plate in a fluid-tight manner for establishing an inner space between the top plate, the bottom plate, the gas inlet and the sidewall, the sidewall having an extent such that the top plate and the bottom plate being capable of defining a distance between themselves of at least 200 mm, such as between 200 mm and 2500 mm, preferably between 250 mm and 1000 mm, more preferably between 300 mm and 800 mm, most preferably between 400 mm and 600 mm.

The drying unit defines an inner space bounded by the top plate facing upwards, the bottom plate facing the ground, the sidewall and the gas inlet. It is contemplated that the bottom plate may be omitted and that the surface of the floor of the room may be used as bottom plate. The top plate has apertures, which are used for arresting the connecting element of the pelt board. Typically, 200 pelt boards may be accommodated on one drying unit. The apertures also distribute drying gas, preferably air, from the inner volume to the hollow pelt board via the bottom of the pelt board. The gas is received by the inner space via the gas inlet, preferably in a direction, which is perpendicular to the direction of the pelt boards.

Standard drying units according to the prior art, which are on the market today, e.g. marketed by the applicant company, are made very shallow, i.e. the top surface is located very low, such as about 100 mm above the bottom plate, i.e. the inner height of the inner space is about 100 mm. The reason for this is the fact that the pelt boards are quite tall, about 1-1.5 meters or more. In order to be able to place and remove the pelt boards on the top surface of the drying unit in an ergonomically way, and to be able to move the drying unit safely through doors etc., it has been desirable to make the distance between the top plate and the bottom plate as small as possible.

The applicant has performed numerous experiments and found out that the standard shallow drying units will not distribute the stream of air from the gas inlet equally among the apertures when high flow velocities are used. High flow velocities cause various flow effects such as increase of pressure, pressure waves, flow separation and turbulence, which in turn make the airflow through each aperture very unpredictable. This may lead to an uneven drying among the pelts on the pelt boards placed in the drying unit. The solution to this problem is to make the distance between the top plate and the bottom plate larger so that the inner space of the drying unit defines a greater volume. This will allow the flow velocity within the drying unit to be maintained while the total volume of gas flowing though the inner volume may be increased. Thus, the negative flow effects mentioned above may be minimized.

Thus, it is suggested by the present applicant that the inner height of the inner space of the drying aggregate is made higher, such as 200 mm, effectively doubling the volume of the inner space compared to standard drying units on the market today. In order to be able to work with the drying unit both efficiently and ergonomically in an industrial environment, the above-mentioned preferred ranges are suitable.

According to a further embodiment of the first aspect, the sidewall is flexible and wherein the drying unit further comprising a lifting device interconnecting the bottom plate and the top plate, the lifting device being capable of moving the top plate and the bottom plate relative to one another between a first position in which the top plate and the bottom plate being adjacent each other, and a second position in which the top plate and the bottom plate being distant each other, the lifting device optionally being lockable by a locking device.

Increasing the height of the drying unit has the drawback that the ergonomically aspect of the use of the drying unit is made worse, since the user has to lift the pelt board to and from a higher location. In order to be able to benefit from both an improved gas flow distribution among the apertures while maintaining the shallow profile of the drying unit during placement and removal of the pelt boards as well as during transport of the drying unit, the sidewall may be made flexible, i.e. capable of defining a larger and smaller area, and the drying unit may be provided with a lifting device capable of moving the top plate and the bottom plate relative to one another. It is understood that the plates and wall as such of the drying unit are substantially pressure proof, i.e. the flexible sidewall should be able to define a larger area without opening any apertures in the sidewall.

In this way, the top plate and the bottom plate may be adjacent each other, such as 100 mm apart, during placement and removal of the pelt boards as well as during transport of the drying unit. When the drying is about to start, the top plate and the bottom plate may be moved apart, making the drying unit higher, such as at least 200 mm, such as between 200 mm and 2500 mm, preferably between 250 mm and 1000 mm, more preferably between 300 mm and 800 mm, most preferably between 400 mm and 600 mm. In this way, the flow distribution is improved when needed during drying whereas the ergonomically friendly height is maintained for the user.

In order to spare the lifting device from excessive loads and long time wear, a locking device may be provided for mechanically locking the distance between the top plate and the bottom plate at specific distances.

According to a further embodiment of the first aspect, the flexible sidewall comprise a first sidewall element being connected to the top plate and a second sidewall element connected to the bottom element, the first sidewall element and the second sidewall element being fluid tightly interconnected in a telescopic configuration.

In this way, the distance between the bottom plate and the top plate may be efficiently moved between the first contracted position and the second extended position, in which the second position is effectively constituting twice the height of the drying unit, and thereby twice the inner volume, compared to the first position. More elements may be used to reach even higher levels and thereby even larger inner volumes.

According to a further embodiment of the first aspect, the flexible sidewall comprise an elastic and/or pleated and/or rolled up element.

The flexible sidewall may e.g. be pleated or elastic in order to be able to be reshaped in a way such that the distance between the bottom plate and the top plate may be changed without opening any apertures in the sidewall. It may also be rolled up on a rod and rolled up/down as the distance between the bottom plate and the top plate is changed, much like a roll-up curtain.

According to a further embodiment of the first aspect, the lifting device being located within the inner space and/or the lifting device comprising a guiding element extending from the bottom plate and through the top plate.

Preferably, the lifting device is within the inner space in order to save space. Further, in order to increase the stability when the top plate and the bottom plate are spaced apart, the lifting device may comprise a guiding element, e.g. in the form of bars.

According to a further embodiment of the first aspect, the lifting device constitutes a hydraulic or pneumatic lifting device or a mechanical lifting device such as a pantograph having a mechanical advantage between 1 and 10, preferably between 2 and 5 and preferably driven by an electrical motor, a hydraulic cylinder or alternatively including a gear mechanism for being manually operated by a user.

The lifting device may thus be either manual using a gear for leverage, powered, or even automatically controlled. A pantograph having a leverage or mechanical advantage may e.g. be used. The mechanical advantage reduces the mechanical stress on the lifting device during the movement of the top plate relative to the bottom plate.

According to a further embodiment of the first aspect, the gas inlet connected to an on board air blower capable of transporting air from outside the drying unit into the inner space and out through the apertures.

In order to be able to use air as drying gas, a blower may be used forcing ambient air into the inner space through the gas inlet. The blower may be fixated to and essentially made part of the drying unit.

According to a further embodiment of the first aspect, the gas inlet is connectable to an external air blower capable of communicating with the gas inlet, the external air blower being capable of transporting air from outside the drying unit into the inner space and out through the apertures.

In order to make a more compact drying unit and free the blower for other uses when the pelt boards are placed on or removed from the drying unit, the blower may be external and capable of being connected to the gas inlet of the drying unit.

According to a further embodiment of the first aspect, the external air blower being capable of transporting air from an outdoor location into the inner space and out through the apertures.

Such an external blower may take outside air instead of ambient air. Air from the outside is typically drier than indoor air and thus has a higher drying effect.

According to a further embodiment of the first aspect, the air blower including a dehumidifier.

Further, in order to reduce the humidity of the drying air or drying gas, a dehumidifier may be used. In this way, the drying effect is increased as the drying air or gas may accept a higher amount of moist before being saturated. The dehumidifier may be used both in connection with the on board air blower as well as with the external air blower.

According to a further embodiment of the first aspect, the gas inlet being located in the sidewall.

In this way space is saved since the complete top plate may be used for accommodating the pelt boards.

According to a further embodiment of the first aspect, the bottom plate being fitted with wheels.

In this way the drying unit may be easily transported.

According to a further embodiment of the first aspect, the bottom plate being fitted with feet such that the drying unit may be moved by the use of a floor conveyor, such as a forklift, jack lift or pallet jack.

Alternatively, wheels are replaced by feet in order to have a more stable positioning of the drying unit. The drying unit is thus moved by means of a floor conveyor.

According to a further embodiment of the first aspect, the drying unit comprises a flow distributor disposed within the inner space between the gas inlet and the top plate.

In order to ensure that the flow through each of the apertures is as uniform as possible, a flow distributor may be used. The flow distributor is understood to comprise one or more flow regulators or any other suitable means for achieving a uniform flow velocity and pressure distribution within the inner space and avoid recirculation, pressure waves, excessive turbulence and similar flow effects. Examples of air distributors may be found in the documents WO 2015/154729 A1, WO 2015/062559 A1, EP2578957 A1, EP 2573479 A2, which describe various ducts and elements used for air distribution in ventilation equipment. The air distributors described in the above cited prior art show some principle examples used in the ventilation industry but also suitable as flow distributors according to the present purpose. The flow distributor preferably extends below and at approximately equal distance from all of the apertures from the apertures of the top plate. Below follows some embodiments of a flow distributor suitable for the present purposes:

According to a further embodiment of the first aspect, the flow distributor comprises one or more flexible and gas permeable hoses, or alternatively the flow distributor comprises a rigid or semi-rigid plate including one or more flexible vent members, or alternatively the flow distributor comprises rigid or semi-rigid flow guiding elements, or alternatively the flow distributor comprises walls within the inner space defining enclosed cells between the gas inlet and the top plate, each of the cells preferably comprising a fan.

One option is to use one or more flexible and gas permeable hoses. The hoses may be made of a flexible web material such as a web material of natural fibres or synthetic fibres, e.g. textile, allowing the gas to flow though the fine holes in the web material. In this way, any pressure fluctuations will be reduced due to the flexibility of the material in conjunction with the distributing effect of the plurality of apertures in the hose. The hose or hoses should preferably extend along a great portion of the inner space in order to distribute the flow equally over all of the apertures.

Alternatively, a rigid or semi-rigid plate with flexible vent members or flaps may be used for the same purpose. The rigid or semi-rigid plate divides the inner space and the flexible vent members should be distributed on the rigid or semi-rigid plate within the inner space for distributing the flow equally over all of the apertures. The flexible vent counteracts any pressure fluctuations by opening when subjected to a large pressure force while closing when the pressure force is smaller, thus limiting the maximum flow though the vent.

Alternatively, rigid or semi-rigid flow guiding elements are used, which cause the flow of drying air to divide into multiple parts and each part of the flow is directed towards a separate aperture or group of apertures. In this way, most of the above mentioned negative flow effects, such as recirculation, are counteracted largely. The flow distributor may even comprise walls, which form cells dividing the inner space into separate spaces, which communicate with separate groups of apertures. Each cell may comprise an individual fan, which may be controlled to achieve a uniform flow between the different cells and within each of the cells.

According to a further embodiment of the first aspect, the drying unit comprises a plurality of gas inlets disposed at the bottom plate and/or the top plate and/or the side plate.

In this way, the flow is more uniformly distributed already when entering the inner space.

According to a further embodiment of the first aspect, the apertures include a nozzle for conditioning the stream of air and/or the apertures including an adapter made of polymeric material and adapted for interconnecting with the connecting element of the pelt board and/or a nozzle.

A nozzle may be used forming a flow constriction in the aperture thus allowing a higher pressure to build up in the inner space. In this way, the flow will be more uniform between the nozzles.

An adapter may be used for providing a more stable positioning of the pelt boards on the top plate. The adapters are fixated in a respective aperture of the top plate. The adapter has a shape which corresponds to the connecting element of the pelt board such that the pelt board is held in a stable position. Thus, the adapters may be used to provide an interface between various types of pelt boards having connecting elements of different size and thus the same drying unit may be shipped with various adapters for being compatible with different pelt boards.

The above need and the above object is according to the teachings of the present invention achieved in a second aspect of the present invention by a method of drying a pelt by providing a drying unit, the drying unit defining:

a top plate having a number of apertures, a bottom plate being parallel to and spaced apart from the top plate, a gas inlet for receiving a stream of gas, preferably air, and a sidewall interconnecting the top plate and the bottom plate in a fluid-tight manner for establishing an inner space between the top plate, the bottom plate, the gas inlet and the sidewall, the sidewall having an extent such that the top plate and the bottom plate being capable of defining a distance between themselves of at least 200 mm, such as between 200 mm and 2500 mm, preferably between 250 mm and 1000 mm, more preferably between 300 mm and 800 mm, most preferably between 400 mm and 600 mm, and the method further comprising the steps of:

accommodating the pelt on an elongated hollow pelt board having a pelt board top, a pelt board bottom and a connecting element at the pelt board bottom, accommodating the connecting element of the pelt board in one of the apertures of the top plate, and introducing gas, preferably air into the inner space for causing the gas to flow into the pelt board via the one aperture.

The above method according to the second aspect is preferably used together with the above drying unit according to the first aspect with a fixed sidewall.

The above need and the above object is according to the teachings of the present invention achieved in a third aspect of the present invention by a method of drying a pelt by providing a drying unit, the drying unit defining:

a top plate having a number of apertures, a bottom plate being parallel to and spaced apart from the top plate, a gas inlet for receiving a stream of gas, preferably air, and a flexible sidewall interconnecting the top plate and the bottom plate in a fluid-tight manner for establishing an inner space between the top plate, the bottom plate, the gas inlet and the flexible sidewall, the sidewall having an extent such that the top plate and the bottom plate being capable of defining a distance between themselves of at least 200 mm, such as between 200 mm and 2500 mm, preferably between 250 mm and 1000 mm, more preferably between 300 mm and 800 mm, most preferably between 400 mm and 600 mm, and a lifting device interconnecting the bottom plate and the top plate, the lifting device being capable of moving the top plate and the bottom plate relative to one another, the method further comprising the steps of:

accommodating the pelt on an elongated hollow pelt board having a pelt board top, a pelt board bottom and a connecting element at the pelt board bottom, moving the lifting device to a first position in which the top plate and the bottom plate are adjacent each other, accommodating the connecting element of the pelt board in one of the apertures of the top plate, moving the lifting device to a second position in which the top plate and the bottom plate are distant each other, and introducing gas, preferably into the inner space for causing the gas to flow into the pelt board via the one aperture.

The above method according to the third aspect is preferably used together with the above drying unit according to the first aspect with a flexible sidewall and a lifting device.

The above need and the above object is according to the teachings of the present invention achieved in a fourth aspect of the present invention by a drying unit for accommodating a plurality of elongated hollow pelt boards, each of the pelt boards having a pelt board top, a pelt board bottom and a connecting element at the pelt board bottom, the drying unit defining:

a top plate having a number of apertures, each of the apertures being adapted for accommodating the connecting element, a bottom plate being parallel to and spaced apart from the top plate, a gas inlet for receiving a stream of gas, preferably air, and a sidewall interconnecting the top plate and the bottom plate in a fluid-tight manner for establishing an inner space between the top plate, the bottom plate, the gas inlet and the sidewall, the drying unit comprising a flow distributor disposed within the inner space between the gas inlet and the top plate.

Alternatively or in conjunction with said drying unit according to the first aspect and the methods according to the second and third aspects, the drying unit may be provided with a flow distributor in order to prevent the negative flow effects associated with high flow velocities for achieving a quicker drying of the pelt as described above. Thus, in case it is not feasible to increase the height of the drying unit or in case where a low drying unit is desired for any reason, a flow distributor may be used for preventing recirculation areas and similar flow effects, which contribute to an uneven distribution of the flow between the apertures.

Further, in case the increase of the height of the drying unit is not sufficient for preventing the negative flow effects or in cases very high flow velocities are used for achieving an even quicker drying of the pelts.

The flow distributor is adapted to provide a substantially uniform gas flow through the apertures. The flow distributor may be any form of physical flow guide, which influences the flow direction, velocity or pressure after the flow has entered the inner space and before the flow exits the aperture, and which has the purpose of achieving an uniform distribution of the flow through the apertures.

According to a further embodiment of the fourth aspect, the flow distributor comprises one or more flexible and gas permeable hoses, or alternatively the flow distributor comprises a rigid or semi-rigid plate including one or more flexible vent members, or alternatively the flow distributor comprises rigid or semi-rigid flow guiding elements, or alternatively the flow distributor comprises walls within the inner space defining enclosed cells between the gas inlet and the top plate, each of the cells preferably comprising a fan.

The above flow distributors are preferably used and as such all of the above flow distributors, which have already been described in detail in connection with the first aspect, are equally applicable with the drying unit according to the fourth aspect as well as the associated method described below.

The above need and the above object is according to the teachings of the present invention achieved in a fifth aspect of the present invention by a method of drying a pelt by providing a drying unit, the drying unit defining:

a top plate having a number of apertures, a bottom plate being parallel to and spaced apart from the top plate, a gas inlet for receiving a stream of gas, preferably air, and a sidewall interconnecting the top plate and the bottom plate in a fluid-tight manner for establishing an inner space between the top plate, the bottom plate, the gas inlet and the sidewall, the drying unit comprises a flow distributor disposed within the inner space between the gas inlet and the top plate, the method further comprising the steps of:

accommodating the pelt on an elongated hollow pelt board having a pelt board top, a pelt board bottom and a connecting element at the pelt board bottom, accommodating the connecting element of the pelt board in one of the apertures of the top plate, and introducing gas, preferably air, into the inner space for causing the gas to flow into the pelt board via the one aperture.

The above method according to the fifth aspect is preferably used in together with the drying unit according to the fourth aspect.

The above need and the above object is according to the teachings of the present invention achieved in a sixth aspect of the present invention by a pelt processing system comprising:

a tanning unit for tanning a pelt which has been fixated to an expanded pelt board having a pelt board top, a pelt board bottom and a connecting element at the pelt board bottom, the pelt board further being operable between an expanded state and a non-expanded state by moving the connecting element relative to the pelt board bottom, a holding unit for accommodating a plurality of the elongated hollow pelt boards, the holding unit defining a top plate having a number of apertures, each of the apertures being adapted for accommodating the connecting element, a blowing unit compatible with the holding unit and comprising a bottom plate being parallel to and spaced apart from the top plate, a gas inlet for receiving a stream of gas, preferably air, and a sidewall for interconnecting with the top plate in a fluid-tight manner for establishing an inner space between the top plate, the bottom plate, the gas inlet and the sidewall, and a release mechanism for causing the pelt boards on the holding unit to assume the non-expanded state.

An example of a tanning unit suitable in the present circumstances is described in WO 2005/028682 A1. The tanning unit stretches and fastens the pelt on the expanded pelt board. The holding unit may be made very light since it must not include any mechanical parts, blowers or flow distributors. Wheels are as well optional as the holding unit may be moved by means of a floor conveyor. It must merely be capable of holding the pelt boards in a substantially stable position. This may be done by apertures in the top plate in conjunction with adapters as described above.

The blowing unit may be stationary and as the holding unit is connected to the blowing unit the inner space is formed in-between the blowing unit and the holding unit. The release mechanism may be included in the blowing unit or it may be a stand-alone unit.

The release mechanism constitutes an actuator, which acts on the connecting elements on the pelt board in order to cause all of the pelt boards to assume the non-expanded state. The non-expanded state is used when the pelts are removed from the pelt boards. The non-expanded state is also known as a collapsed state. Such pelt boards are generally known in the art as collapsible pelt boards and are described in e.g. WO 2005/026394 and WO 2015/144774. The connecting element has the dual function of holding the pelt board upright and causing the pelt board to collapse by pulling it in a direction away from the bottom of the pelt board.

According to a further embodiment of the sixth aspect, the release mechanism form part of the blowing unit or holding unit. The release mechanism may thus be integrated into the blowing unit for a simple release of the pelt directly after drying. It may also be considered to include the release mechanism or part thereof in the holding unit, however, it would make it heavier and thus less maneuverable.

According to a further embodiment, the pelt processing system includes a pelt release station comprising the release mechanism and being separate from the blowing unit, the pelt release station being compatible with and capable of accommodating the holding unit. Preferably, the release mechanism is part of a separate release station. The present pelt processing system according to the sixth aspect is preferably modular in that the tanning unit, holding unit, blowing unit and release mechanism are separate stand-alone units. In this way, the airflow inside the blowing unit and through the apertures will not be negatively influenced, and there is no need to include the mechanics needed for the skin release function into every blowing unit.

According to a further embodiment, the release mechanism comprises a gripping member, the gripping member being adapted to engage the connecting element when accommodated in one of the apertures of the holding unit and moving the connecting element relative to the pelt board bottom. The gripping member is capable of engaging, i.e. gripping, a connecting element, hold it securely and pull or push it relative to the board bottom so that the pelt board due to its internal construction will contact. Such contraction is a feature of most modern pelt boards, and in that way, the dried skin on the pelt board will be easier to remove compared to the older wooden pelt boards. During drying, the pelt contacts and will thus be more difficult to remove once dried on the pelt board. Previously, this movement of the connection element in order to contract the pelt boards were made manually, a rather toilsome labor.

According to a further embodiment the gripping member is biased, e.g. by a spring, to a non-engaged position in which the gripping member is located adjacent the holding unit and adapted to receive the connecting element, the release mechanism further comprising an actuator for moving the gripping member to an engaged position engaging the connecting element and subsequently to a released position, in which the connecting element has moved relative to the pelt board bottom and the pelt board has assumed a non-expanded state. In order to be able to place and remove the pelt board from the holding unit, the gripping member is biased in the non-engaged position. When a release of the skin is desired, the user may cause an actuator to move the gripping member so that it grips or engages the connecting elements and subsequently moves the connecting elements so that the pelt is released from the pelt board as described above.

According to a further embodiment, the actuator is capable of moving the gripping member away from the holding unit. In the normal type of pelt boards used by the applicant company, the pelt boards are switched from the expanded state to the non-expanded or contacted/collapsed state by pulling the connecting element downwards, i.e. away from the bottom of the board bottom. Thus, the expanded state may be resumed by simply pushing the connecting element inwards, towards the bottom of the pelt board.

According to a further embodiment, the release mechanism comprises a multitude of gripping members and the actuator is movable between the gripping members for moving the gripping members in sequence. By moving only one or some of the gripping elements at a time and thereby releasing only one or some of the skins of the pelt boards at a time, the drive mechanism of the actuator may be made smaller and lighter. The actuator may e.g. comprise a belt and pulley such for moving one actuator between gripping members.

According to a further embodiment, the release mechanism is elongated and the multitude of gripping members correspond to a row of apertures of the holding unit. In this way a complete row of pelt boards may be released using the same actuator.

According to a further embodiment, the release mechanism is mounted on a frame and the release mechanism is movable between the rows of apertures of the holding unit. In this way, the same actuator may be used for releasing all pelt boards on the holder, one by one and row by row.

According to a further embodiment, the actuator is manually driven, or alternatively, driven by a electrical, hydraulic or pneumatic drive. In some cases a lever may be used for operating the actuator, however, in most cases electrical, hydraulic, or pneumatic drives will be used in order to simplify the work of the operator.

According to a further embodiment, the gripping member comprises a first jaw and an opposite second jaw movable within respective guides between the non-engaged position in which the jaws are open, the engaged position in which the jaws are closed and the release position in which the jaws are moved away from the holding unit. The jaws are open in the non-engaged position, allowing the connecting element to be placed between the jaws. Subsequently, the jaws are closed in the engaged position securing the connecting element to the gripping element and yet subsequently, both jaws are moved downwards while in the closed position, i.e. away from the pelt board bottom and holding unit, in order to release the skin in the release position. The steps are reversed for disengaging the connecting element and the gripping member.

According to a further embodiment, the holding unit and/or the blowing unit comprise transportation means including wheels. In this way, the units may be easily moved around.

According to a further embodiment, the transportation means further include a motor, the motor either being operatively connected to the wheels or being part of a separate wheeled unit for transporting the holding unit and/or the blowing unit. Preferably, the holding unit and/or the blowing unit are motorized, further reducing the manual labor required.

According to a further embodiment, the transportation means further include a user interface being mounted on the holding unit and/or the blowing unit or alternatively constituting a panel for controlling the transportation means from a remote location via wireless communication. The user interface may be mounted on the unit in order to move the unit while walking behind it, similar to a powered pallet jack. Alternatively, the units may be remote controlled via a panel. The units may even be entirely autonomous, i.e. moving between stations without use involvement.

According to a further embodiment, the drying unit comprises a gas inlet having central inflow, a circumferential inflow and a cone adjacent the central inflow for directing inflowing gas from the central inflow past the circumferential inflow thereby generating an entrainment effect at the circumferential inflow. In this way, the Coanda effect is used for entraining additional drying air into the drying unit. The drying air constitutes the mixture of the inflowing air. The above embodiment may be used with or without an air conditioning system for providing the main flow. The air-conditioning unit may supply air having a humidity lower than the ambient. Further, one or more ventilators may be included in connection with the central inflow and/or the circumferential inflow.

According to a further embodiment, the central inflow and/or the circumferential inflow comprise one or more valves, preferably the drying unit comprises sensors for controlling the valves. Sensors may be used in order to monitor pressure, temperature and/or humidity of the drying air. Valves in the central inflow and/or circumferential inflow may be used in order to optimize the pressure, temperature and/or humidity of the drying air. In this way a perfect mix of conditioned air and ambient air may be established when the central inflow is connected to an air conditioning system.

The above gas inlet including the cone may be used together with any of the previously described drying units according to any of the previously described aspects.

The above need and the above object is according to the teachings of the present invention achieved in a sixth aspect of the present invention by a method of drying a pelt by providing a drying system, the drying system comprising:

- a tanning unit for tanning a pelt which has been fixated to an expanded pelt board having a pelt board top, a pelt board bottom and a connecting element at the pelt board bottom,
- a holding unit defining a top plate having a number of apertures, each of the apertures being adapted for accommodating the connecting element,
- a blowing unit compatible with the holding unit and comprising a bottom plate being parallel to and spaced apart from the top plate, a gas inlet for receiving a stream of gas, preferably air, and a sidewall interconnecting the top plate and the bottom plate in a fluid-tight manner for establishing an inner space between the top plate, the bottom plate, the gas inlet and the sidewall, and
- a release mechanism for causing the pelt board on the holding unit to assume the non-expanded state.

the method further comprising the steps of:

- providing a pelt board, the pelt board having a pelt board top, a pelt board bottom and a connecting element at the pelt board bottom, the pelt board further being adjustable between an expanded state and a non-expanded state by operating the connecting element,
- accommodating the pelt on the elongated hollow pelt board being in the expanded state,
- accommodating the connecting element of the pelt board in one of the apertures of the top plate,
- interconnecting the holding unit and the blowing unit by optionally lifting the holding unit,
- introducing gas, preferably air, into the inner space for causing the gas to flow into the pelt board via the one aperture,
- disconnecting the holding unit and the blowing unit and preferably moving the holding unit to a pelt release station including the release mechanism, and,
- operating the release mechanism thereby causing the pelt board to assume the non-expanded state.

By operating the release mechanism, all pelt boards are caused to assume the collapsed state. The release mechanism may be manual or automated.

The method according to the seventh aspect is preferably used together with the system according to the sixth aspect. The system is preferably modular.

The above need and the above object is according to the teachings of the present invention achieved in an eight aspect of the present invention by a drying system for accommodating a plurality of elongated hollow pelt boards, each of the pelt boards having a pelt board top, a pelt board bottom for receiving drying air and a connecting element at the pelt board bottom, the drying system comprising a drying unit, the drying unit defining a top plate having a number of primary apertures, each of the primary apertures accommodating an adapter, each of the adapters defining a secondary aperture, the secondary aperture being capable of accommodating the connecting element of one of the pelt boards and allowing passage of drying air from the drying system to the pelt board, the drying unit defining entrainment openings in the adapter and/or between the top plate and the adapter, the entrainment openings being located adjacent each of the secondary apertures allowing a non-obstructed passage of drying air from the drying unit to the pelt board when the connecting element is accommodated in the secondary aperture of the adapter The present adapter allows the pelt board to be held in a very stable position and additionally allows pelt boards of different sizes to be attached to the drying unit by exchanging the adapter to another adapter of different size. The outer shape of the adapter may be standardized in order to fit in the primary aperture of the top plate of the drying unit, whereas the secondary aperture is adapted to a specific connecting element of a specific pelt board in order to hold the pelt board in a very stable position.

The adapter holds the connecting element securely while allowing drying air to pass in mutually cooperating channels between the connecting element and the adapter. However, the air channels thereby established must necessarily cause the airflow to have a non-linear path, i.e. the connecting part will act as an obstruction for the air flowing from the drying system through the secondary aperture and into the pelt board. By establishing entrainment openings adjacent the secondary aperture, some amount of air may flow unobstructed by the connecting element from the drying unit through the entrainment openings into the pelt board. In this way, more air is led into the pelt board from the additional contribution of the entrainment openings. Further, since the entrainment openings provide an unobstructed flow path through the adapter, the flow velocity through the entrainment openings of the adapter will exceed the flow velocity through the secondary aperture of the adapter. This will establish a so-called entrainment effect, also known as ejector effect, as the high flow velocity through the entrainment opening will reduce the air pressure at the interface between the pelt board and the adapter which will cause additional air to be sucked into the pelt board via the secondary aperture of the adapter, all according to the well known Bernoulli principle. The entrainment opening should be located adjacent the secondary aperture.

According to a further embodiment of the eight aspect, the secondary aperture is associated with more than one entrainment opening, such as 2-20 entrainment openings, preferably 2, 3, 4, 5, 6, 7 or 8 entrainment openings.

More entrainment openings adjacent the secondary aperture will enhance the entrainment effect.

According to a further embodiment of the eight aspect, each of the secondary apertures are surrounded by entrainment openings.

Preferably, the more than one entrainment opening are used in order to allow the entrainment openings to circumferentially enclose the secondary aperture in order to further enhance the entrainment effect.

According to a further embodiment of the eight aspect, the distance between any entrainment opening and an adjacent secondary aperture is less than 10 mm, such as 1-5 millimetres.

The entrainment openings should be adjacent the secondary aperture while still allowing the adapter a high structural strength.

According to a further embodiment of the eight aspect, the top plate comprises a primary top plate and a secondary top plate, the adapter being fixated between the primary top plate and the secondary top plate.

In this way, the adapter may be securely fastened in the drying system between the primary to plate and the secondary top plate.

According to a further embodiment of the eight aspect, the secondary top plate includes additional openings for supplying the aperture and/or the entrainment openings.

The secondary top plate may contribute to an efficient flow of air into the pelt board by being fitted with additional openings allowing air to flow through the secondary top plate into the secondary aperture and/or the entrainment opening without obstruction or with only minimal obstruction.

According to a further embodiment of the eight aspect, the adapter is made of a polymeric material, such as plastic.

In this way, the introduction and removal of the pelt board will be simplified.

According to a further embodiment of the eight aspect, the drying unit further including a bottom plate being parallel to and spaced apart from the top plate, a gas inlet for receiving a stream of gas, preferably air, and a sidewall interconnecting the top plate and the bottom plate in a fluid-tight manner for establishing an inner space between the top plate, the bottom plate, the gas inlet and the sidewall.

In this way, a drying unit or drying box may be established.

It is further contemplated that the connecting element and/or the adapter may be provided with flow channels for guiding air from the drying unit to the pelt board.

The above need and the above object is according to the teachings of the present invention achieved in a ninth aspect of the present invention by a method of drying a pelt by providing a drying unit, the drying unit defining a top plate having a number of primary apertures, each of the primary apertures accommodating an adapter defining a secondary aperture, the drying unit define entrainment openings adjacent each of the secondary apertures in the adapter, and/or, between the top plate and the adapter, the method further comprising the steps of:

accommodating the pelt on an elongated hollow pelt board having a pelt board top, a pelt board bottom for receiving drying air and a connecting element at the pelt board bottom, accommodating the connecting element of the pelt board in one of the secondary apertures of the top plate, and introducing gas, preferably air, into the pelt board bottom via the one secondary aperture partially obstructed by the connecting element and unobstructed via the adjacent entrainment openings.

The method according to the ninth aspect is preferably used with the system according to the eight aspect, and the method and system according to the respective eight and ninths aspects may further include features from the drying units and systems according to any of the first to seventh aspect.

The above need and the above object is according to the teachings of the present invention achieved in a tenth aspect of the present invention by a drying unit for accommodating a plurality of elongated hollow pelt boards, each of the pelt boards having a pelt board top, a pelt board bottom and a connecting element at the pelt board bottom, the drying unit defining:

a top plate having a number of apertures, each of the apertures being adapted for accommodating the connecting element, a bottom plate being parallel to and spaced apart from the top plate, a gas inlet for receiving a stream of gas, preferably air, and a sidewall interconnecting the top plate and the bottom plate in a fluid-tight manner for establishing an inner space between the top plate, the bottom plate, the gas inlet and the sidewall, the inner space defining a volume of at least 10 litres per aperture, preferably between 20 and 200 litres, more preferably between 50 and 100 litres.

The above need and the above object is according to the teachings of the present invention achieved in an eleventh aspect of the present invention by a method of drying a pelt by providing a drying unit, the drying unit defining:

a top plate having a number of apertures, a bottom plate being parallel to and spaced apart from the top plate, a gas inlet for receiving a stream of gas, preferably air, and a flexible sidewall interconnecting the top plate and the bottom plate in a fluid-tight manner for establishing an inner space between the top plate, the bottom plate, the gas inlet and the flexible sidewall, the inner space defining a volume of at least 10 litres per aperture, preferably between 20 and 200 litres, more preferably between 50 and 100 litres, and a lifting device interconnecting the bottom plate and the top plate, the lifting device being capable of moving the top plate and the bottom plate relative to one another, the method further comprising the steps of:

accommodating the pelt on an elongated hollow pelt board having a pelt board top, a pelt board bottom and a connecting element at the pelt board bottom, moving the lifting device to a first position in which the top plate and the bottom plate are adjacent each other, accommodating the connecting element of the pelt board in one of the apertures of the top plate, moving the lifting device to a second position in which the top plate and the bottom plate are distant each other, and introducing gas, preferably air, into the inner space for causing the gas to flow into the pelt board via the one aperture.

The method according to the ninth aspect is preferably used with the system according to the eight aspect.

BRIEF DESCRIPTION OF THE DRAWINGS

FIG. 8A is a perspective cut-out view of the above drying unit having multiple hoses.

FIG. 8B is a perspective view of the above drying unit showing the flow of air.

FIG. 9A is a perspective view of the airflow in a hose as a flow distributor.

FIG. 9B is a perspective view of the airflow in another hose as a flow distributor.

DETAILED DESCRIPTION OF THE DRAWINGS

Figure 1B:
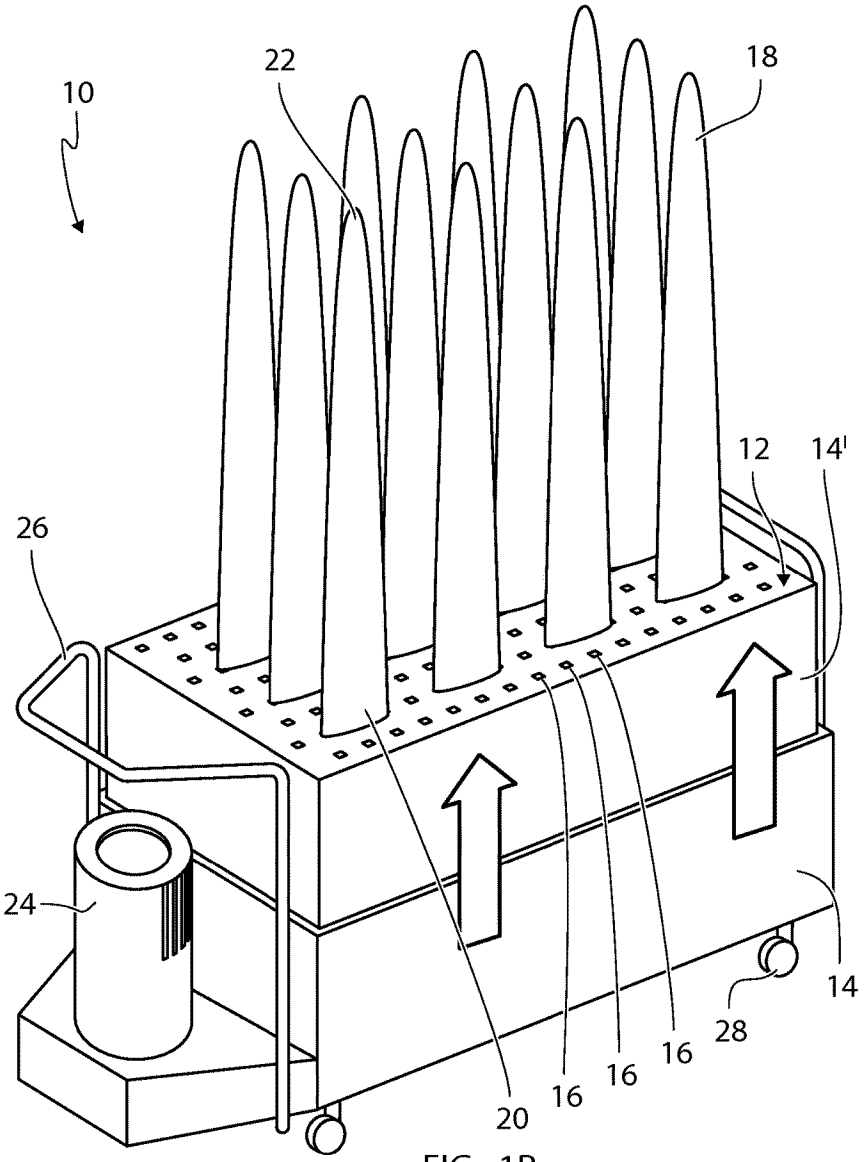
FIG. 1B is a perspective view of a drying unit in a second high position.
Figure 1A:
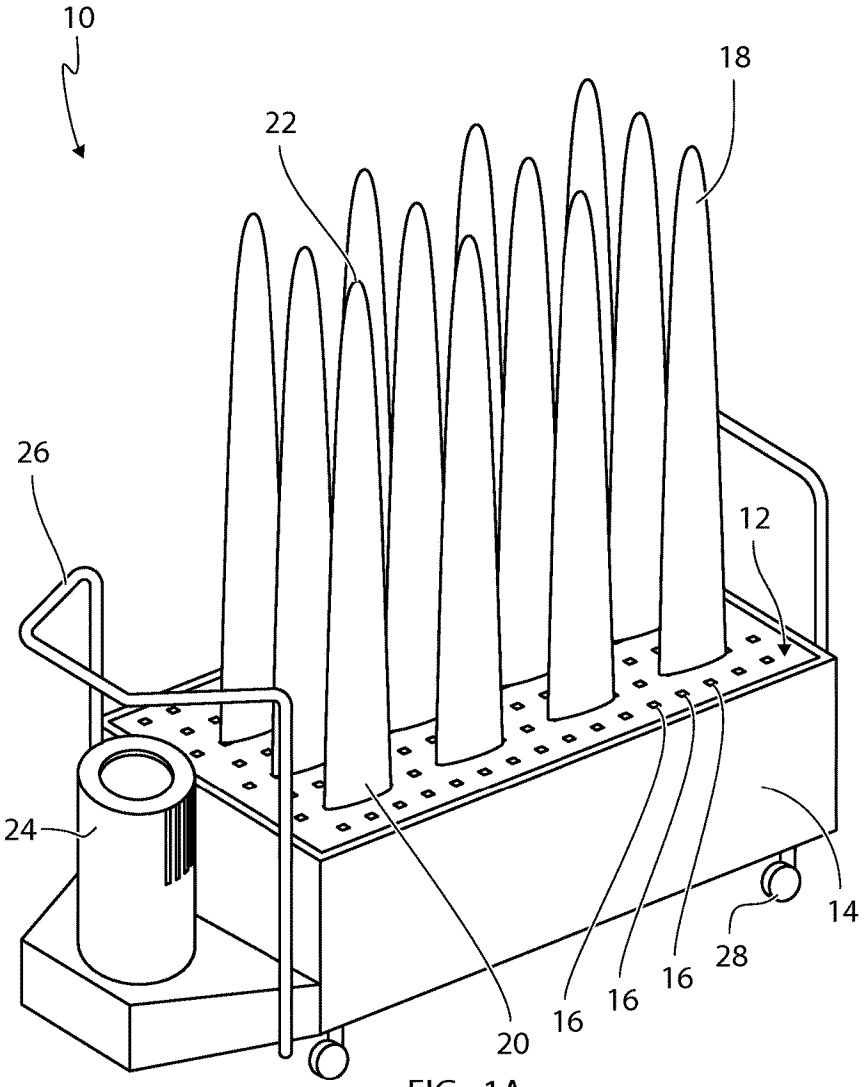
FIG. 1A is a perspective view of a drying unit in a first low position.

FIG. 1A shows a perspective view of a drying unit 10 in a first low position. The drying unit comprise a top plate 12, a flexible sidewall 14 and a bottom wall (not visible) opposite the top wall 12. The top wall 12 is provided with apertures 16. Each of the apertures 16 are adapted for accommodating a pelt board 18. The pelt board 18 has an elongated and convex shape defining a top 20 and a bottom 22, and accommodate a pelt (not shown) stretched onto the outside of the pelt board 18. The pelt board 18 is hollow and adapted for receiving air from the corresponding aperture 16. The air is delivered from an on board blower 24 via an inner space of the drying unit 10. For easy transportation, the drying unit is provided with a handle 26 and wheels 28. The sidewall 14 is flexible and in the present view the drying unit 10 is in the low position suitable such that the top plate 12 has a suitable height for a user placing and removing pelt boards 18 from the top plate 12. The distance between the bottom plate and the top plate 12 is typically below 200 mm, such as 100 mm.

Figure 2A:
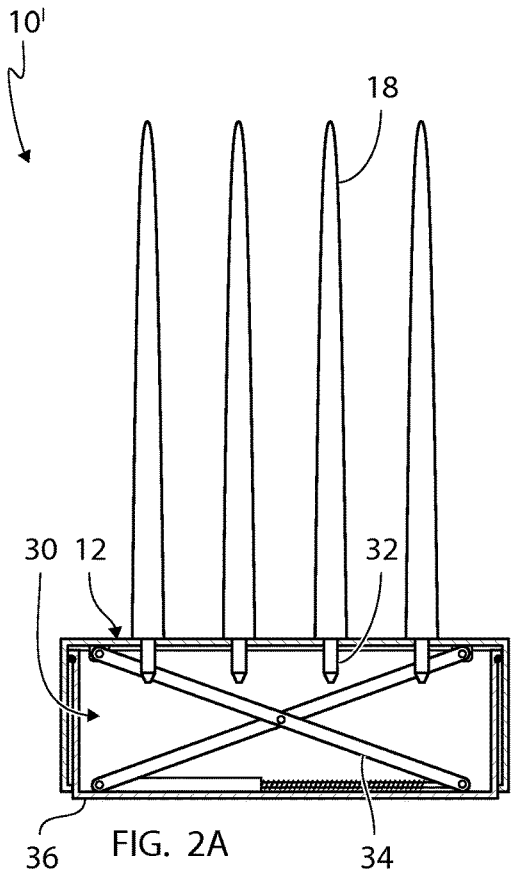
FIG. 2A is a side view of a mechanical drying unit in a first low position.

FIG. 1B shows a perspective view of the drying unit 10 in a second high position. The flexible sidewall 14 in the present embodiment is telescopic comprising a second sidewall element 14'. In this way the volume of the inner space of the drying unit 10 is doubled, allowing the airflow through the inner space of the drying unit 10 to define a lower velocity and thereby a more uniform flow pattern. This position is suitable for the drying operation. The distance between the bottom plate and the top plate is at least 200 mm, such as between 200 mm and 2500 mm, preferably between 250 mm and 1000 mm, more preferably between 300 mm and 800 mm, most preferably between 400 mm and 600 mm FIG. 2A shows a side view of a mechanical drying unit 10' in a first low position. The inner space 30 is visible in a cut-through perspective, and it can be seen that a connecting element 32 of the pelt board 18 reaches into the inner space 30 and arrests the pelt board 18. A mechanical lifting device 34 is located in the inner space between the top plate 12 and the bottom plate 36. The mechanical lifting device 34 may e.g. be driven by an electrical motor (not shown) or by hand via a gear (not shown).

Figure 2B:
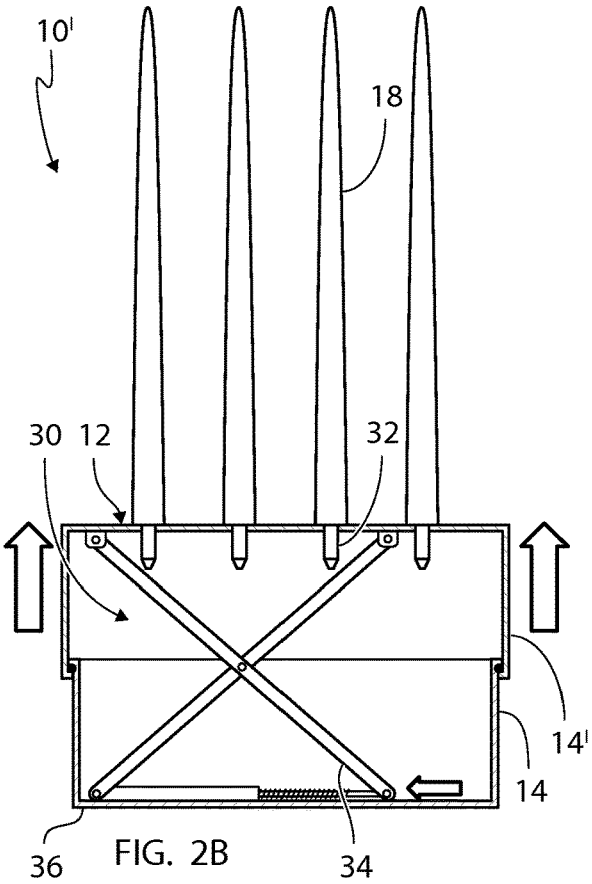
FIG. 2B is a side view of a mechanical drying unit in a second high position.

FIG. 2B shows a side view of the mechanical drying unit 10' in a second high position. The top plate 12 is raised from the bottom plate 36 by using the mechanical lifting device 34 as shown by the arrows thereby increasing the volume of the inner space 30. The flexible wall has two elements 14, 14', which are sealed in a telescopic configuration.

Figure 3A:
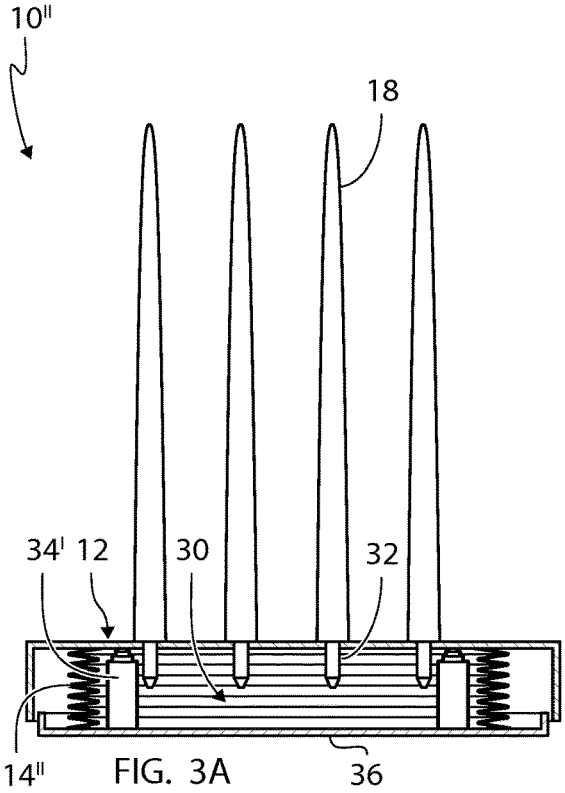
FIG. 3A is a side view of a hydraulic drying unit in a first low position.

FIG. 3A shows a side view of a hydraulic drying unit 10" in a first low position similar to the previous embodiment, however, the lifting device 34' is hydraulic (or pneumatic) and the flexible sidewall 14" is pleated.

Figure 3B:
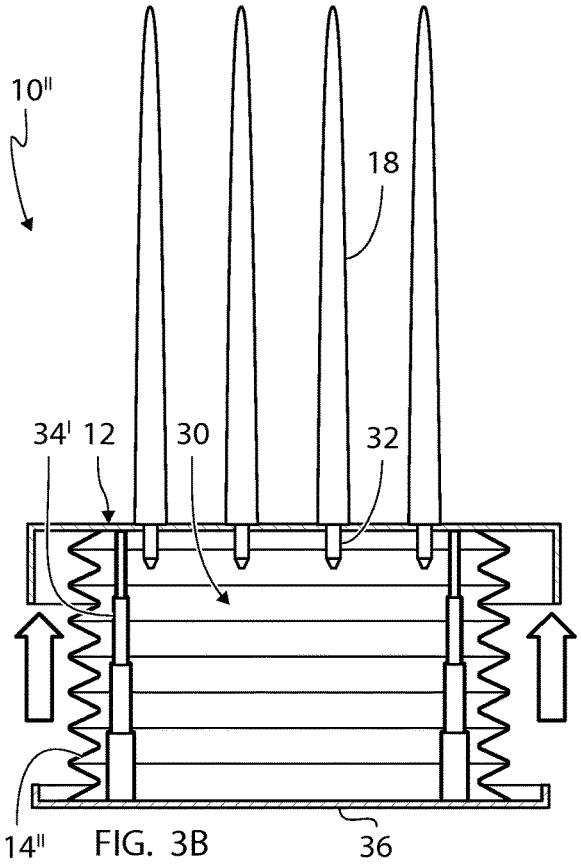
FIG. 3B is a side view of a hydraulic drying unit in a second high position.

FIG. 3B shows a side view of the hydraulic drying unit in a second high position, similar to the previous embodiment. It should be noted that combinations of the above embodiment 10' and 10" are possible such as a drying unit having a hydraulic lifting device and a telescopic sidewall or a as a drying unit having a mechanical lifting device and a pleated sidewall.

Figure 3D:
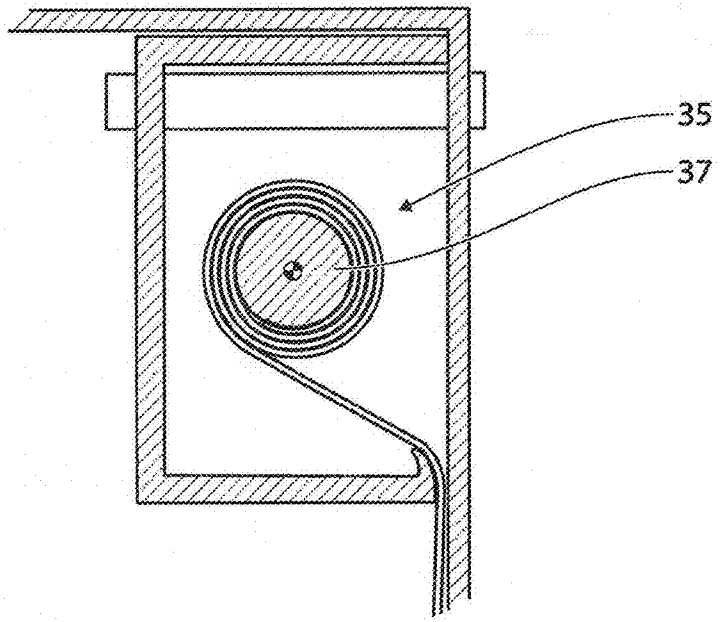
FIG. 3D is a side close-up view of the roll-up mechanism of the above drying unit.
Figure 3C:
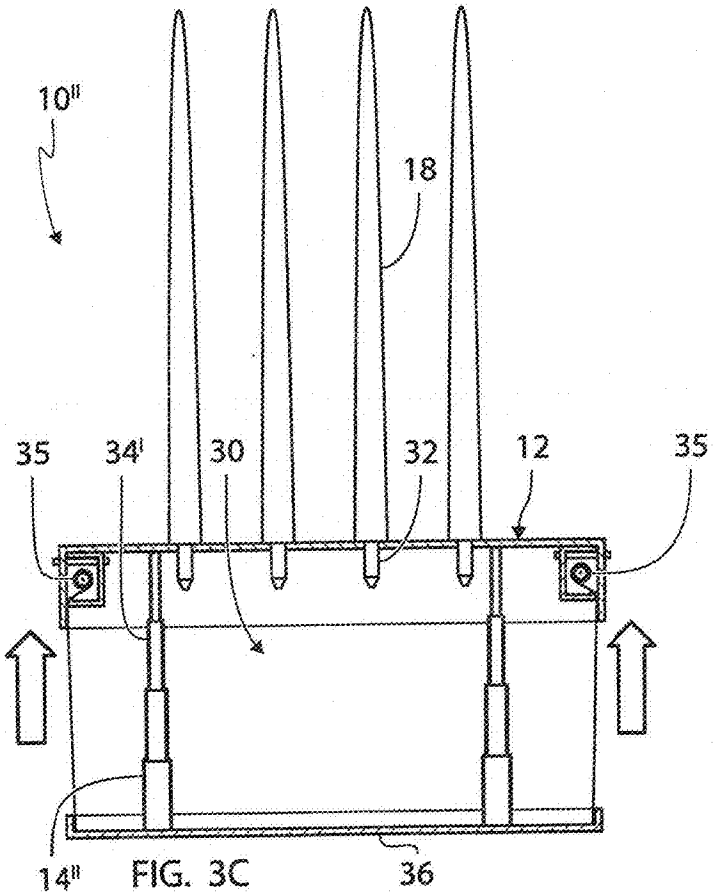
FIG. 3C is a side view of another hydraulic drying unit using a roll-up element.

FIG. 3C shows a side view of another hydraulic drying unit using a roll-up element 14'" instead of the pleated wall. The roll-up element 14'" is resembling a roll-up curtain made of fluid tight flexible material and is fixated between the top plate 12 and the bottom plate 36. The top plate 12 comprises a roll-up mechanism 35, which is described in more detail below.

FIG. 3D is a side close-up view of the roll-up mechanism 35 of the above drying unit 10". The roll-up mechanism comprises a cylinder 37, which may either be motor driven or tensioned by a spring or the like so that there is always tension in the roll-up element 14'" between the top plate 12 and the bottom plate 36.

Figure 4A:
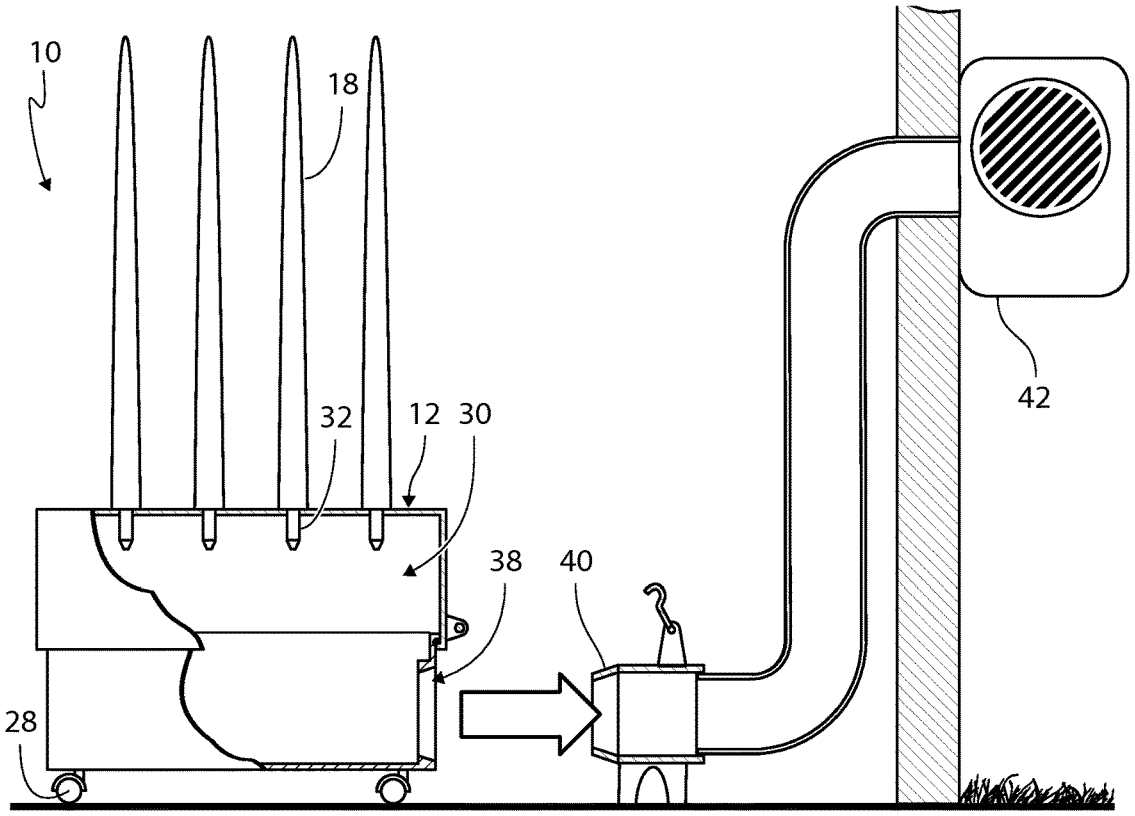
FIG. 4A is a side view of a drying unit and an external blower.

FIG. 4A shows a side view of a drying unit 10 having a gas inlet 38, which is capable of cooperating with an external blower 40. The external blower receives air from an outside unit 42.

Figure 4B:
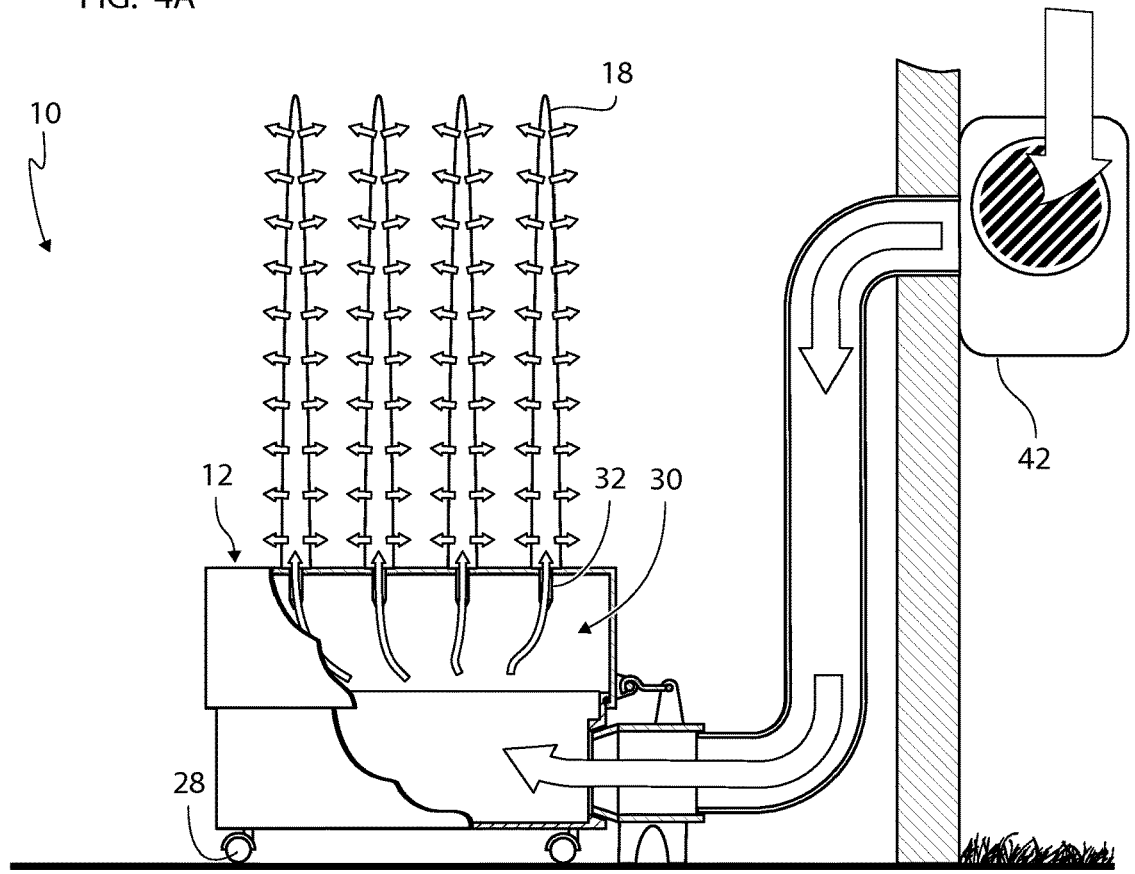
FIG. 4B is a side view of a drying unit connected to an external blower.

FIG. 4B shows a side view of the drying unit 10 when connected to the external blower 40. The airflows from the outside 42 via the blower 40, the gas inlet 38, the inner space 30 through the apertures 16 in the top plate 12 into the pelt board 18, through the pelt as shown by the arrows.

Figure 5A:
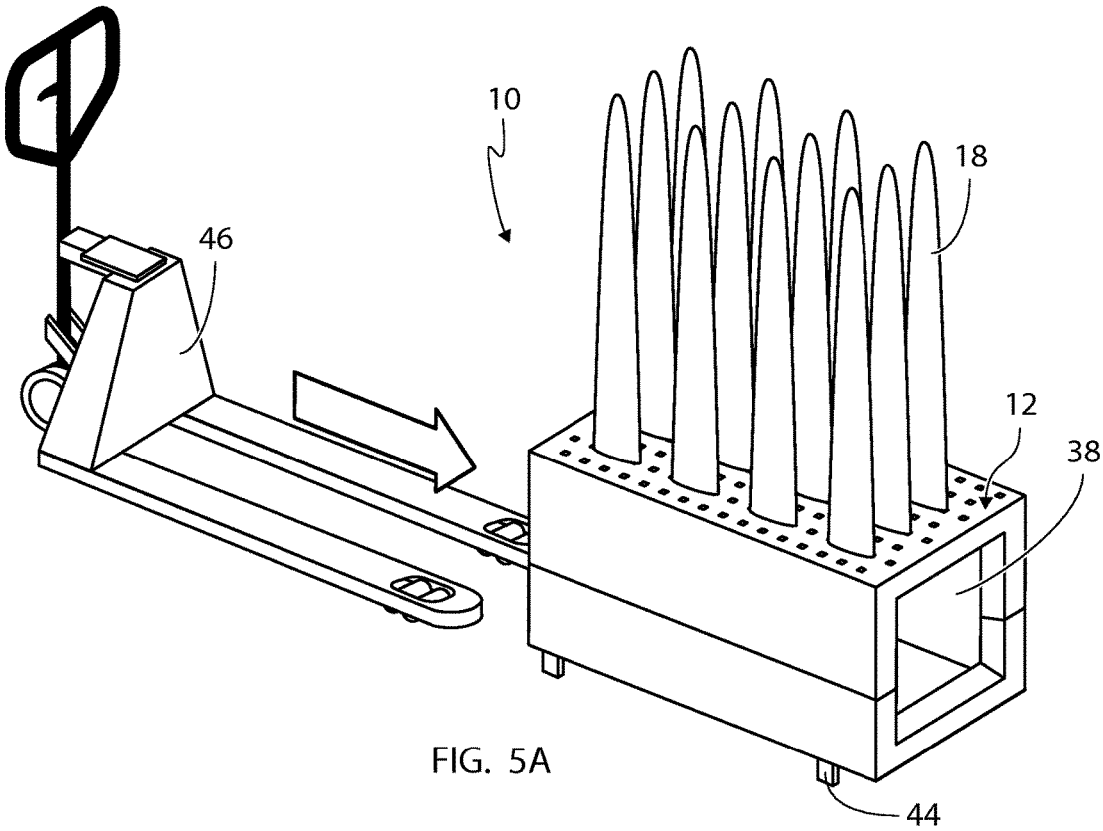
FIG. 5A is a side view of a drying unit having feet and a floor jack.

FIG. 5A shows a side view of a drying unit 10 having feet 44 and a floor jack 46 for moving the drying unit 10. In this way, the drying unit 10 must not have wheels and may be positioned more stable.

Figure 5B:
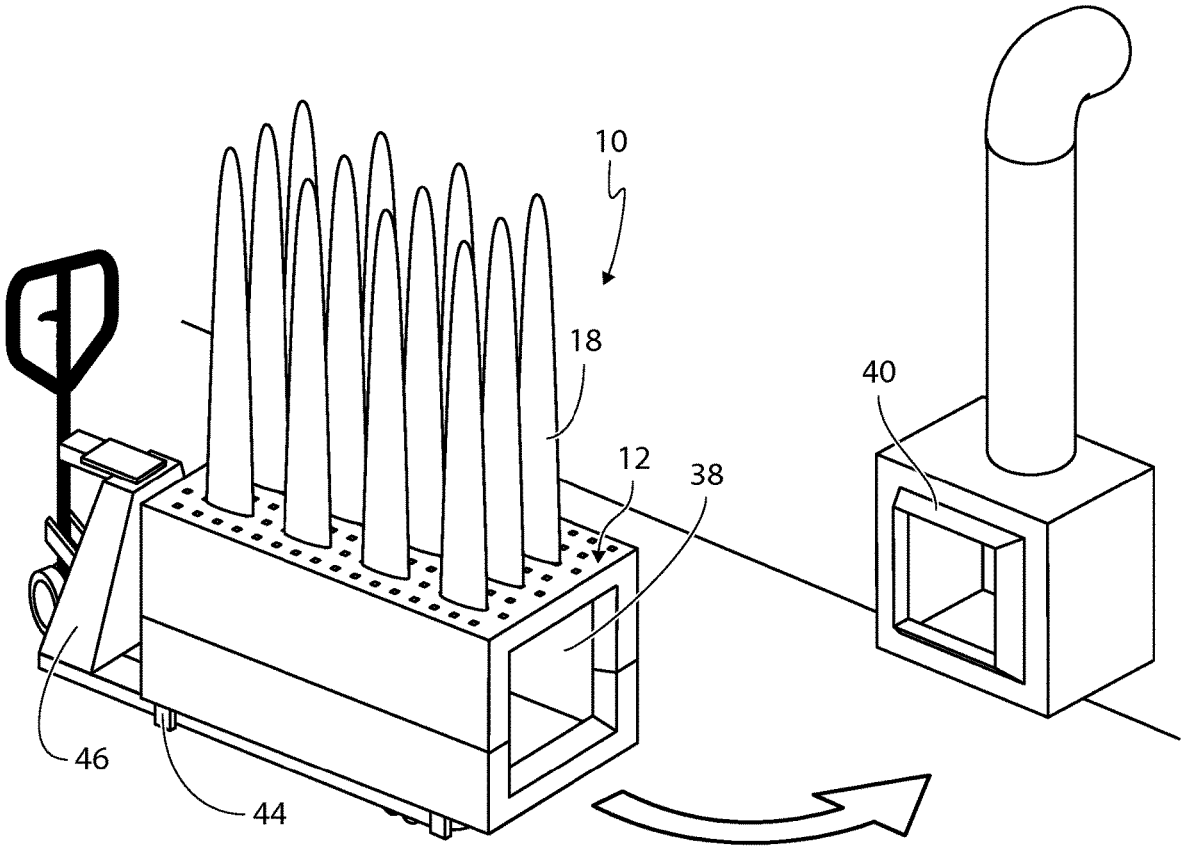
FIG. 5B is a side view of a drying unit having feed when moved to an external blower.

FIG. 5B shows a side view of a drying unit 10 having feet 44 when moved to an external blower 40. Of course, a drying unit having feet and an on board blower would be equally feasible.

Figure 6:
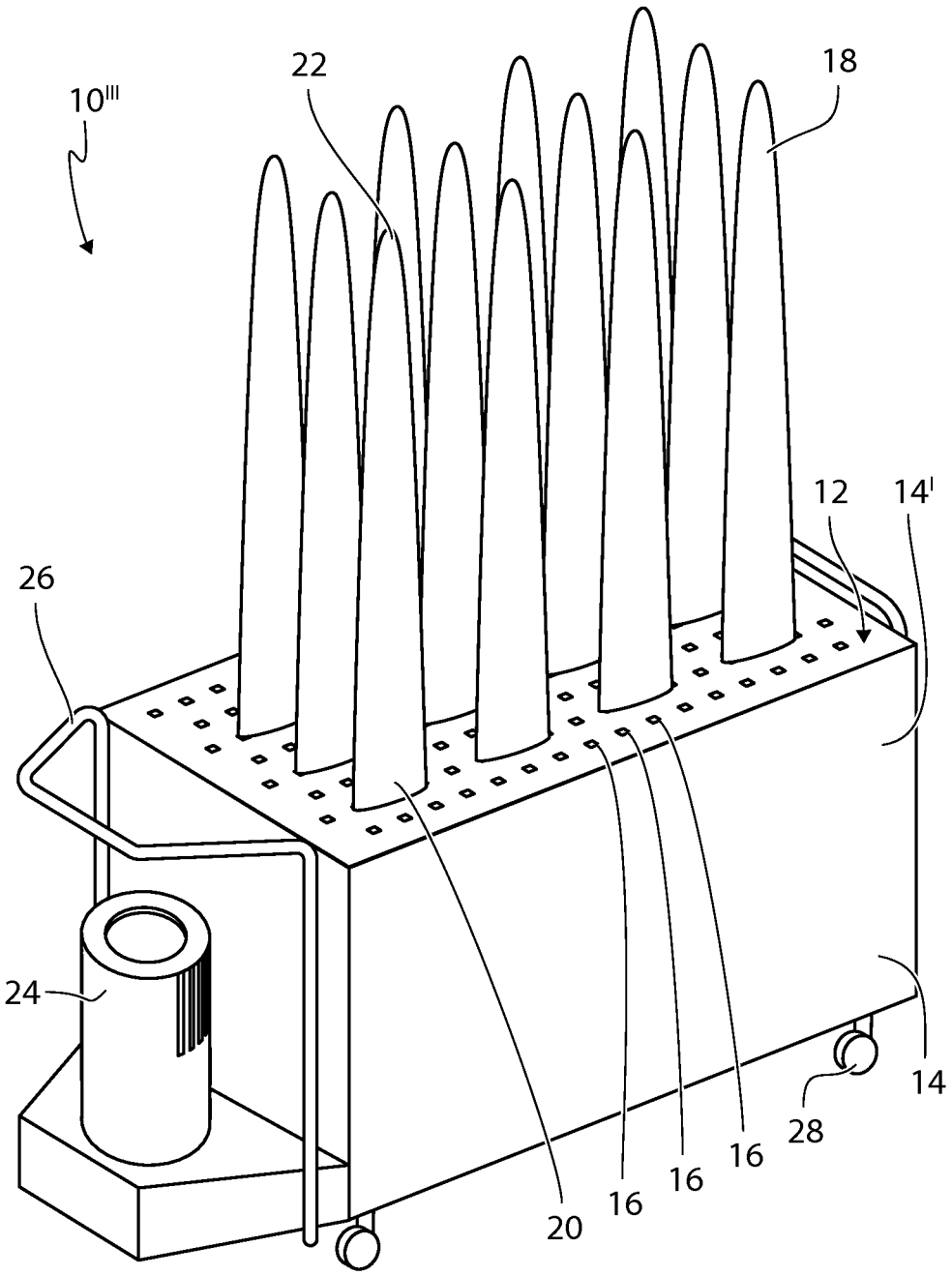
FIG. 6 is a perspective view of a drying unit having a fixed height.

FIG. 6 shows a perspective view of a drying unit 10'" having a fixed height. This may be considered an economic solution in which the flow pattern is improved and no lifting device is needed, thus saving some costs, however, in this way the ergonomics will be less optimal compared to the prior art. The distance between the bottom plate adjacent the ground and the top plate will thus be at least 200 mm, such as between 200 mm and 2500 mm, preferably between 250 mm and 1000 mm, more preferably between 300 mm and 800 mm, most preferably between 400 mm and 600 mm.

Figure 7A:
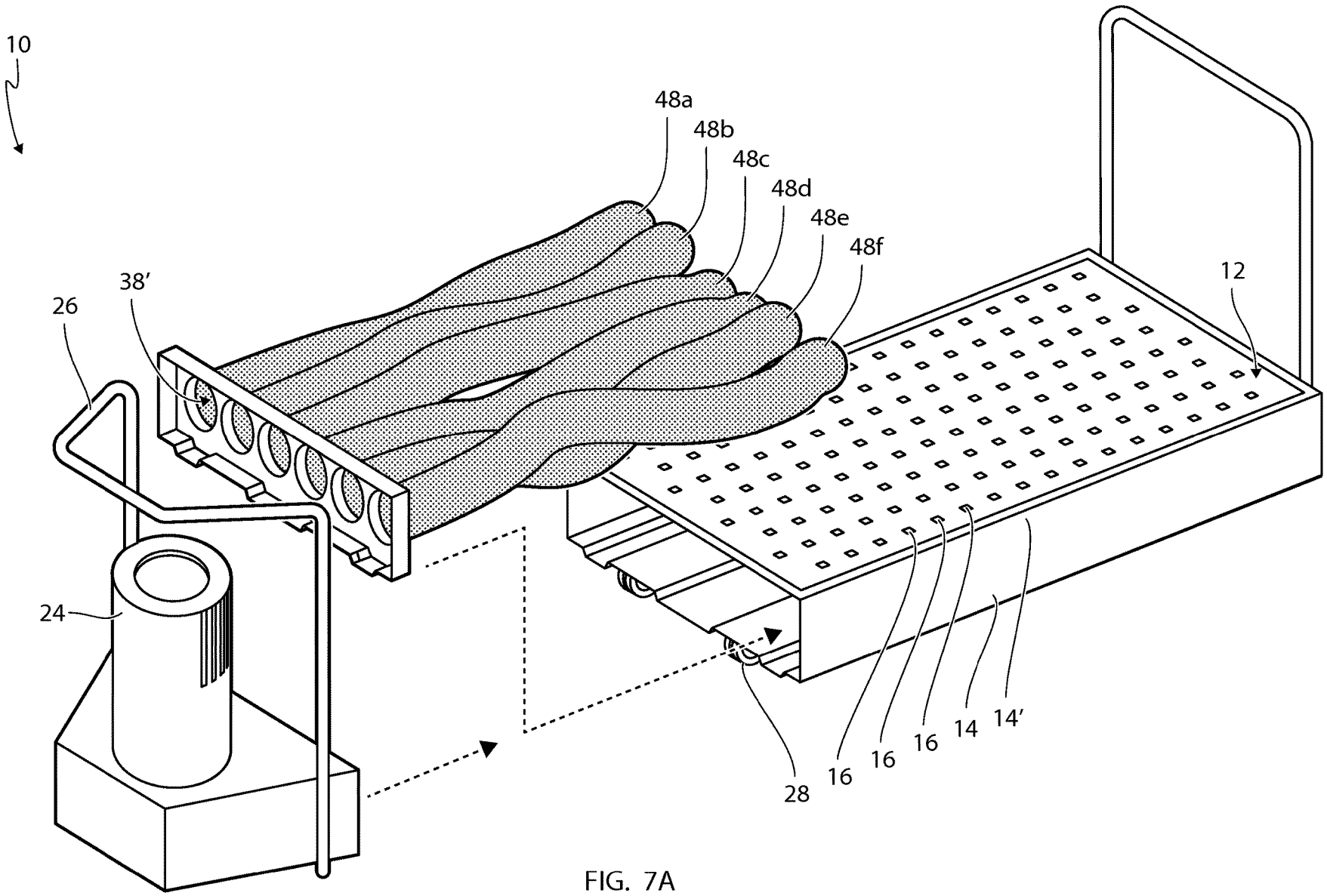
FIG. 7A is a perspective exploded view of a drying unit having multiple hoses.

FIG. 7A shows a perspective exploded view of a drying unit 10 having multiple hoses 48*a-f* as flow distributor. The hoses 48*a-f* are made of a flexible web material of natural or synthetic fibres, and form a flexible textile. The flow inlet 38' corresponds to the hoses 48*a-f*.

Figure 7B:
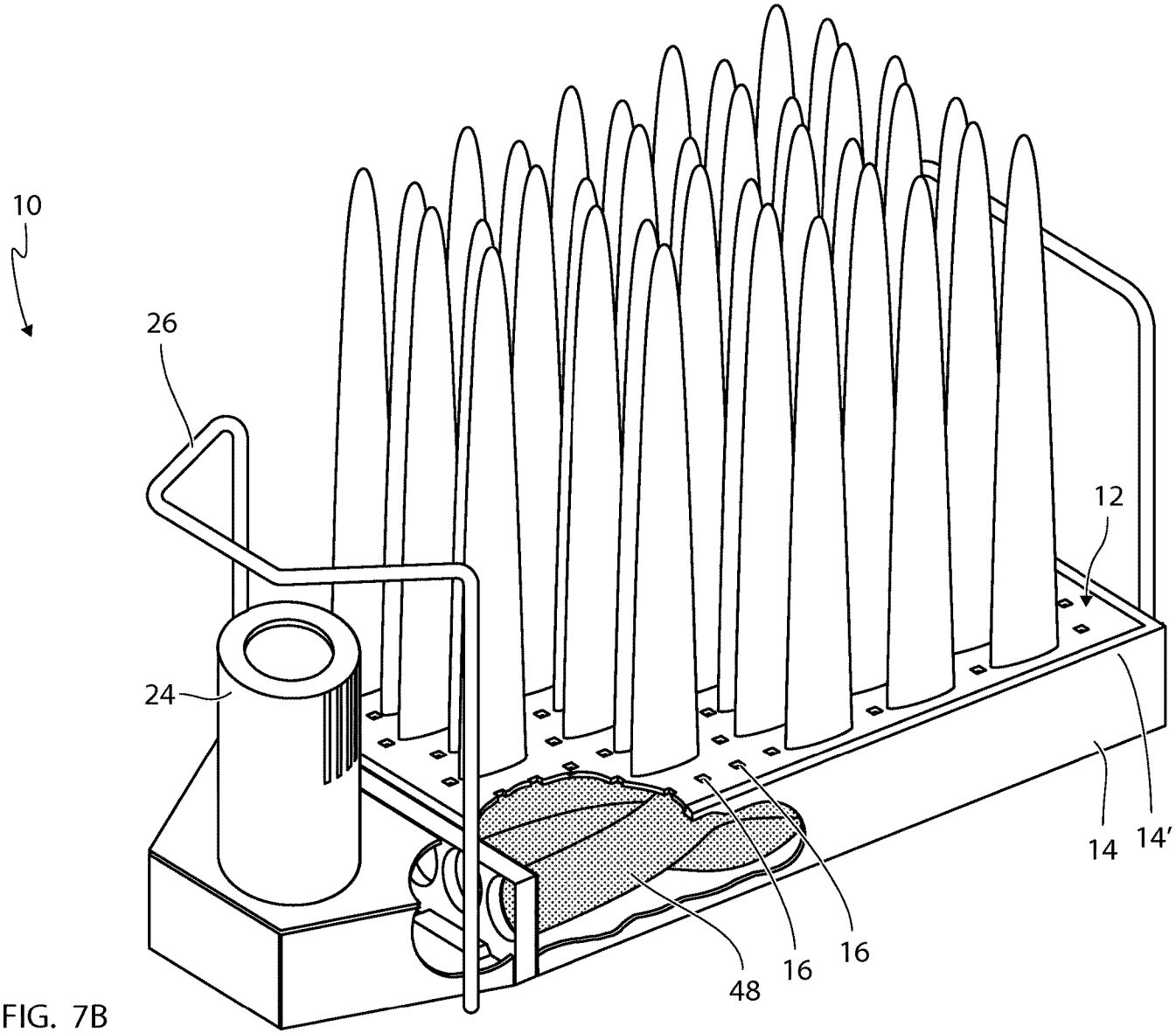
FIG. 7B is a perspective view of the above drying unit having hoses as flow distributor.

FIG. 7B shows a perspective view of the above drying unit 10 in a first low position. The drying unit 10 is assembled and the hoses 48 are inside the inner space of the drying unit and as such visible anymore.

FIG. 8A shows a perspective cut-out view of the above drying unit 10 having multiple hoses 48*a-f*. As the blower 24 forces air into the flow inlet 38, the air distributes in the hoses 48*a-f*. The hoses 48*a-f* extend into the inner space 30 of the drying unit 10 and together cover the bottom plate 36 more or less completely. The air penetrates the gaps in the web structure of the hoses in a substantially uniform way and distributes within the inner space 30. The hoses 48*a-f* effectively splits the inner space 30 into a lower part, which is in fluid communication with the inlet 38" and an upper part in fluid communication with the apertures 16 of the top plate 12. When air (or gas) is introduced into the hoses 48*a-f* through the inlet 38", a pressure difference will be established over the hoses 48*a-f* causing the hoses to 48*a-f* inflate and expand. The air leaks through the web material of the hoses and the higher the pressure difference, the more the hoses will expand and the gaps in the web material of the hoses 48*a-f* will be larger, allowing more air to penetrate. In this way, the pressure is uniformly distributed within the hoses 48*a-f*.

FIG. 8B shows a perspective view of the above drying unit 10 showing the flow of air through the apertures 16. The flow originates from the hoses as described in the previous figure and the flow is substantially uniform between the apertures 16.

FIG. 9A shows a perspective view of the airflow in a hose 48 as a flow distributor. The airflow is substantially uniform in all directions since the complete hose 48 is made of a flexible web material.

FIG. 9B shows a perspective view of the airflow in another hose 48' as a flow distributor. The airflow is substantially uniform through the upper side of the hose 48', i.e. the part of the hose 48' facing the top plate, whereas there is no flow through the lower side of the hose 48', i.e. the part of the hose 48' facing the bottom plate. The upper part of the hose is thus made of a flexible web material, whereas the lower part of the hose 48' is made of a fluid tight material such as rubber. In this way, most of the flow may be directed towards the upper plate, which may further reduce turbulence and other negative flow effects within the inner space 30.

Figure 10:
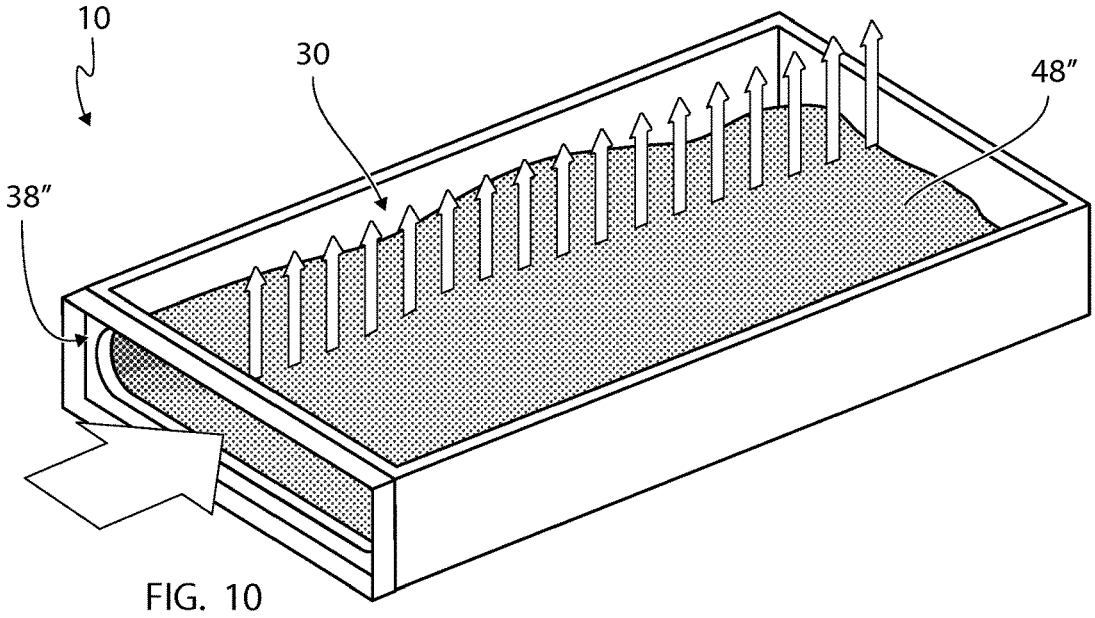
FIG. 10 is a perspective view of a drying unit having one large hose as flow distributor.

FIG. 10 shows a perspective view of a drying unit 10 having one large hose 48" as flow distributor. The large hose 48", which is made of a flexible web material, may be manufactured to extend into the inner space 30 to cover most of the bottom plate 36 and effectively splits the inner space 30 into a lower part, which is in fluid communication with the inlet 38" and an upper part in fluid communication with the apertures 16 of the top plate 12.

Figure 11A:
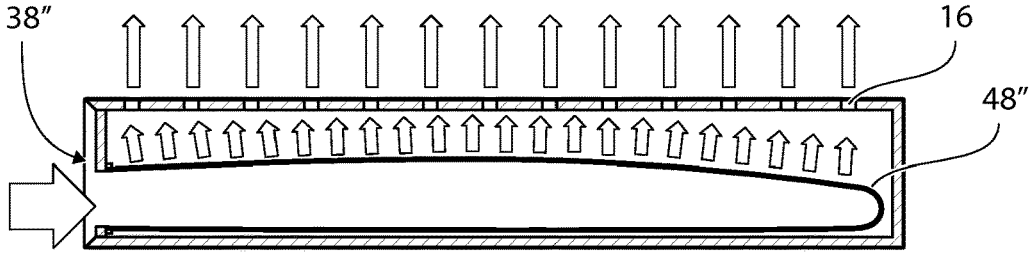
FIG. 11A is a side view of the above drying unit having one large hose.

FIG. 11A shows a side view of the above drying unit 10 having one large hose 48". The uniform structure of the large hose yields a uniform flow distribution in the inner space 10 above the large hose 48". The large hose 48" may be manufactured in the same material as the previous hoses and optionally with a fluid tight lower part.

Figure 11B:
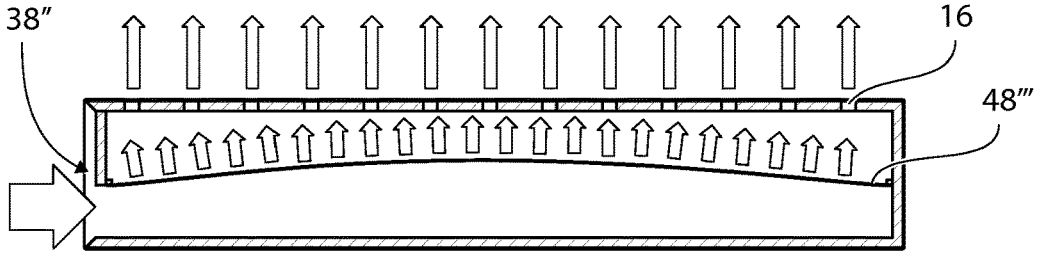
FIG. 11B is a side view of a drying unit having a flexible membrane.

FIG. 11B shows a side view of a drying unit 10 having a flexible membrane 48'" made of a web material. The membrane 48'" extends between the sidewalls 14 and effectively splits the inner space 30 into a lower part, which is in fluid communication with the inlet 38" and an upper part in fluid communication with the apertures 16 of the top plate 12. The membrane 48'" may be manufactured in the same material as the above-mentioned large hose and optionally with a fluid tight lower part. The working principle is similar to the large hose.

Figure 11C:
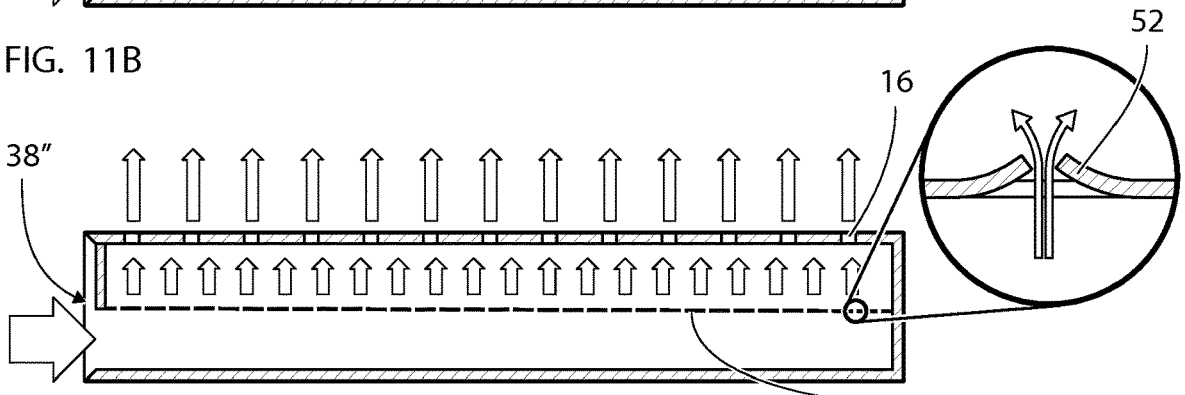
FIG. 11C is a side view of a drying unit having a plate and flexible vent members.

FIG. 11C shows a side view of a drying unit 10 having a flow guiding plate 50 comprising flexible vent members 52. The flow guiding plate 50 extends between the sidewalls 14 and effectively splits the inner space 30 into a lower part, which is in fluid communication with the inlet 38" and an upper part in fluid communication with the apertures 16 of the top plate 12. The vent members 52 consist of flexible flaps, which are closed or exhibit a small opening when the pressure difference over the flow guiding plate 50 is low or non existent. At higher pressure differences over the plate the flaps will exhibit a larger opening, thus mimicking the effect of the flexible hoses described above.

Figure 12A:
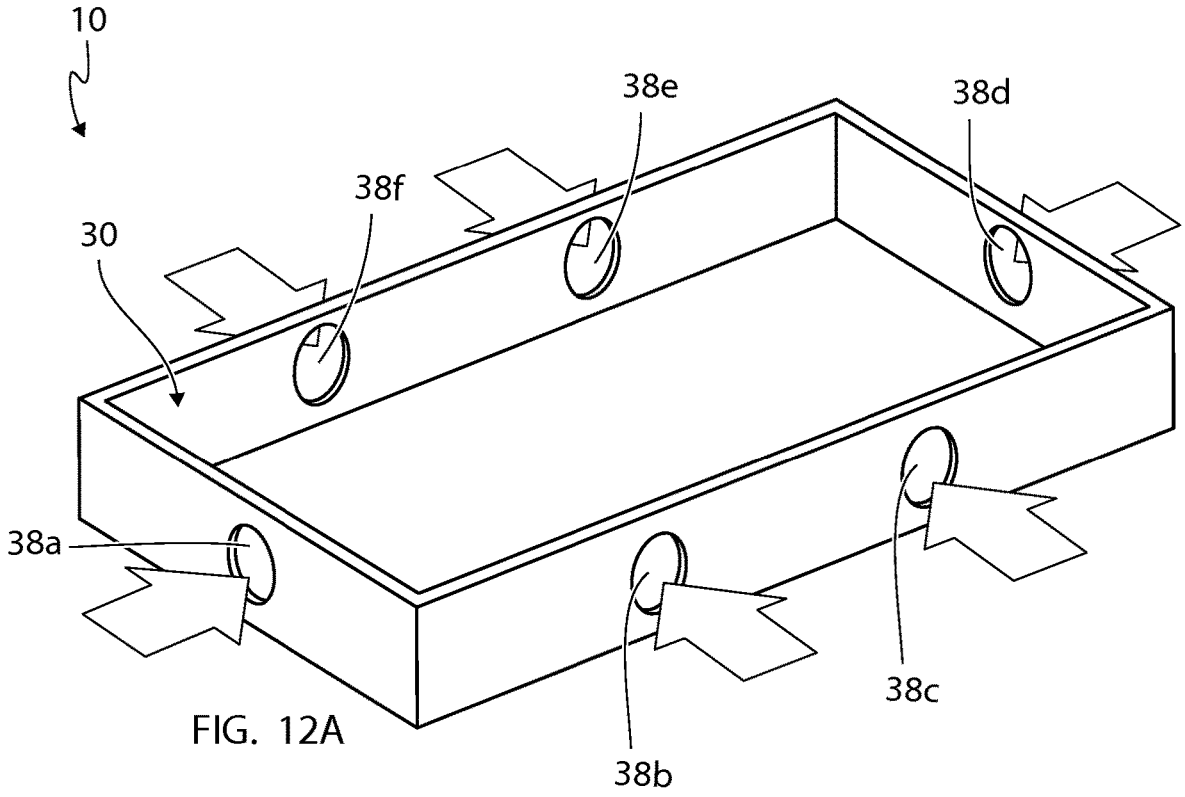
FIG. 12A is a perspective view of a drying unit having multiple side inlets.

FIG. 12A shows a perspective view of a drying unit 10 having multiple side inlets 38*a-f*. The side inlets 38*a-f* are distributed on the sidewalls 16 of the drying unit 10 for achieving a uniform flow pattern in the inner space 30.

Figure 12B:
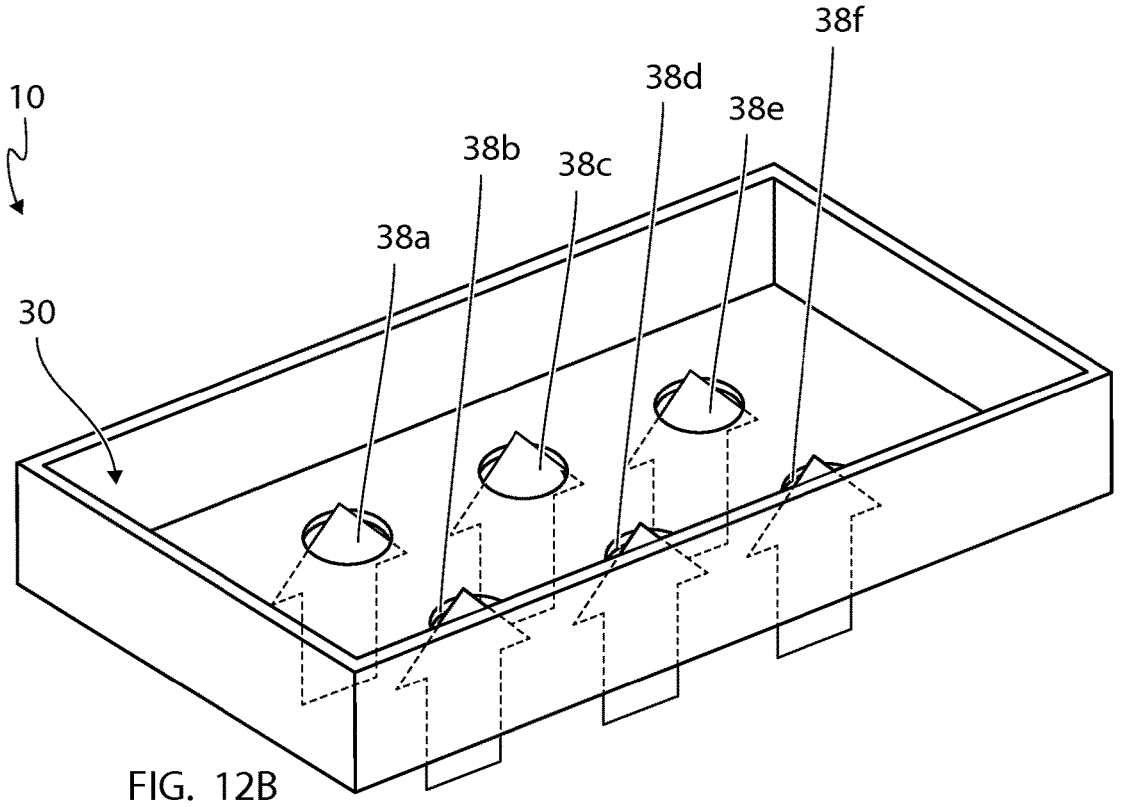
FIG. 12B is a perspective view of a drying unit having multiple bottom inlets.

FIG. 12B shows a perspective view of a drying unit 10 having multiple bottom inlets 38*a-f*. The bottom inlets 38*a-f* are distributed on the bottom plate 36 of the drying unit 10 for achieving a uniform flow pattern in the inner space 30. This setup has the advantage that the general flow direction of the air through the inner space 30 must not be redirected.

Figure 13A:
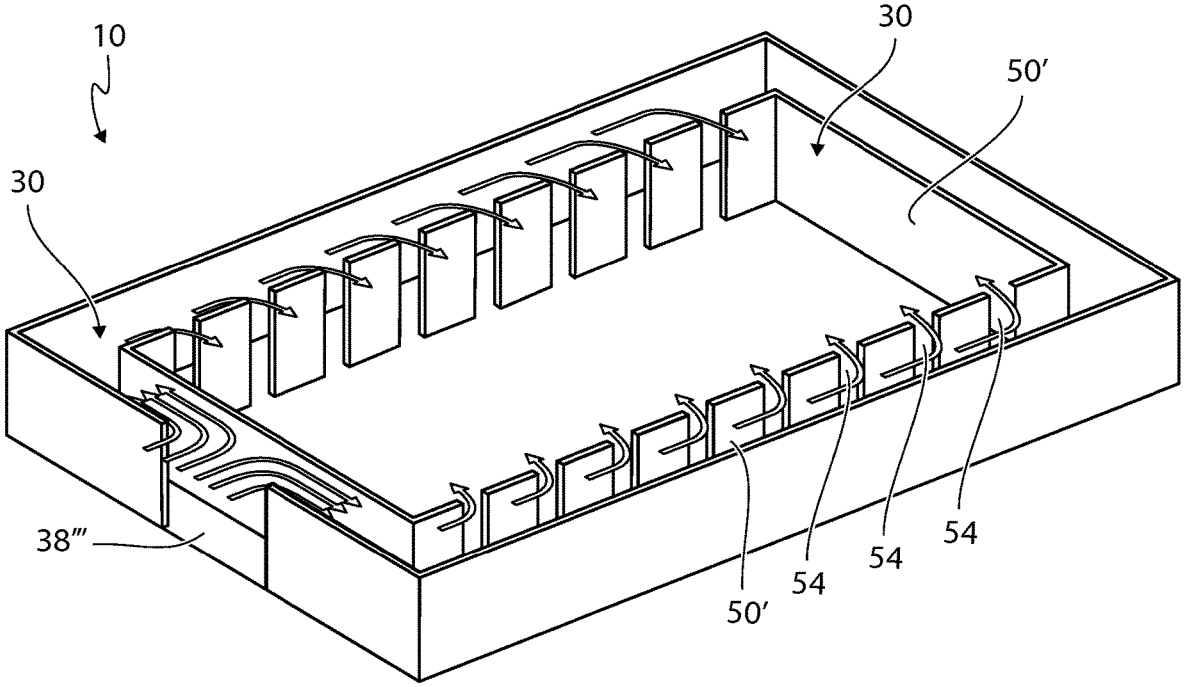
FIG. 13A is a perspective view of a drying unit having flow guiding plates.

FIG. 13A shows a perspective view of a drying unit 10 having flow guiding plates 50' in the inner space 30. The flow guiding plates 50' mimic the sidewall inlets of the previous embodiment. Air (or gas) is received through a common inlet 38'" in the sidewall 16. The air is led by the plates 50 and through openings 54, which are distributed along the circumference of the inner space for distributing the air within the inner space 30 and achieve a uniform flow pattern.

Figure 13B:
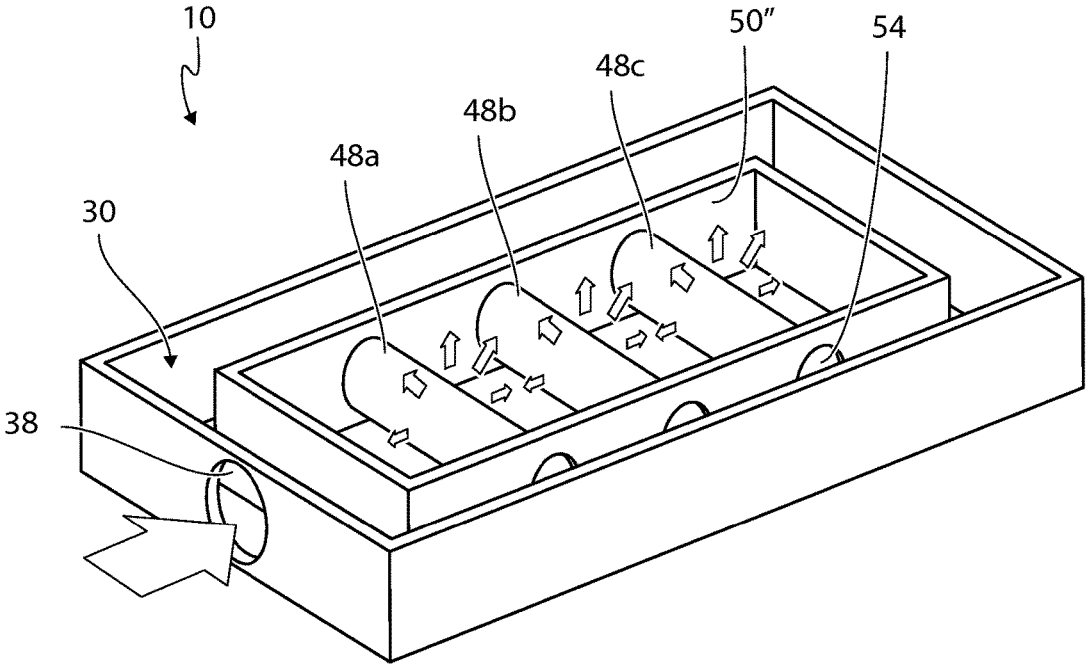
FIG. 13B is a perspective view of a drying unit having hoses with opposing fixation.

FIG. 13B shows a perspective view of a drying unit 10 having hoses 48*a-c* which are fixated on both sides. The hoses are similar to the previously described hoses, however, the hoses 48 do not extend from the gas inlet 38 but from openings 54 in a flow guiding plate 50" within the inner space 30. This configuration may reduce any possible movement of the hoses within the inner space.

Figure 13C:
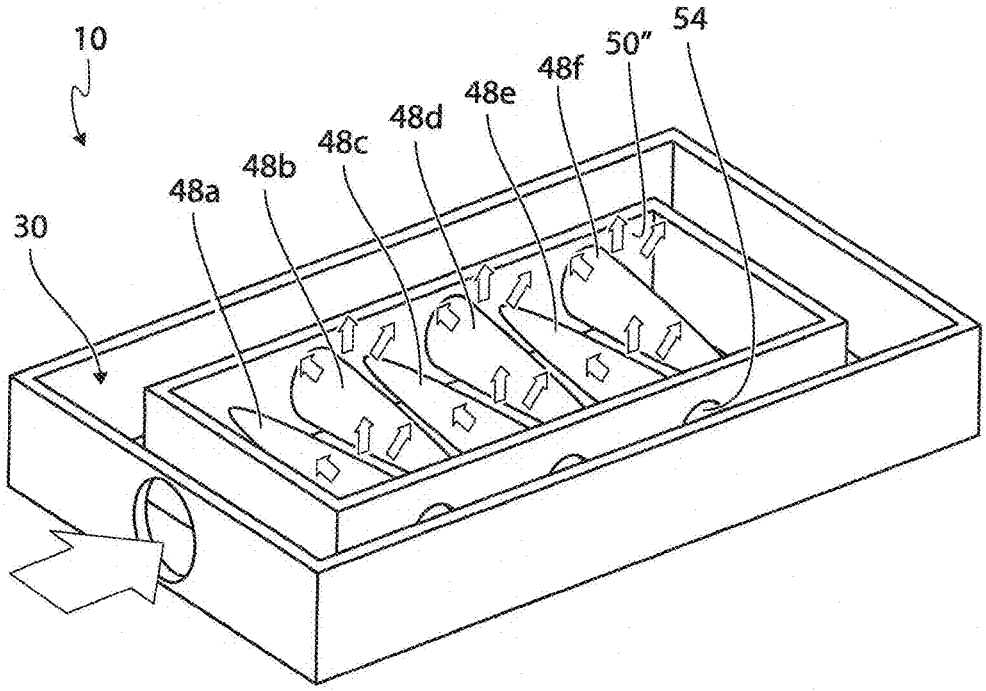
FIG. 13C is a perspective view of a drying unit having tapered hoses.

FIG. 13C shows a perspective view of a drying unit 10 having hoses 48*a-f* which are tapered. The hoses are similar to the previously described hoses but are only fixated on one side. The hoses 48 thus extend from openings 54 in a flow guiding plate 50" within the inner space 30 in an alternating configuration. The hoses may thus be made shorter and the movement of the hoses reduced.

Figure 14A:
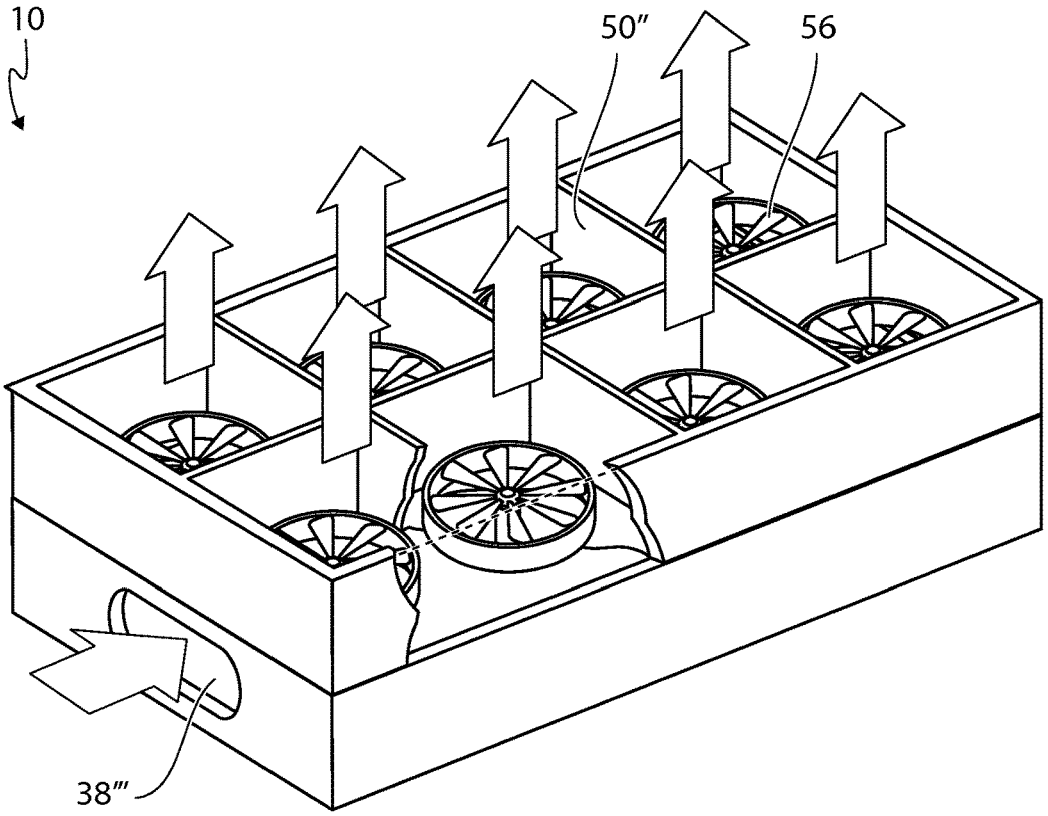
FIG. 14A is a perspective view of a drying unit having cells and fans.

FIG. 14A shows a perspective view of a drying unit 10 having cells and fans 56. The cells are formed by plates 50", which divide the inner space 30 into separate spaces between a common inlet 38'" and the top plate (not shown). Each cell is in fluid communication with a number of apertures (not shown) of the top plate (not shown). The number of apertures per cell may vary. In an extreme case each aperture may communicate with a separate cell. Each cell also optimally includes a fan 56 which fans may serve as the sole blowers or in conjunction with an on board or external blower as previously described. In this way, the cells will receive a constant flow of air and recirculation effect may be reduced.

Figure 14B:
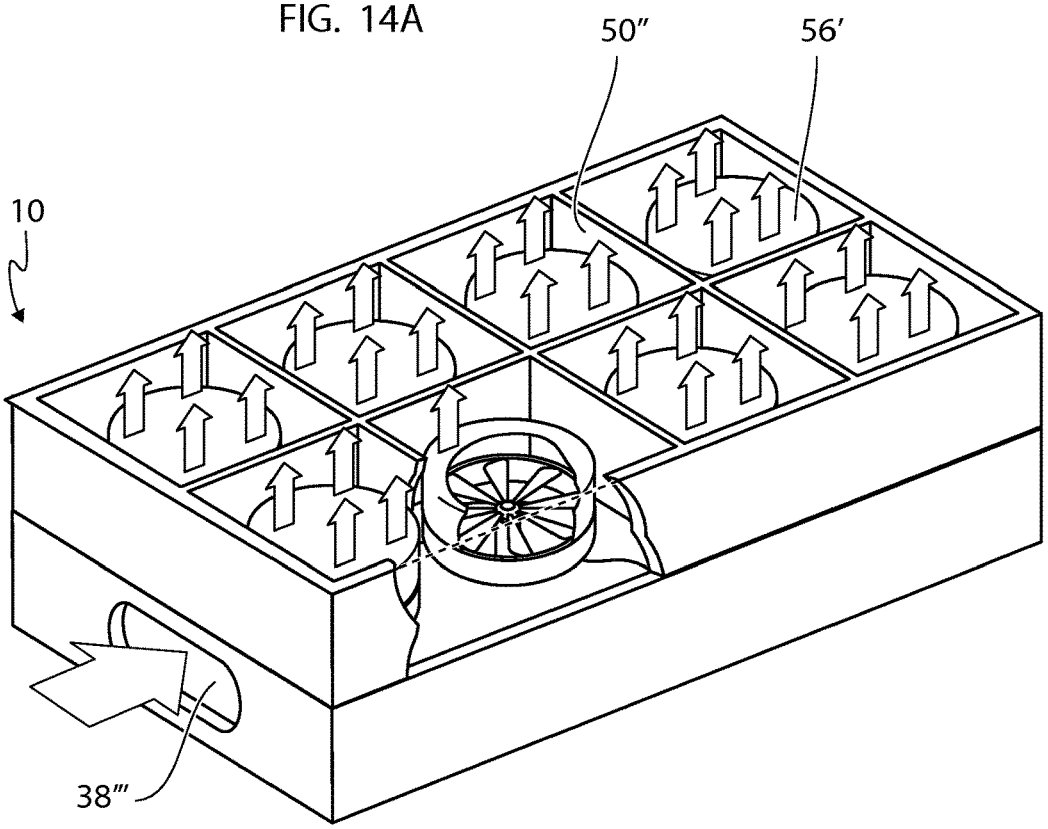
FIG. 14B is a perspective view of a drying unit having cells, fans and bags.

FIG. 14B shows a perspective view of a drying unit 10 having cells, fans and bags 56'. The present embodiment is similar to the previous embodiments except that the fan in covered by a bag, which may be of the same material as the previously described hoses and thus have the same flow distributing effect.

Figure 15:
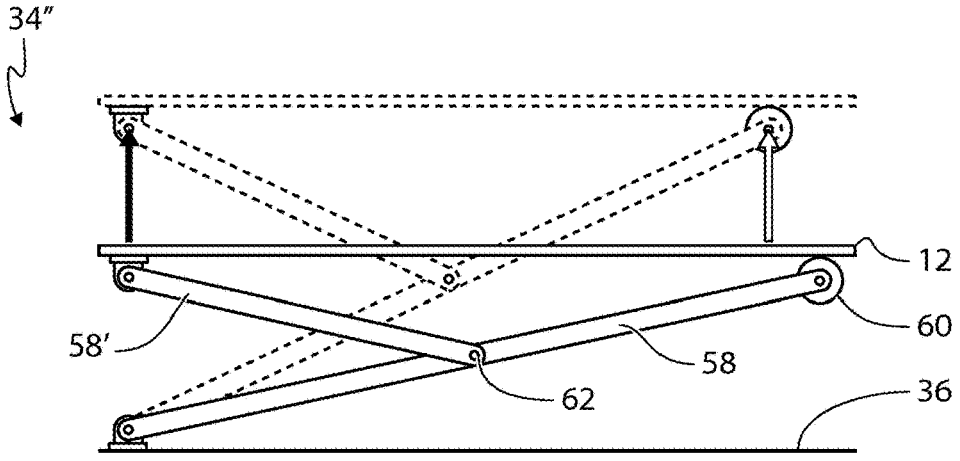
FIG. 15 is a side view of a mechanical lifting device using a first pantograph.

FIG. 15 shows a side view of a mechanical lifting device using a mechanical lifting device 34" in the form of a first pantograph. The lifting device 34" comprises a first bar 58, which is attached to the bottom plate 36 and contacting the top plate 12 with a roller 60. The first bar 58 is connected to a second bar 58' via an axle 62 in the center of the first bar 58 and the second bar 58' is further attached to the top plate 12 opposite the first bar 58. By moving the roller 60, the distance of the top plate 12 relative to the bottom plate 36 may be adjusted in the vertical direction.

Figure 16:
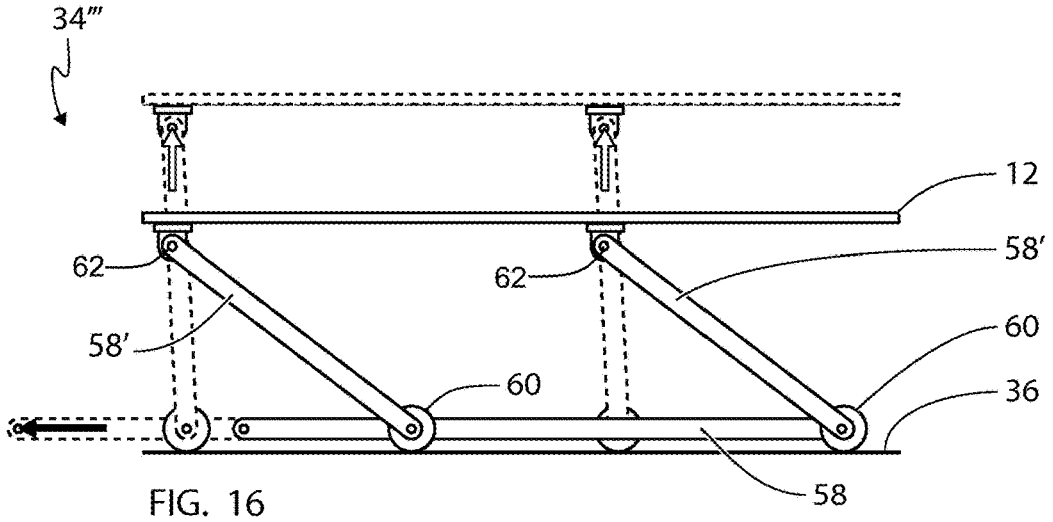
FIG. 16 is a side view of a mechanical lifting device using a second pantograph.

FIG. 16 shows a side view of a mechanical lifting device using a mechanical lifting device 34'" in the form of a second pantograph. The lifting device 34'" comprises a first bar 58 connected to rollers 60, which in turn contact the bottom plate 36 at opposite locations. Two separate bars 58' are connected between each of the rollers 60 via a respective axle 62 at opposite locations under the top plate 12. By moving the first bar 58 horizontally, the distance of the top plate 12 relative to the bottom plate 36 may be adjusted in the vertical direction.

Figure 17:
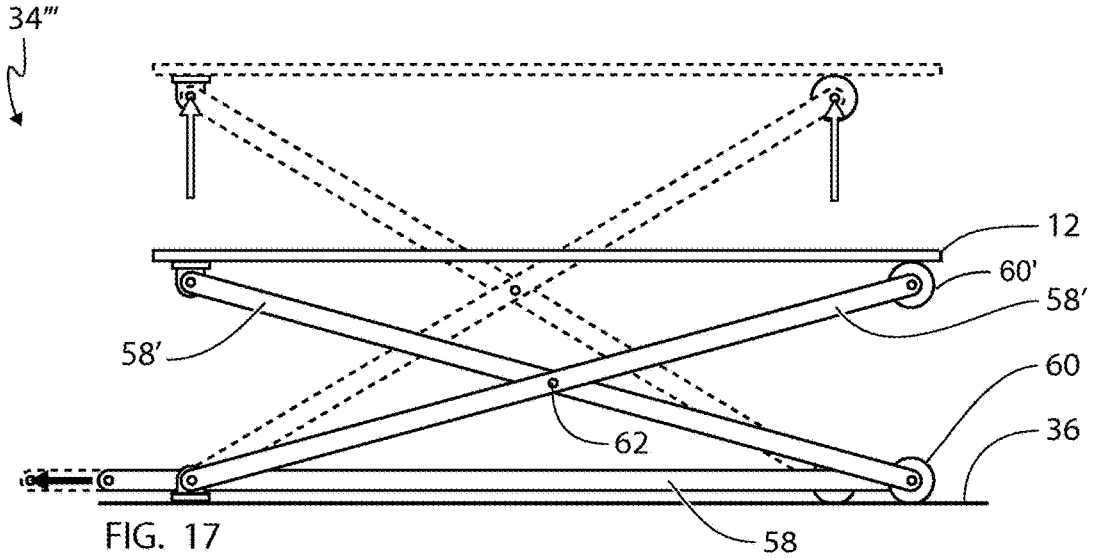
FIG. 17 is a side view of a mechanical lifting device using a third pantograph.

FIG. 17 shows a side view of a mechanical lifting device using a mechanical lifting device 34'" in the form of a third pantograph. The lifting device 34'" comprises a first bar 58 attached to the bottom plate 58 at one end and at the opposite end connected to a roller 60, which in turn contacts the bottom plate 36. Two separate bars 58' are connected between each end of the first bar 58 via respective axles 62 and having opposite ends at opposite locations under the top plate 12, whereby the end located adjacent the roller 60 of the first bar 58 has a roller 60' contacting the top plate 12, whereby the end located adjacent the end of the first bar 58, which is attached to the bottom plate 36, is attached to the top plate 12, and whereby the two bars 58' cross at a central location, in which said bars 58' are interconnected by an axle 62. By moving the first bar 58 horizontally, the distance of the top plate 12 relative to the bottom plate 36 may be adjusted in the vertical direction.

Figure 18A:
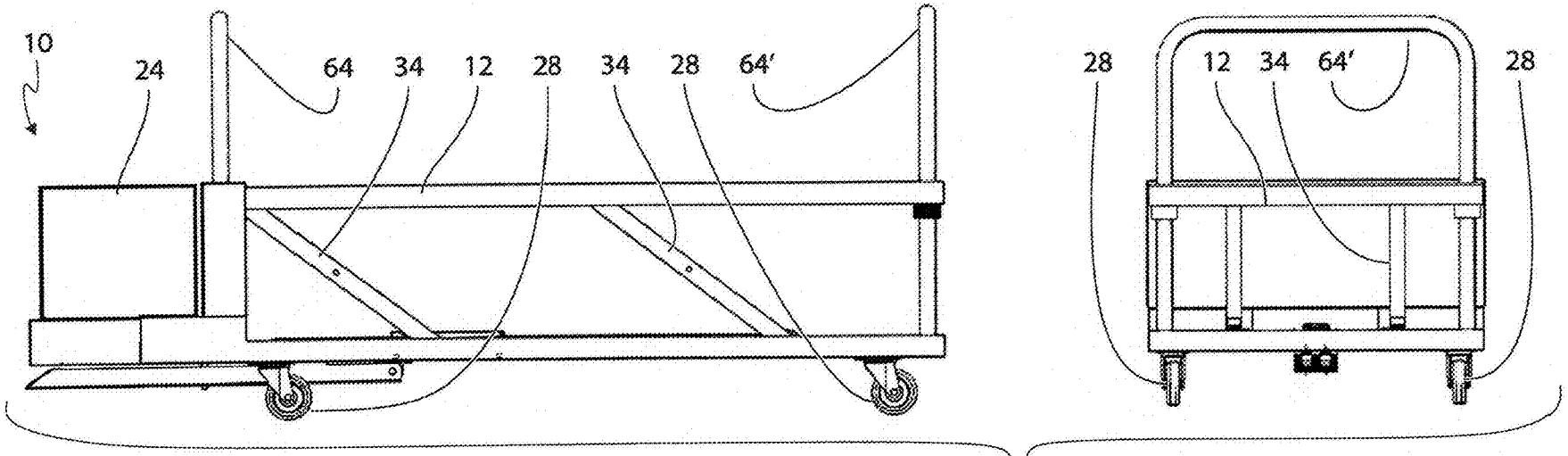
FIG. 18A is a side/front cut-out view of a high drying unit having a guiding element.

FIG. 18A shows a side cut-out view of a high drying unit 10 having a guiding element 64. The sidewalls have been left out in order to visualize the inner space. The present view shows the drying unit 10 in the high position, which is preferably used during drying. The guide elements 64 64' are attached to the bottom plate 36 and extend through the upper plate 12 in order to provide stability in the high position.

Also shown is a front cut-out view of a high drying unit 10 having a guiding element 64. The guide elements form an inverted U.

Figure 18B:
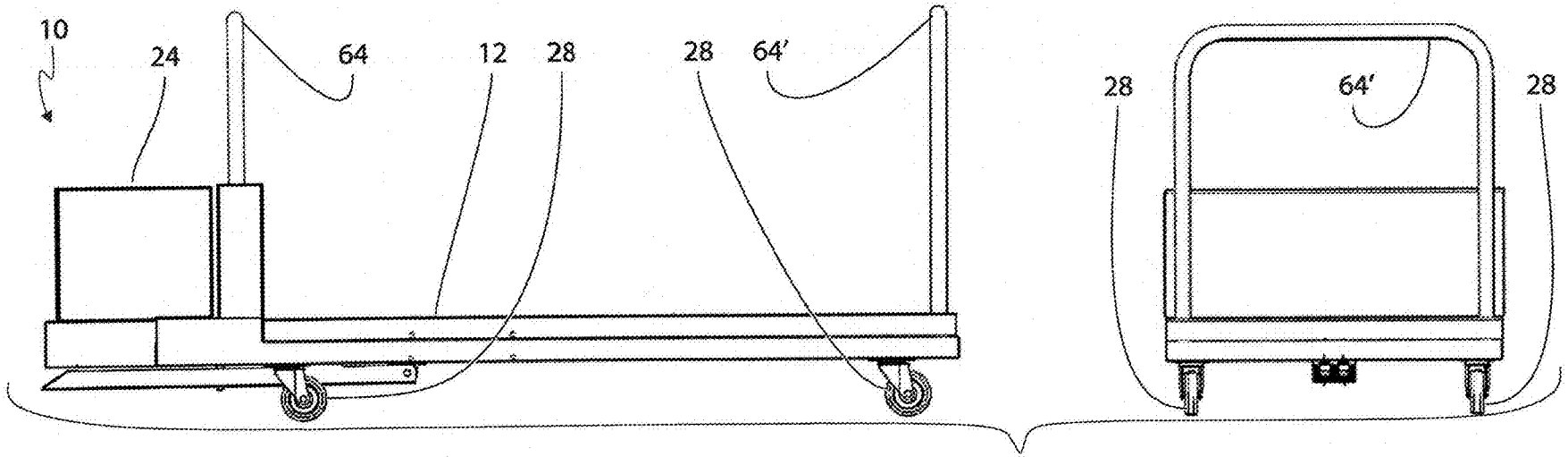
FIG. 18B is a side/front cut-out view of a low drying unit having a guiding element.

FIG. 18B shows a side cut-out view of a low drying unit having a guiding element 64. The present view shows the drying unit 10 in the low position, which is preferably used during transport and handling.

Also shown is a front cut-out view of a low drying unit having a guiding element. The guide elements may double as handles for moving the drying unit 10.

Figure 19A:
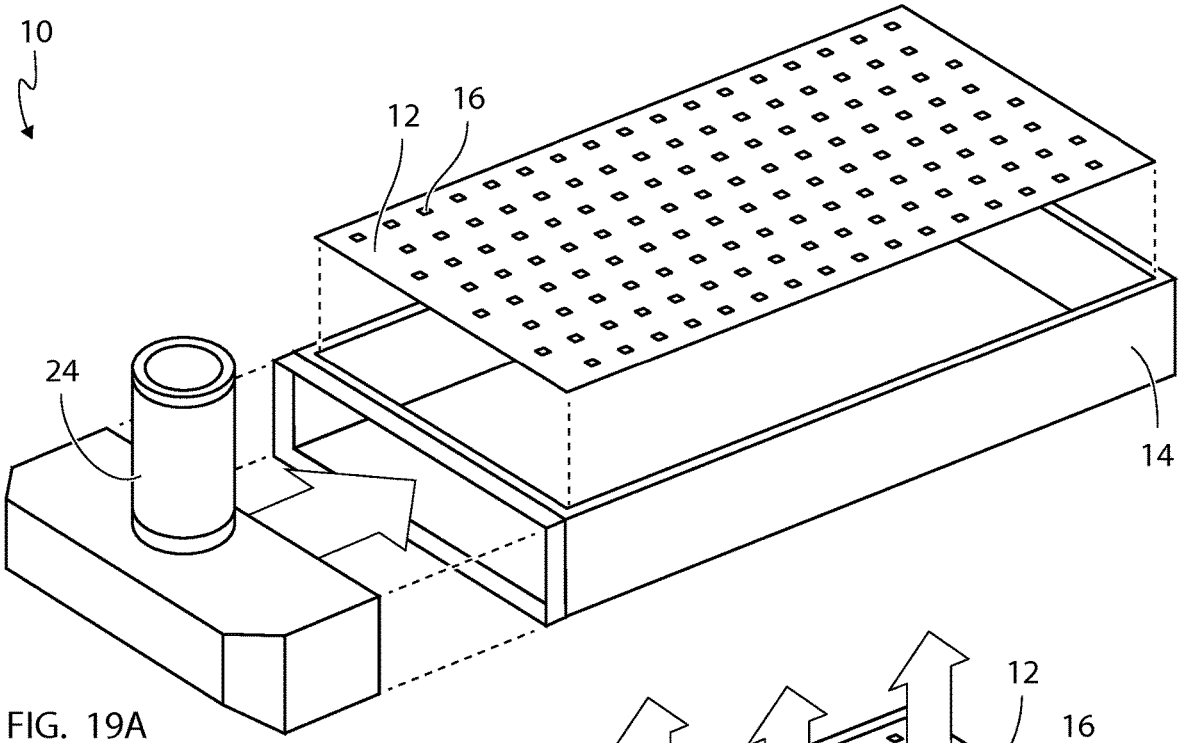
FIG. 19A is a perspective exploded view of a drying unit according to the state of art.

FIG. 19A shows a perspective exploded view of a drying unit 10 according to the state of the art. The drying unit 10 is low and without any flow distributor.

Figure 19B:
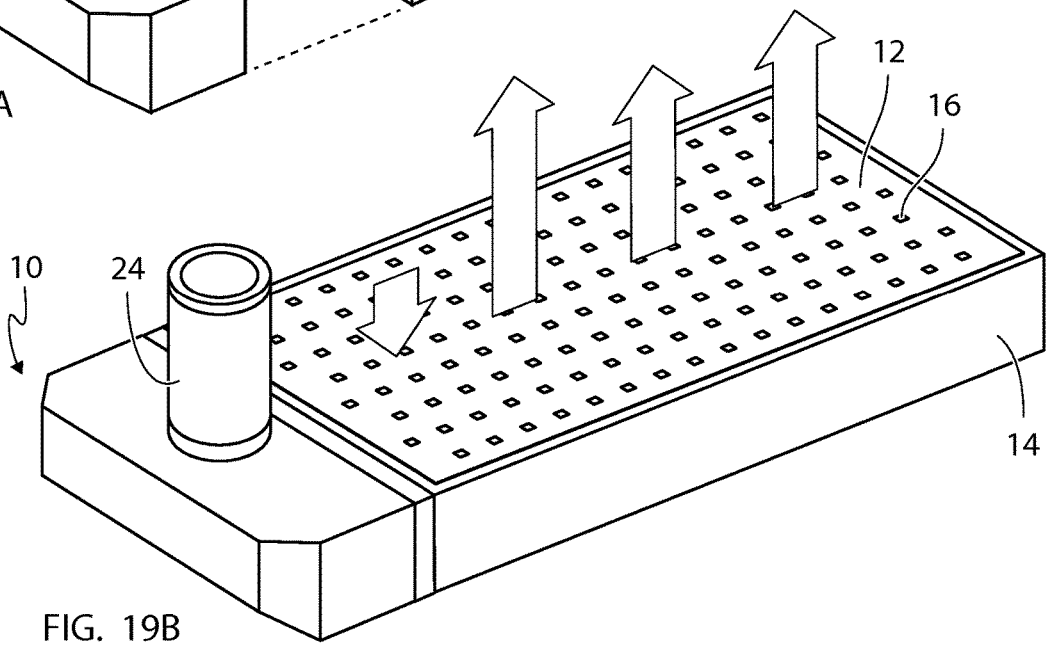
FIG. 19B is a perspective view of a drying unit according to the state of the art.

FIG. 19B shows a perspective view of a drying unit according to the state of the art. The present view shows arrows representing the flow of air through the apertures 16 when the flow velocity is increased. As can be seen, the flow distribution is non-uniform as the flow velocity through some apertures 16 is very high, whereas the flow velocity through others even are negative.

Figure 19C:
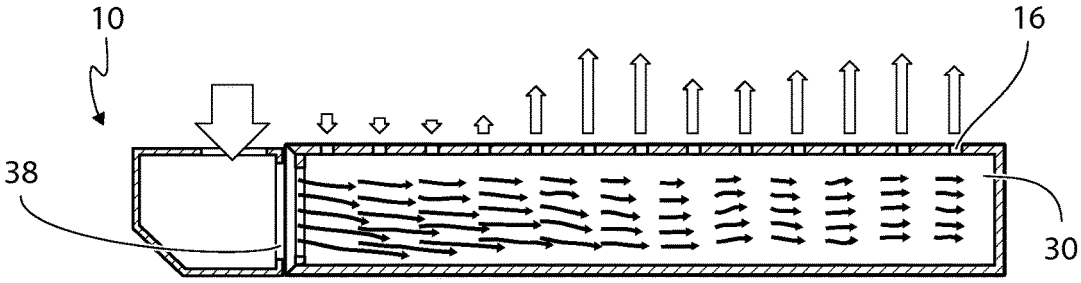
FIG. 19C is a perspective side view of a drying unit according to the state of the art.

FIG. 19C shows a perspective side view of a drying unit according to the state of the art. The present view shows arrows representing the flow of air within the inner space 30 in addition to the arrows representing the flow of air through the apertures 16. As can be seen, the flow velocity and turbulence is very intense close to the gas inlet 38 resulting in Venturi effect suction adjacent the gas inlet 38.

Figure 20A:
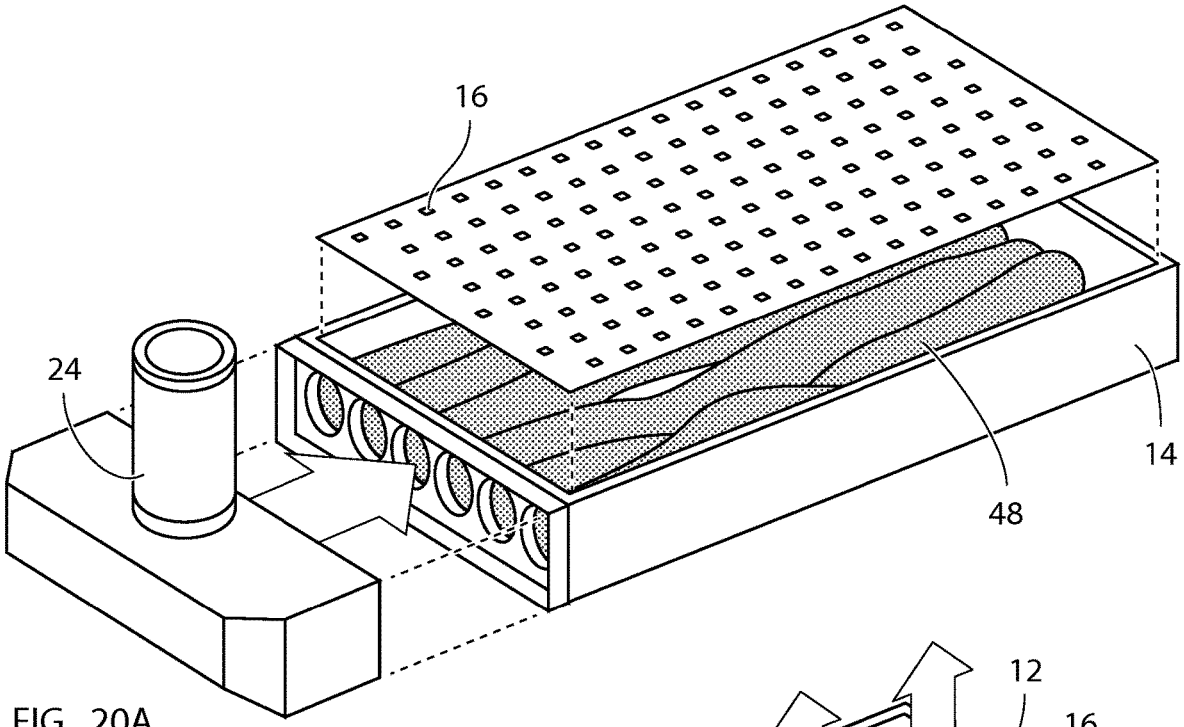
FIG. 20A is a perspective exploded view of a drying unit having hoses.

FIG. 20A shows a perspective exploded view of a drying unit 10 having hoses 48.

Figure 20B:
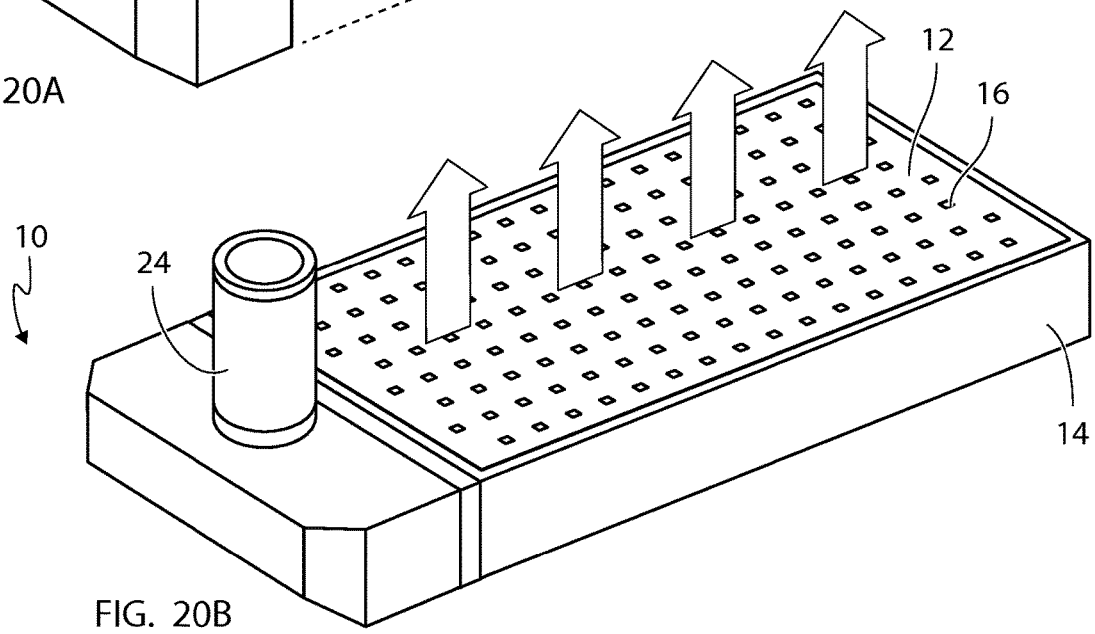
FIG. 20B is a perspective view of a drying unit having hoses.

FIG. 20B shows a perspective view of a drying unit 10 having hoses 48. The present view shows arrows representing the flow of air through the apertures 16 when the flow velocity is increased. As can be seen, the flow distribution is uniform and the flow velocity through all of the apertures 16 are approximately the same.

Figure 20C:
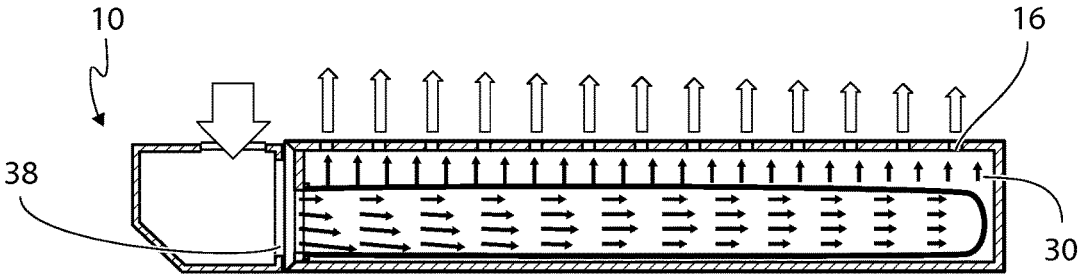
FIG. 20C is a perspective side view of a drying unit having hoses.

FIG. 20C shows a perspective side view of a drying 10 unit having hoses 48. The present view shows arrows representing the flow of air within the inner space 30 in addition to the arrows representing the flow of air through the apertures 16. As can be seen, the presence of the flow distributor constituted by the hoses 48 reduces the turbulence and eliminates the Venturi effect suction adjacent the gas inlet 38.

Figure 21A:
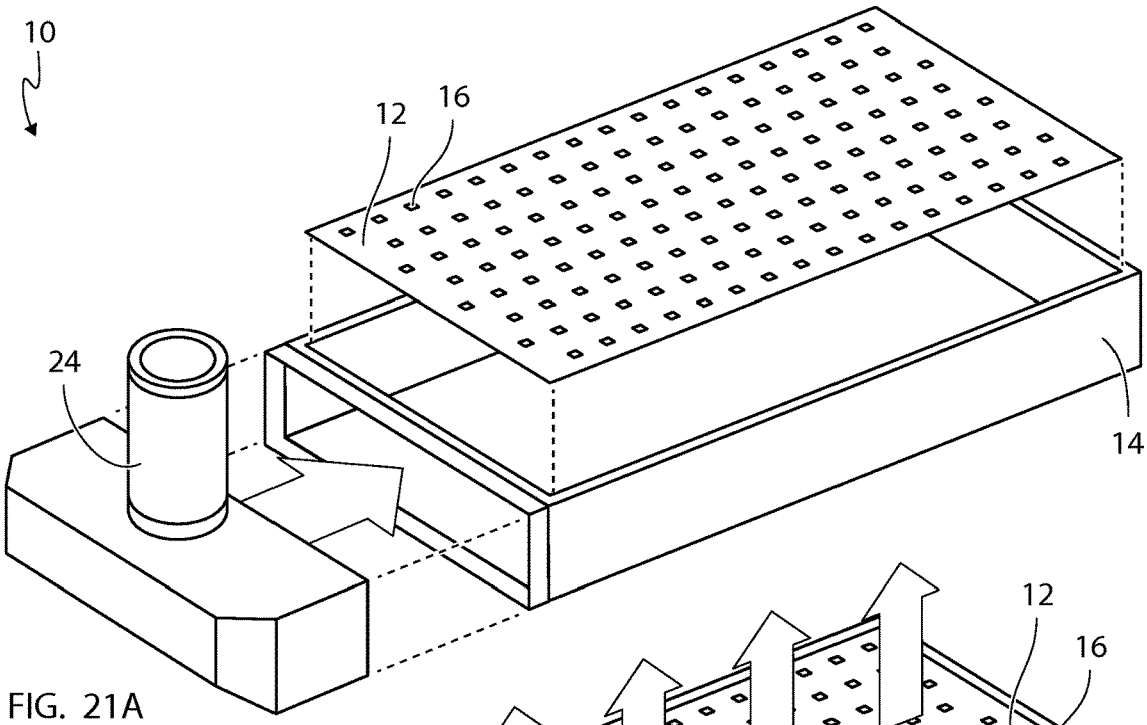
FIG. 21A is a perspective exploded view of a high drying unit.

FIG. 21A shows a perspective exploded view of a high drying unit 10.

Figure 21B:
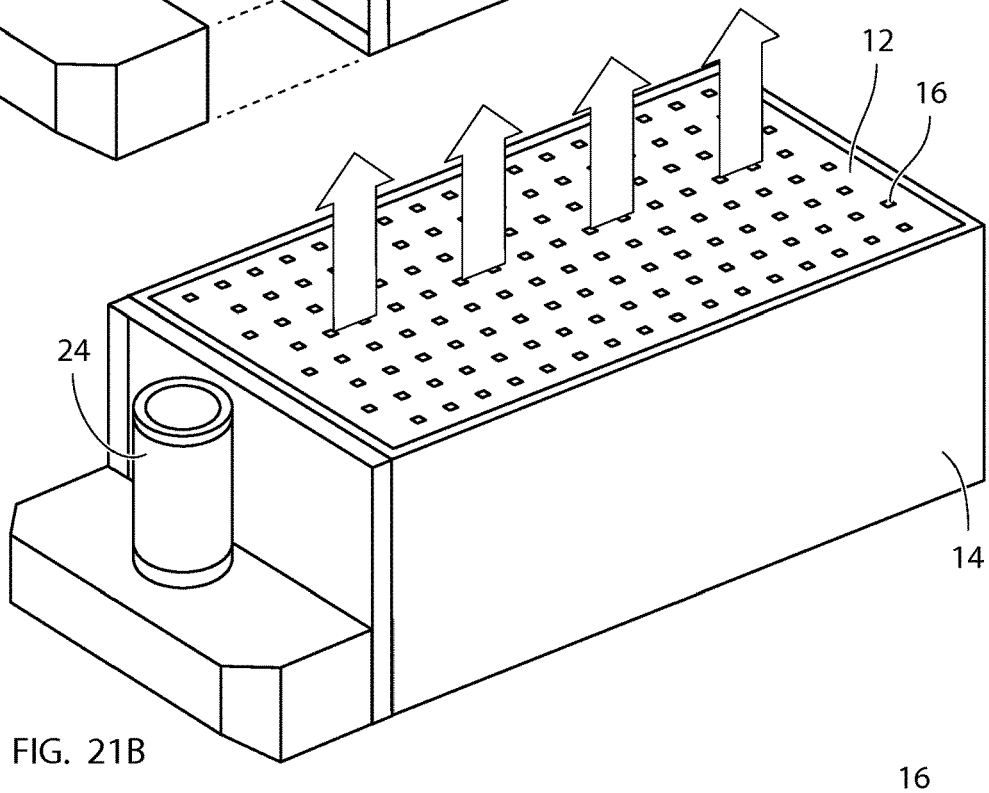
FIG. 21B is a perspective view of a high drying unit.

FIG. 21B shows a perspective view of a high drying unit. The present view shows arrows representing the flow of air through the apertures 16 when the flow velocity is increased. As can be seen, the flow distribution is uniform and the flow velocity through all of the apertures 16 are approximately the same.

Figure 21C:
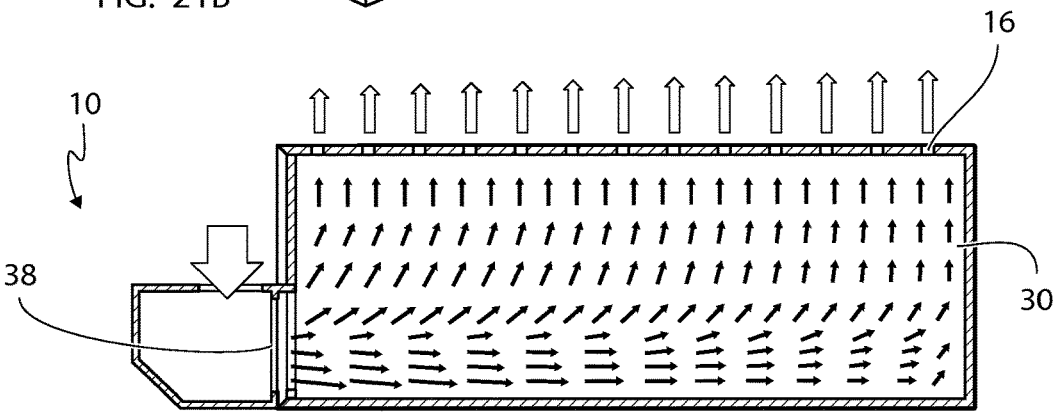
FIG. 21C is a perspective side view of a high drying unit.

FIG. 21C shows a perspective side view of a high drying unit 10. The present view shows arrows representing the flow of air within the inner space 30 in addition to the arrows representing the flow of air through the apertures 16. As can be seen, the greater distance between the gas inlet 38 and the apertures 16 reduces the turbulence and eliminates the Venturi effect suction adjacent the gas inlet 38.

Figure 22A:
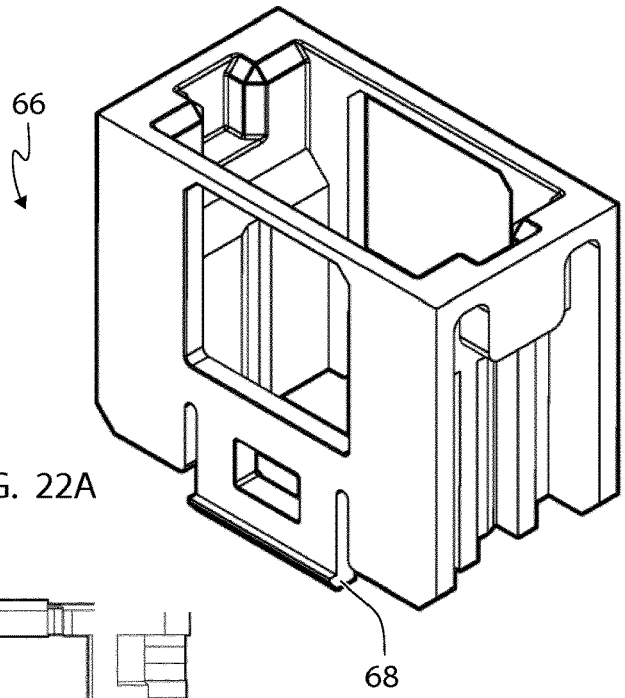
FIG. 22A is a perspective view of an adapter.

FIG. 22A shows a perspective view of an adapter 66 for being fixated in the aperture (not shown) of the top plate (not shown) of the drying unit (not shown). The adapter 66 has an inner shape corresponding to the shape of a pelt board connecting element (not shown) such that the pelt board connecting element may be easier placed in and more stable accommodated in the aperture (not shown). The adapter 66 is preferably made of polymeric material such as plastic. The adapter 66 comprise a clip-on mechanism for attachment to the top plate (not shown) of the drying unit (not shown).

Figure 22B:
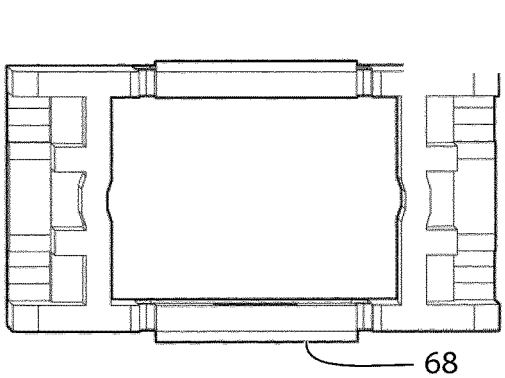
FIG. 22B is a top view of an adapter.

FIG. 22B shows a bottom view of an adapter 66. As can be seen, the adapter 66 is hollow for allowing gas to pass through with little or no flow resistance.

Figure 22C:
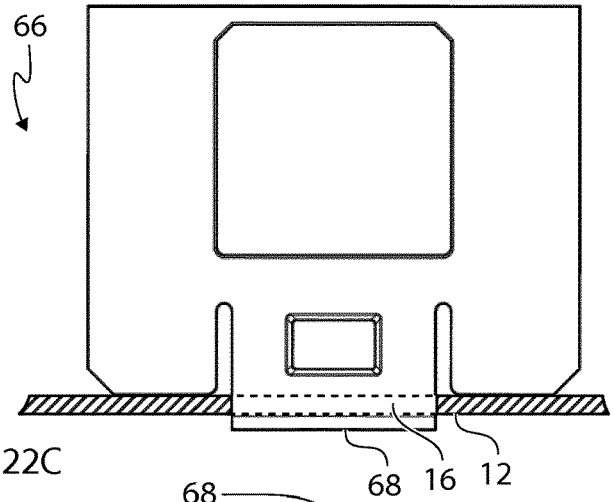
FIG. 22C is a front view of an adapter.

FIG. 22C shows a front view of an adapter 66 when attached to the top plate 12 of the drying aggregate (not shown) at the aperture 16.

Figure 22E:
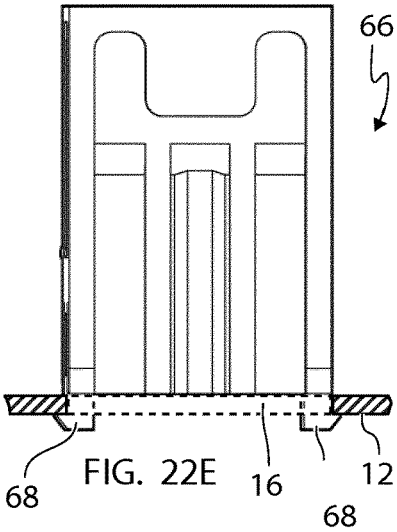
FIG. 22E is a side view of an adapter.
Figure 22D:
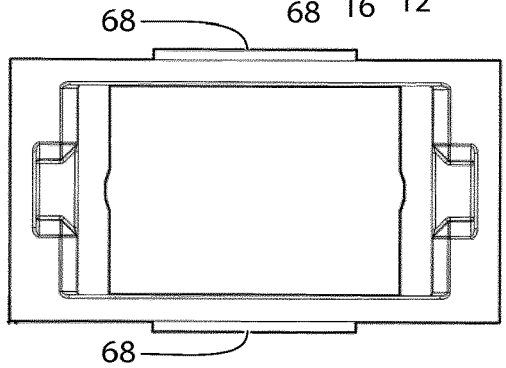
FIG. 22D is a bottom view of an adapter.

FIG. 22D shows a top view of an adapter 66.

FIG. 22E shows a side view of an adapter 66.

Figure 23A:
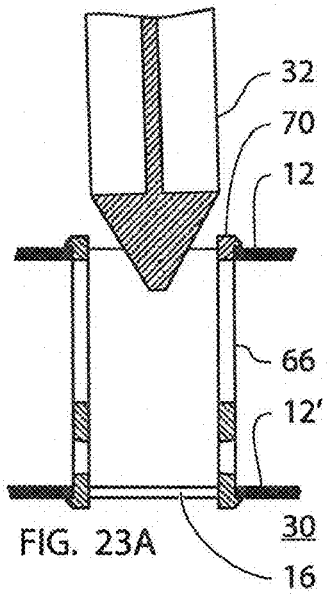
FIG. 23A is a side view of an adapter and a large connecting element.

FIG. 23A shows a side view of an adapter 66 and a large connecting element 32 of the pelt board (not shown). The adapter 66 is fitted in the aperture 16 between the top plate 12 and a secondary top plate 12', which is similar to the top plate 12 but located below the top plate 12 within the inner space 30 for the purpose of fixating the adapter 66. The clip mechanism attaches to the secondary top plate 12', whereas a top portion 70 of the adapter 66 acts as counter hold.

Figure 23B:
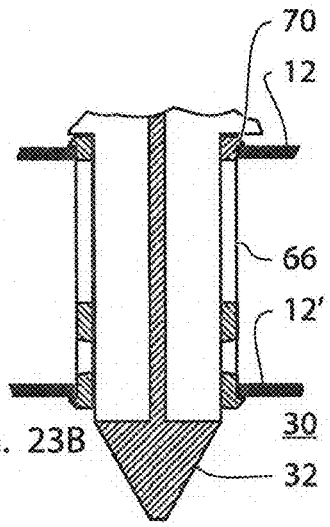
FIG. 23B is a side view of an adapter attached to a large connecting element.

FIG. 23B shows a side view of an adapter 66 attached to a large connecting element 32 of the pelt board (not shown). As can be seen, the adapter 66 assures a stable position of the pelt board connecting element 32.

Figure 23C:
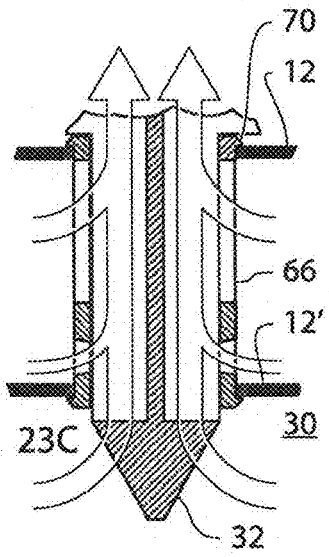
FIG. 23C is a side view of an adapter and a large connecting element when drying.

FIG. 23C shows a side view of an adapter 66 and a large connecting element 32 when drying. As shown by the arrow, the hollow configuration of the adapter 66 allows air to pass from the inner space 30 through the adapter 66 in the aperture 16 to the pelt board (not shown).

Figure 24A:
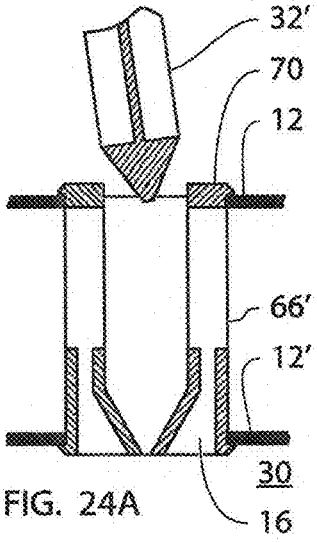
FIG. 24A is a side view of an adapter and a small connecting element.

FIG. 24A shows a side view of an adapter 66' and a small connecting element 32' of the pelt board (not shown). The adapter 66' is fitted in the same aperture 16 between the top plate 12 and a secondary top plate 12', which is similar to the top plate 12, but located below the top plate 12 within the inner space 30 for the purpose of fixating the adapter 66'. The clip mechanism attaches to the secondary top plate 12' whereas a top portion 70 of the adapter 66' acts as counter hold. Thus, the same drying unit may be used with different adapters for differently sized connecting elements.

Figure 24B:
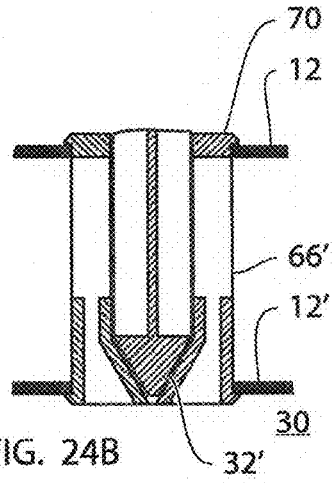
FIG. 24B is a side view of an adapter attached to a small connecting element.

FIG. 24B shows a side view of an adapter 66' attached to a small connecting element 32' of the pelt board (not shown). As can be seen, the adapter 66' assures a stable position of the pelt board connecting element 32'

Figure 24C:
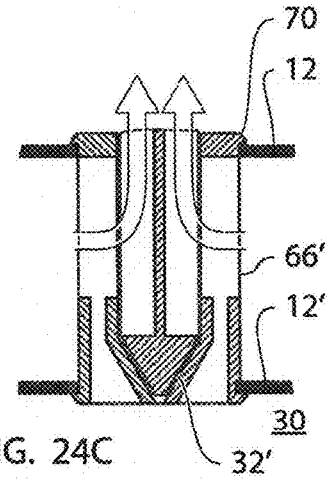
FIG. 24C is a side view of an adapter and a small connecting element when drying.

FIG. 24C shows a side view of an adapter 66' and a small connecting element 32' when drying. As shown by the arrow, the hollow configuration of the adapter 66' allows air to pass from the inner space 30 through the adapter 66' in the aperture 16 to the pelt board (not shown).

Figure 25:
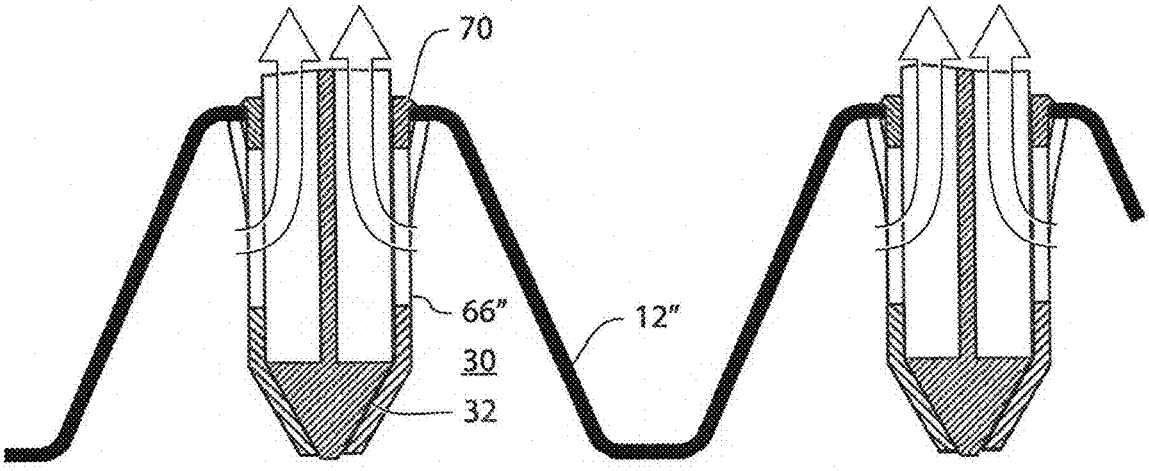
FIG. 25 is a side view of an adapter.

FIG. 25 shows a side view of an adapter 66" for use with a corrugated top plate 12". The present adapter 66' is held at only one location, however, it would be equally feasible to provide a secondary top plate for allowing the adapter to be held at two locations for additional stability as shown above. Further, the present top plate 12" may be non-corrugated and/or used together with adapters of different sizes.

Figure 26A:
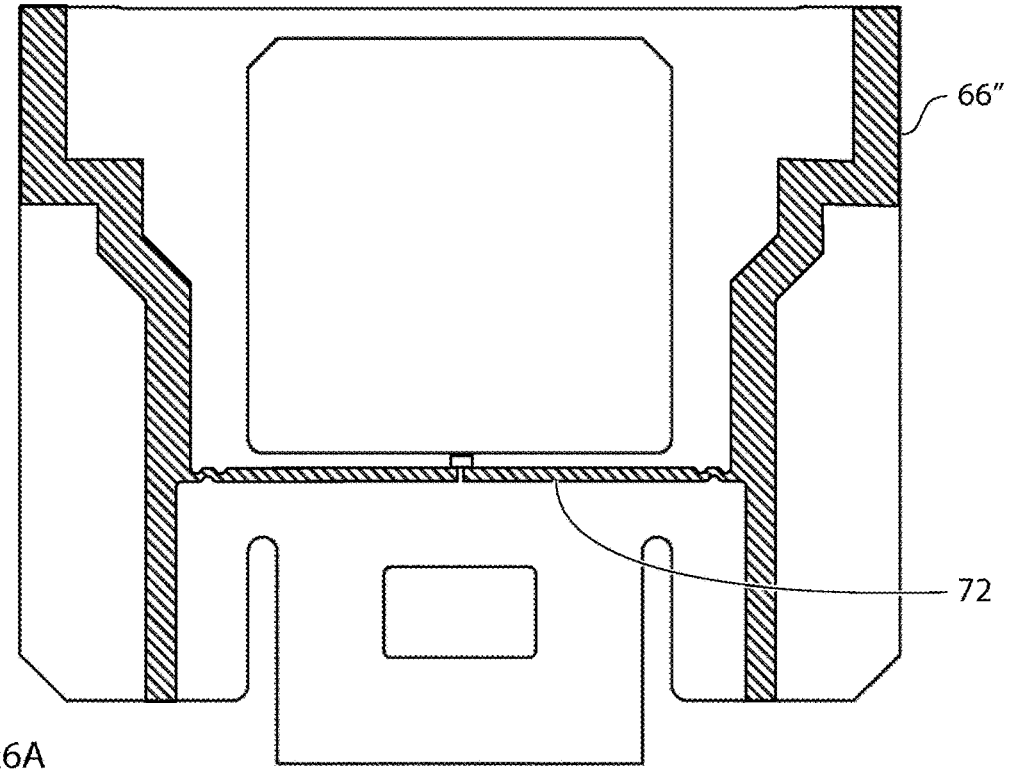
FIG. 26A is a side view of an adapter having a check valve in a closed state.

FIG. 26A shows a side view of an adapter 66" having a check valve 72 in a closed state. When no pelt board connecting element is inserted into the adapter 66", the check valve remains closed and thus no air will flow through the adapter 66". In this way, any loss of drying gas/air through an aperture, which has no connecting element/pelt board attached, is prevented. Alternatively or in addition to a check valve a nozzle may be used for similar purposes.

Figure 26B:
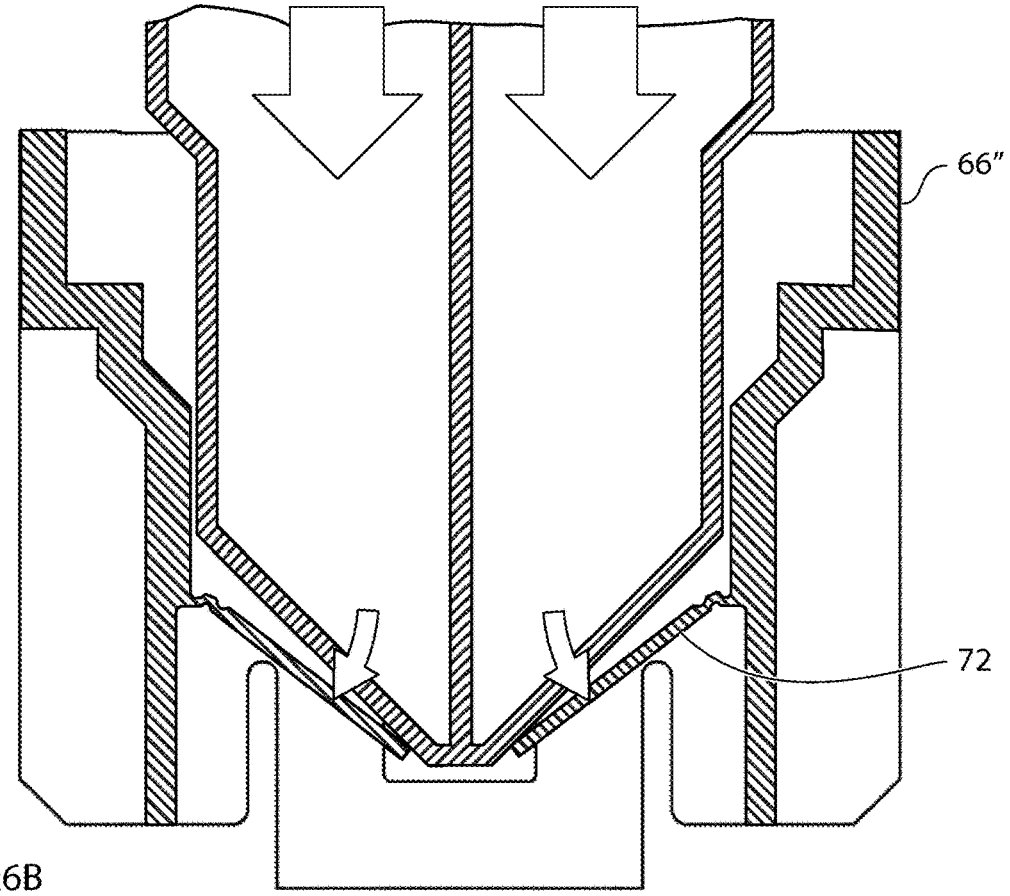
FIG. 26B is a side view of an adapter having a check valve in an open state.

FIG. 26B shows a side view of an adapter having a check valve in an open state. When a pelt board connecting element is inserted into the adapter 66", the check valve 72 will open and permit drying air/gas to pass through.

Figure 27:
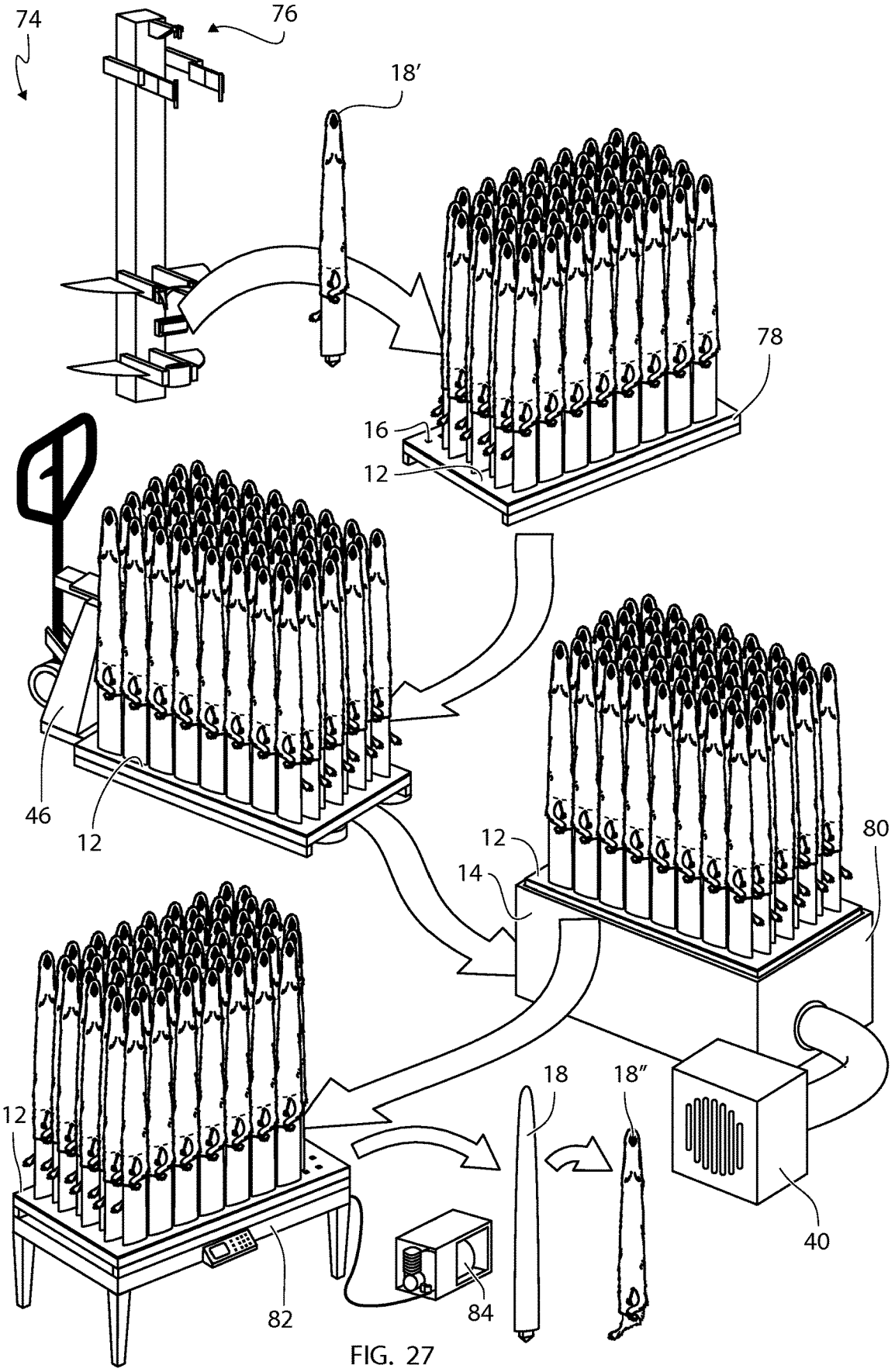
FIG. 27 is a perspective view of a pelt processing system.

FIG. 27 shows a perspective view of a pelt processing system 74. The pelt processing system comprises different modular stations in the form of a tanning unit 76, a holding unit 78, a blowing unit 80 and a release mechanism 82. The tanning unit 76 is the first station at which the pelt on the pelt board 18' is stretched when the pelt board is in its expanded state. The pelt and pelt board 18' are subsequently put in an holding unit 78 comprising a top plate 12 with apertures 16 for holding the connecting element 32 of the pelt board 18'. Then, the holding unit 78 is moved by e.g. a floor conveyor 46 to the blowing unit 80, which includes an external blower 40 and sidewalls 14. Together, the holding unit 78 and the blowing unit 80 form a drying unit for drying the pelts on the pelt boards. Finally, after drying the pelts, the holding unit 78 is moved to a release mechanism 82, at which all pelt boards are collapsed to their non-expanded state. The release mechanism may e.g. be driven by compressed gas via a compressor 84, however, other means such as an electric motor or even a hand lever, are equally feasible.

Figure 28A:
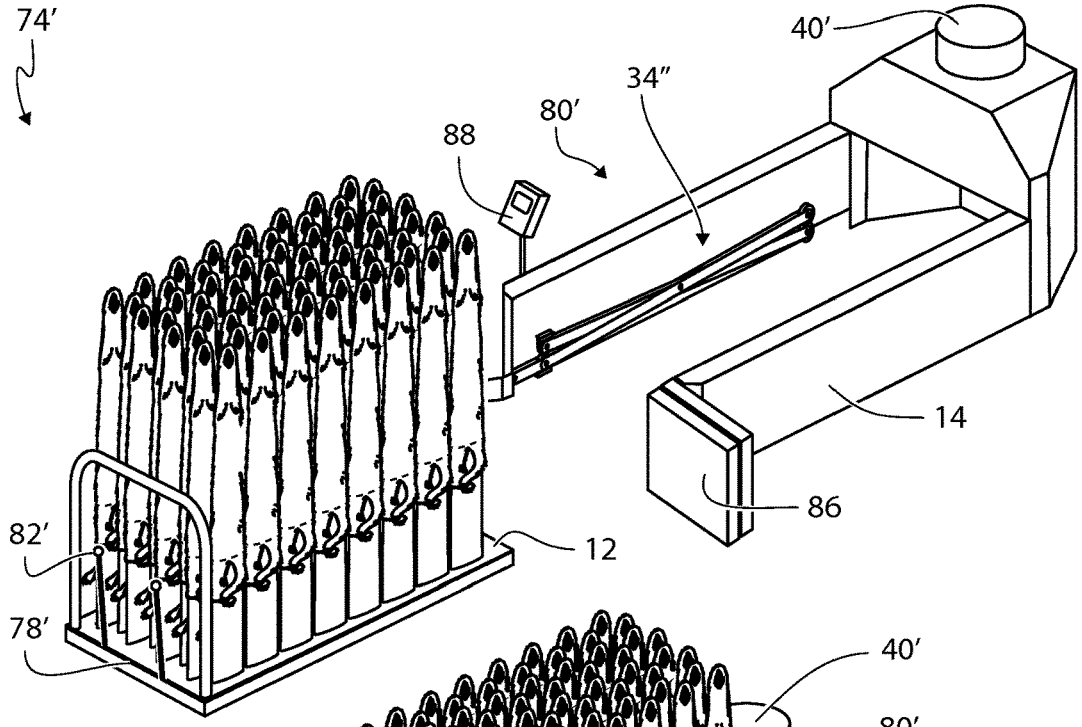
FIG. 28A is a perspective view of an alternative pelt processing system.

FIG. 28A shows a perspective view of an alternative embodiment of a pelt processing system 74'. The pelt processing system 74' comprises a holding unit 78' and a blowing unit 80'. The holding unit 78' comprises a top plate 12 with apertures for holding the connecting element of the pelt boards 18'. The blowing unit 80' comprises a blower 40', sidewalls 12 and a openable port 86. The bottom of the blowing unit 80' is constituted by the surface of the floor of the building in which the blowing unit 80' is situated. Further, a manual release mechanism 82' is provided for collapsing all of the pelt boards 18 simultaneously, however, a motorized release mechanism is equally feasible.

Figure 28B:
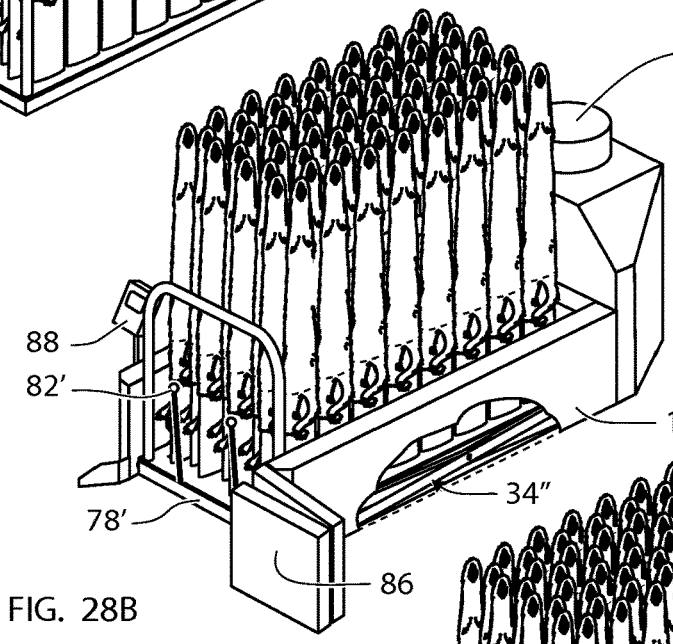
FIG. 28B is a perspective view of the alternative system during assembly.

FIG. 28B shows a perspective view of the alternative embodiment of a pelt processing system 74' during assembly. The holding unit 78' has now been inserted into the blowing unit 80' by means of e.g. a floor jack or by wheels mounted on the holding unit 78'.

Figure 28C:
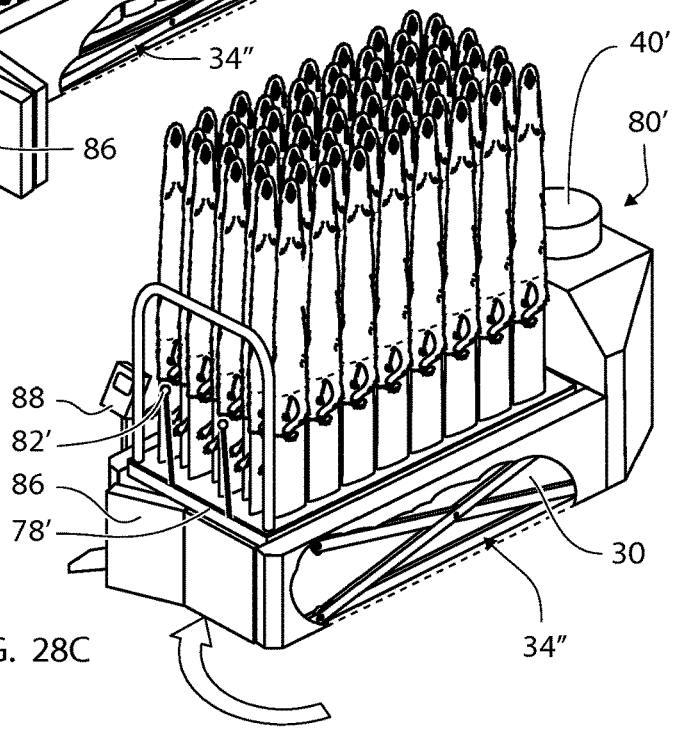
FIG. 28C is a perspective view of the alternative system during operation.

FIG. 28C shows a perspective view of the alternative embodiment of a pelt processing system 74' during operation. In order to seal off the blowing unit 80', the port 86 is closed as shown by the arrow and in order to for an inner space 30 to form, a lifting device 34" is used for elevating the holding device 78'. The present lifting device is in the form of a pantograph, however, a hydraulic or pneumatic lifting mechanism is equally feasible. Subsequently, the blower 40' is started for drying the pelts. The lifting device 34" and the blower 40' are controlled by a controller 88. The port 86 and the release mechanism 82' are typically manually operated, but may also be motorized and controlled by the controller 88.

The following FIGS. 29A-G are self-explanatory proof-of-concept CFD (Computational Fluid Dynamics) simulations made in order to increase the understanding of the present invention.

Figure 29A:
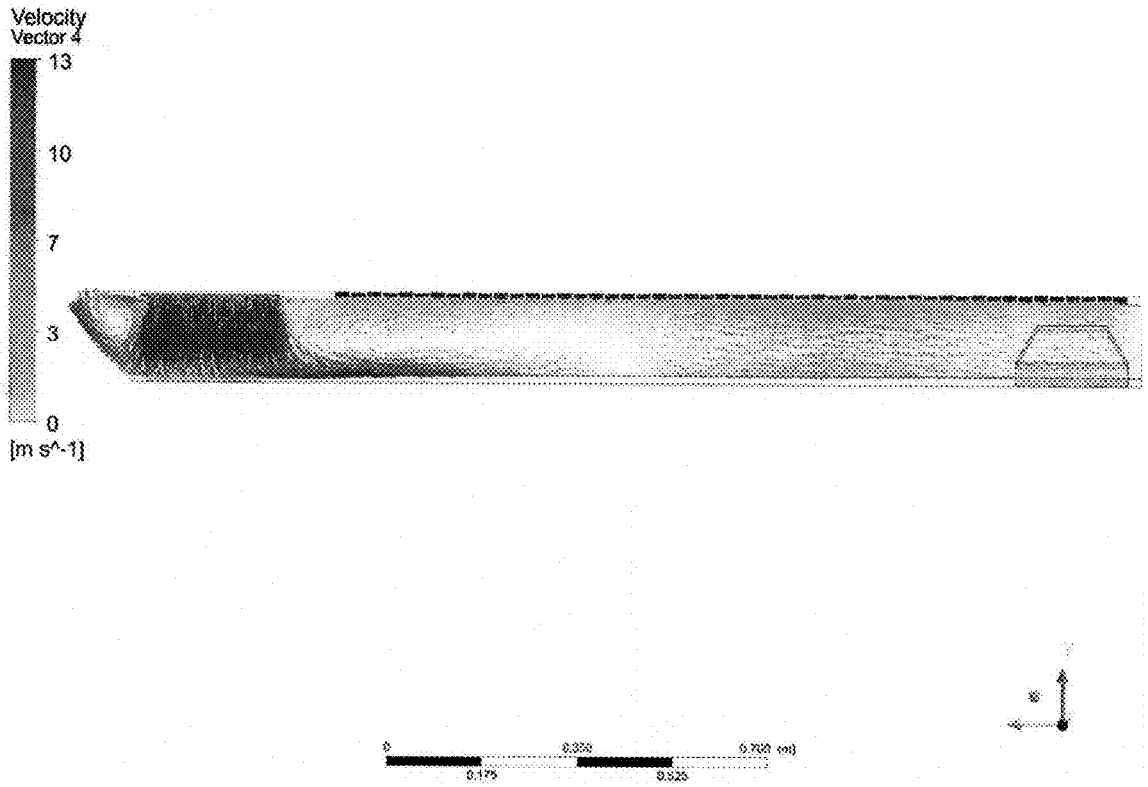
FIG. 29A is a CFD simulation of a low drying unit viewed from the side.

FIG. 29A shows a CFD simulation of a low drying unit viewed from the side. The simulation shows the flow velocity inside the inner space. As can be seen, the flow velocity is non-uniform.

Figure 29B:
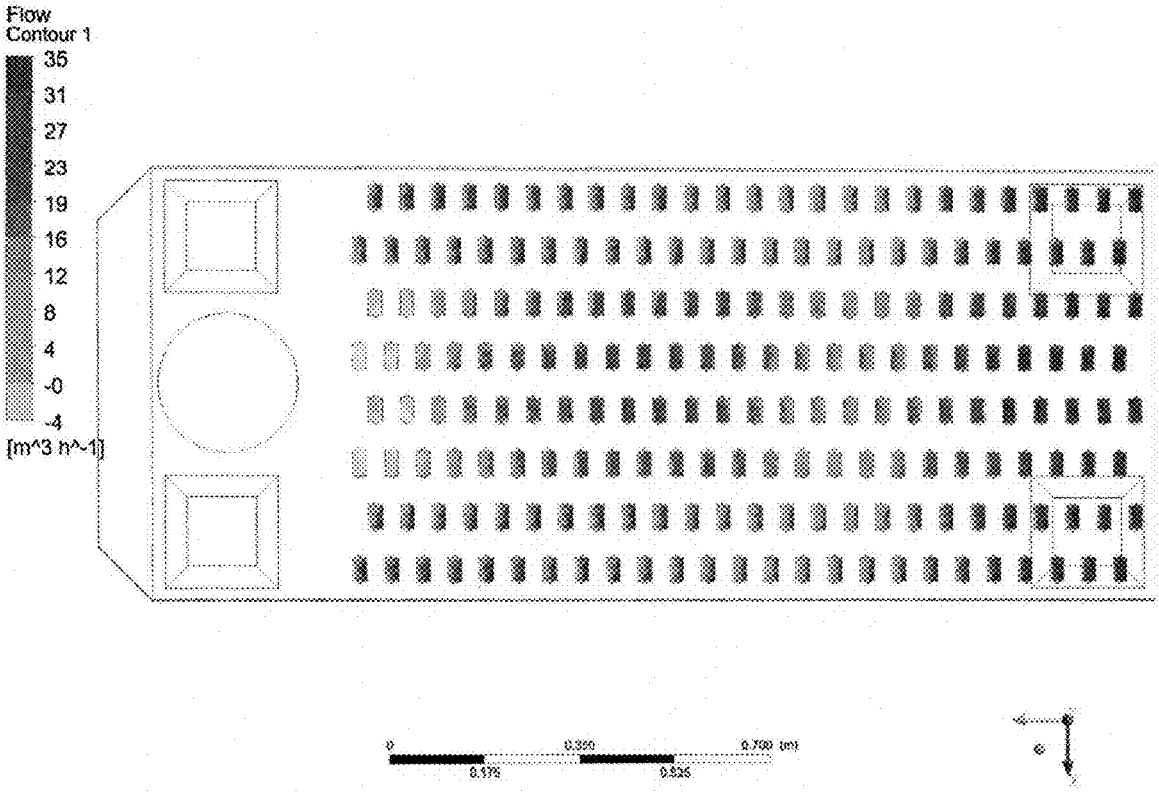
FIG. 29B is a CFD simulation of a low drying unit viewed from the top.

FIG. 29B shows a CFD simulation of a low drying unit viewed from the top. The simulation shows the flow volume per hour through the apertures. As can be seen, the flow volume per hour through the apertures is non-uniform.

Figure 29C:
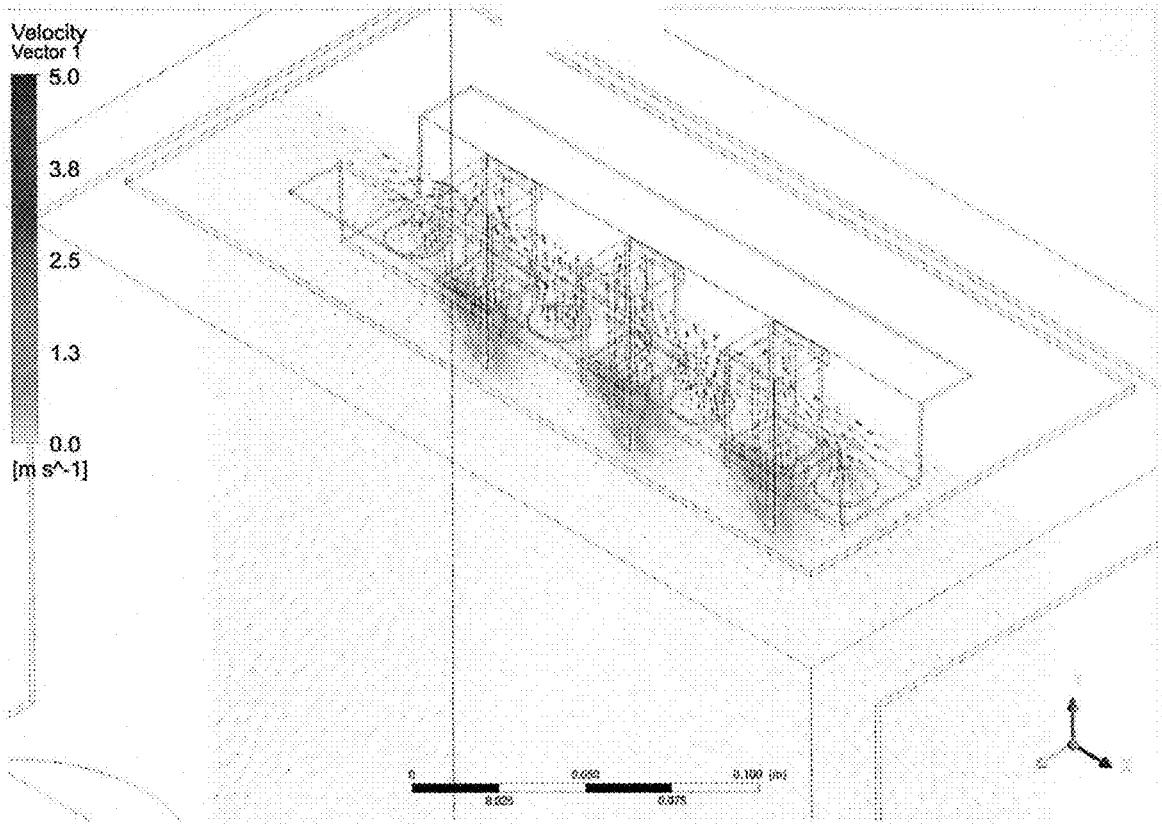
FIG. 29C is a CFD simulation of low interface.

FIG. 29C shows a CFD simulation of low interface/adapter having less amount of air passing through.

Figure 29D:
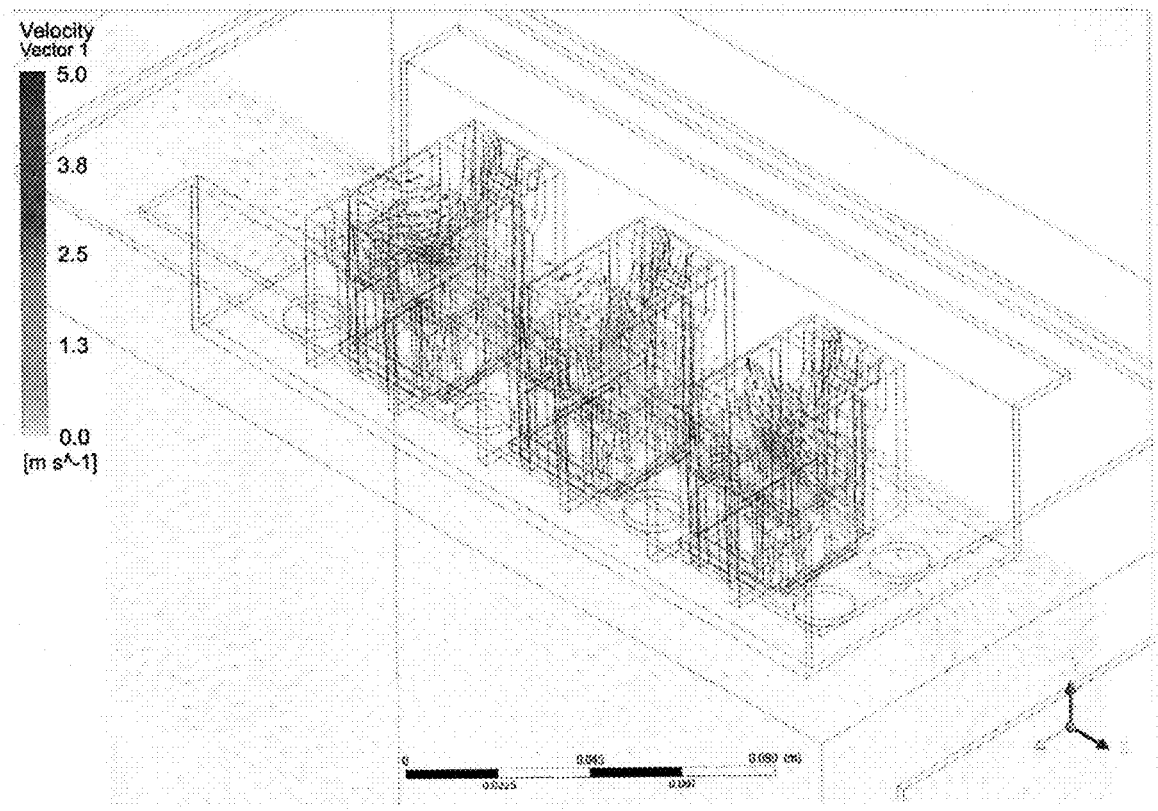
FIG. 29D is a CFD simulation of a high interface.

FIG. 29D shows a CFD simulation of a high interface/adapter allowing more air to pass from the drying unit to the pelt boards.

Figure 29E:
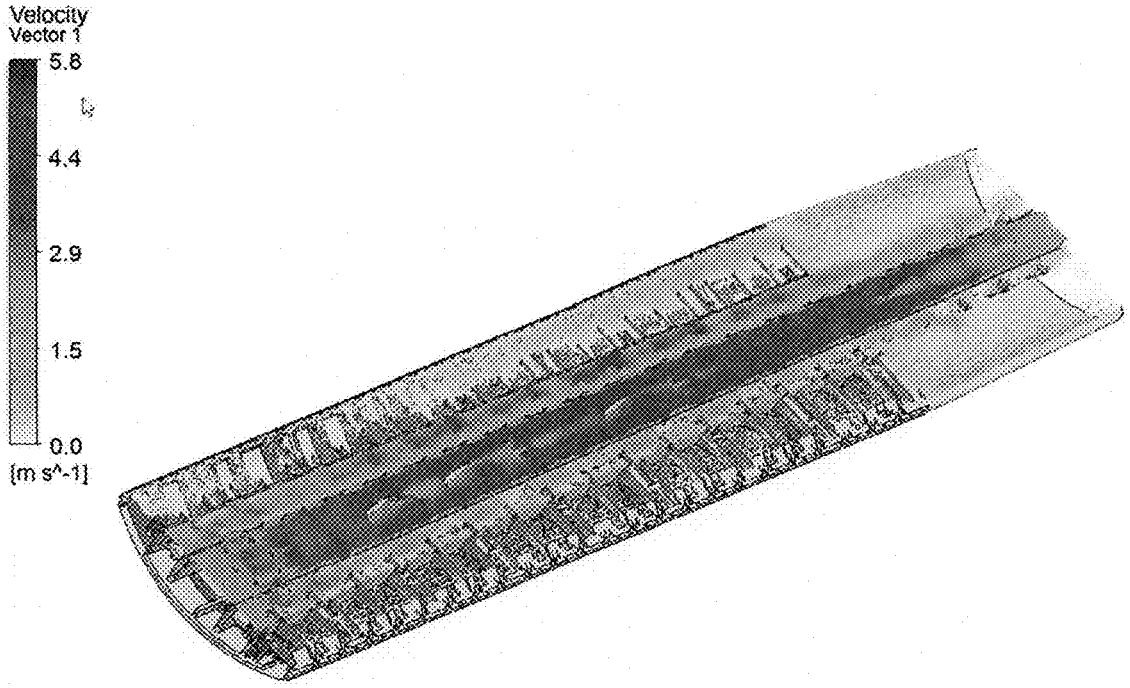
FIG. 29E is a CFD simulation of a pelt board.

FIG. 29E shows a CFD simulation of a pelt board. A large flow channel creates an airflow through the whole pelt board.

Figure 29F:
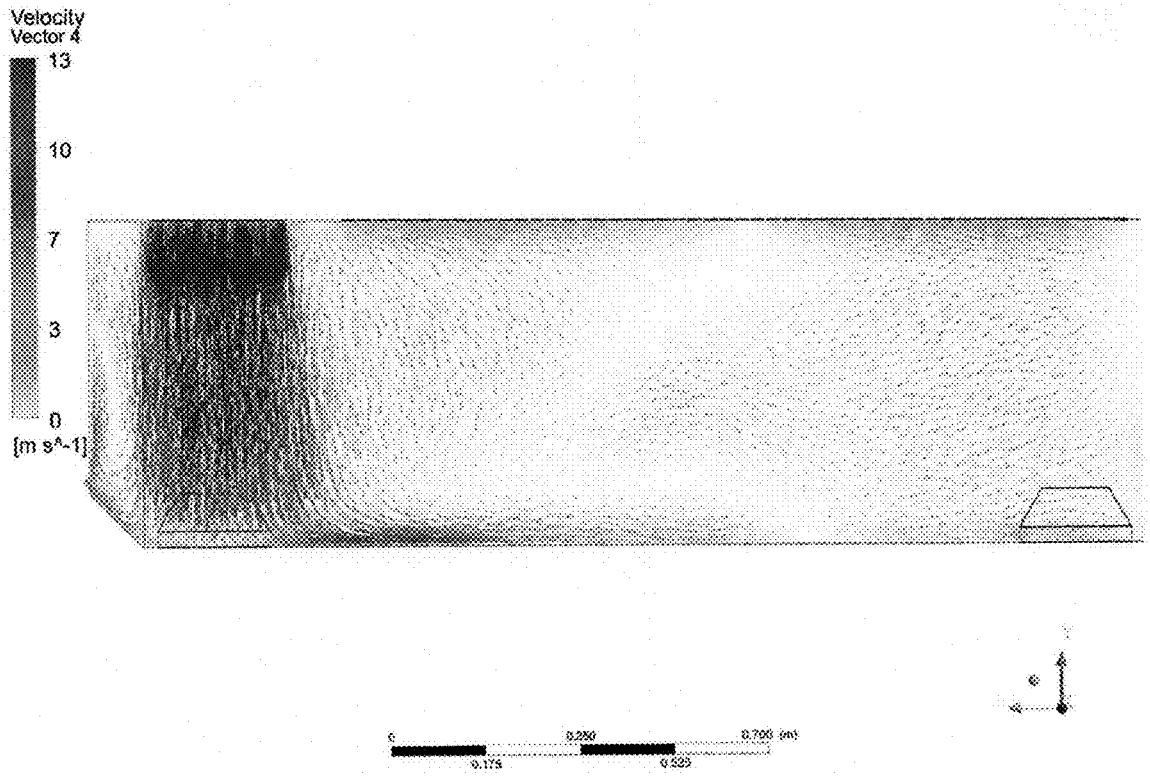
FIG. 29F is a CFD simulation of a high drying unit viewed from the side.

FIG. 29F shows a CFD simulation of a high drying unit viewed from the side. The simulation show the flow velocity inside the inner space. As can be seen, the flow velocity is much more uniform than the low drying unit.

Figure 29G:
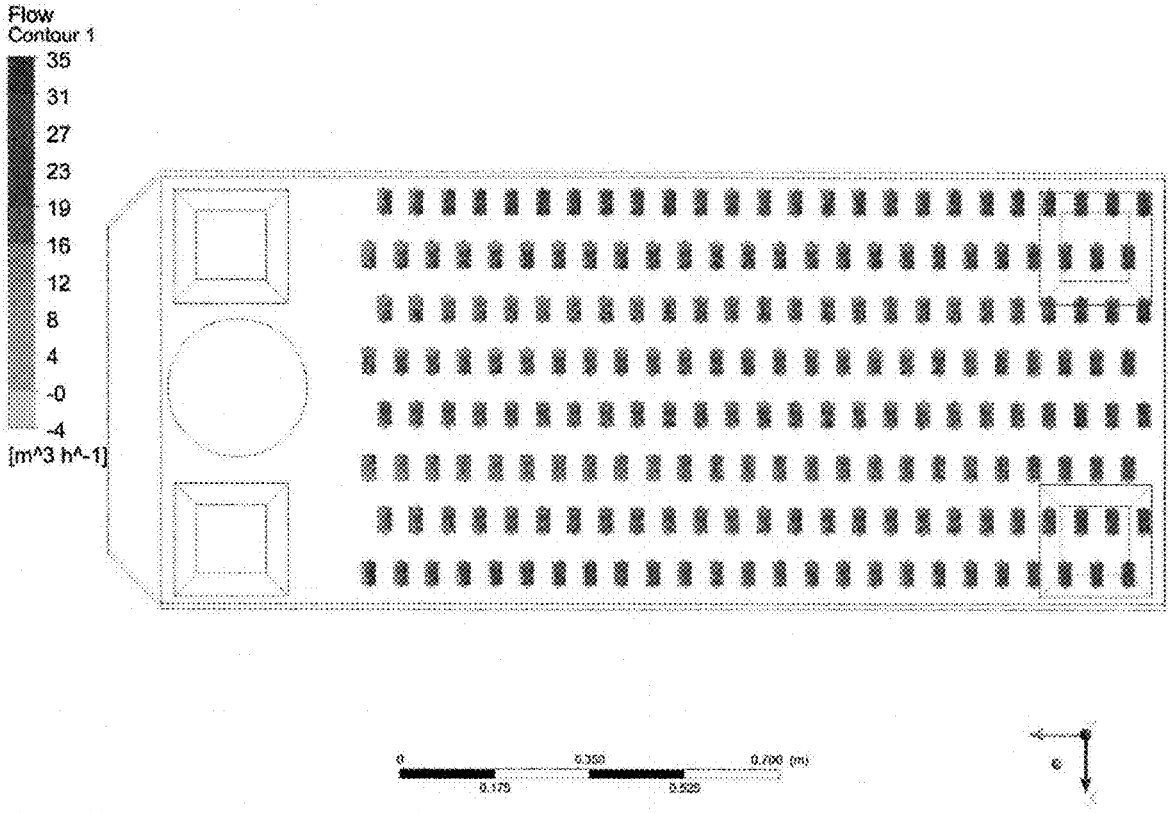
FIG. 29G is a CFD simulation of a high drying unit viewed from the side.

FIG. 29G shows a CFD simulation of a high drying unit viewed from the top. The simulation show the flow volume per hour through the apertures. As can be seen, the flow volume per hour through the apertures is much more uniform than the low drying unit.

Figure 30A:
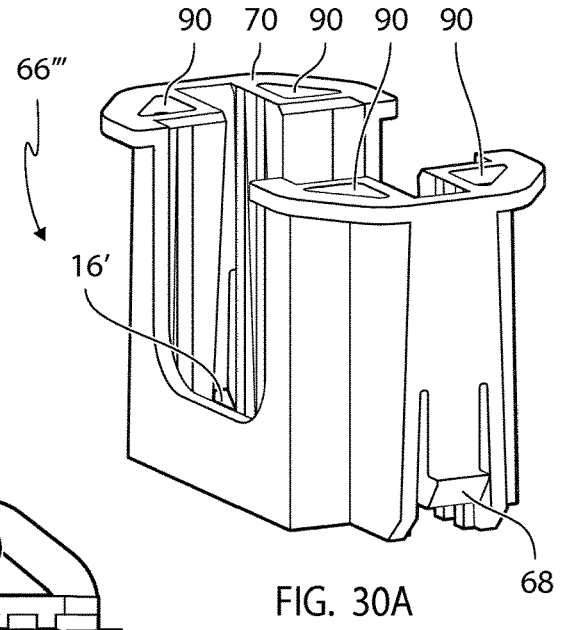
FIG. 30A is a perspective view of an alternative adapter for being fixated in the aperture.

FIG. 30A shows a perspective view of an alternative adapter 66''' for being fixated in the aperture (not shown) of the top plate (not shown) of the drying unit (not shown). The alternative adapter 66''' comprises entrainment openings 90 located adjacent an aperture 16'. The aperture 16' is adapted for accommodating the connecting element (not shown) of a pelt board. In the present embodiment four entrainment openings 90 are used, however, other numbers such as one, two, three, five, six, seven or more may be used. The entrainment openings 90, which constitute additional openings through the adapter 66''', are located adjacent the aperture 16' and surrounds the aperture 16'.

The purpose of the entrainment openings 90 is to provide an unobstructed flow path from the drying unit (not shown) into the pelt board (not shown). The air flowing though the entrainment openings 90 will thus be capable of reaching a higher flow velocity compared to the air flowing through the aperture 16', which aperture 16' is partially obstructed by the connecting element (not shown) of the pelt board (not shown) which is held by the aperture 16'. Thus, significantly more air per unit of time will be able to flow into the pelt board compared to having only a single aperture 16' which is partially obstructed by the pelt board. A larger amount of air flowing into the pelt board and out through the pelt will allow the pelt to dry faster and more efficiently.

The high velocity flow of air through the entrainment openings 90 will result in an additional flow effect in the adjacent aperture 16' which effect is here referred to as the "entrainment effect", which causes the flow in the aperture 16' to be dragged along by the faster flowing air through the entrainment openings 90. The effect which is based on the Bernoulli principle is also known as the "ejector effect". The high velocity flow through the entrainment openings will according to the Bernoulli principle cause a pressure drop in and adjacent to the entrainment openings, which pressure drop will in turn cause the flow through the aperture 16' to increase.

Figure 30B:
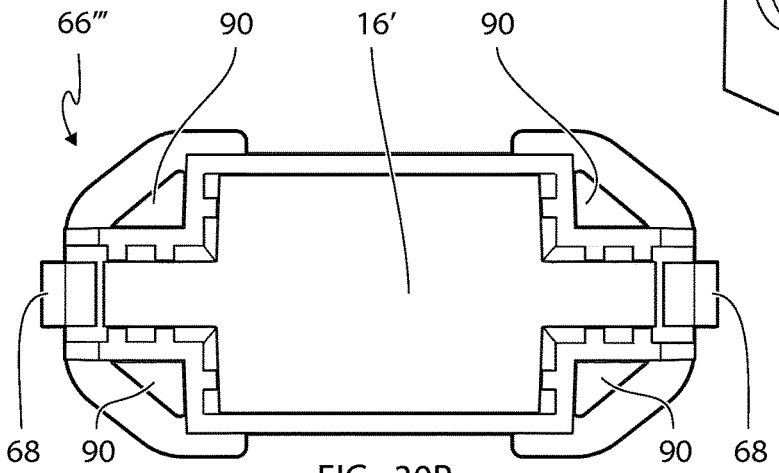
FIG. 30B is a bottom view of the adapter as shown above.

It is further contemplated that the present adapter in order to further increase the entrainment effect may also utilize the so called "venturi effect" which is used in fluid pumps and similar devices FIG. 30B shows a bottom view of the adapter 66''' as described above. The adapter 66''' comprises a clip-on mechanism 68 for attachment to the top plate (not shown) of the drying unit (not shown). The aperture 16' as well as the entrainment openings 90 are visible, all being through-going. The aperture 16' will be partially obstructed by the connecting element (not shown) of the pelt board (not shown) which will take up much of the space of the aperture 16' and reduce the effective flow area through the aperture. The entrainment openings 90 provide a direct flow path from the interior of the drying unit (not shown) to the interior of the pelt board (not shown).

Figure 30C:
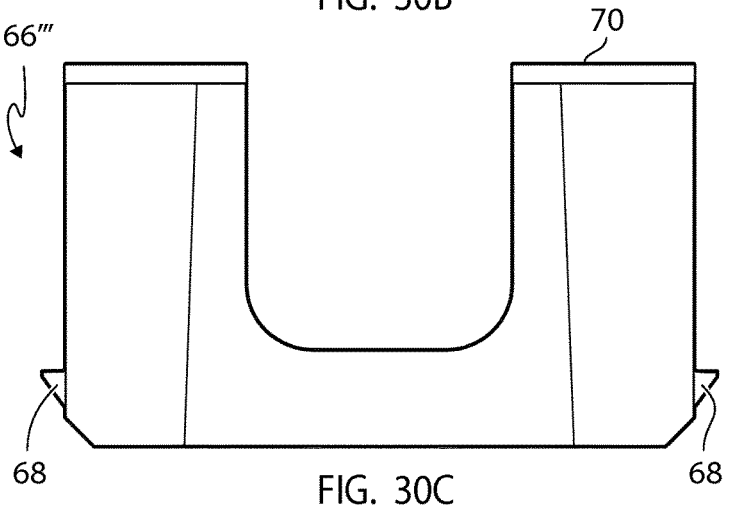
FIG. 30C is a first side view of the adapter.

FIG. 30C shows a first side view of the adapter 66'''. The present view explains the working principle of the clip-on mechanism 68, which grasps below the top plate (not shown) as previously described.

Figure 30D:
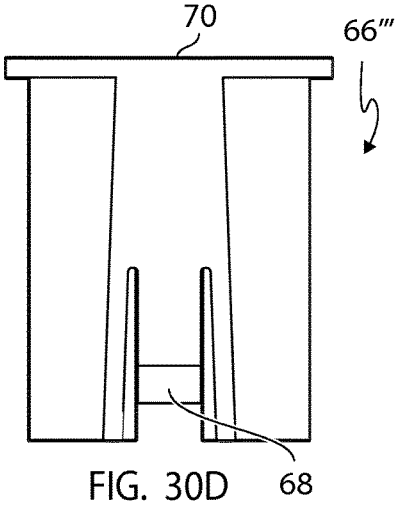
FIG. 30D is a second side view of the adapter.

FIG. 30D shows a second side view of the adapter 66''', illustrating the outer shape of the adapter 66''' and also the working principle of the clip-on mechanism 68.

Figure 30E:
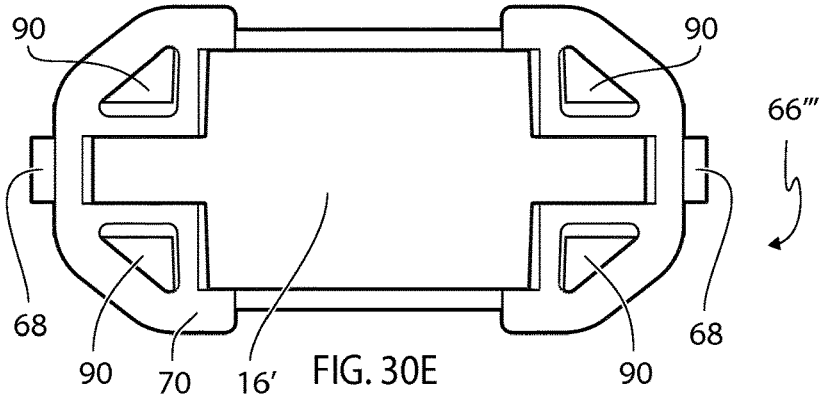
FIG. 30E is a top view of the adapter showing the top portion.

FIG. 30E shows a top view of the adapter 66''' showing the top portion 70 and illustrating the through-going aperture 16' as well as the through going entrainment openings 90.

Figures 31A, 31B:
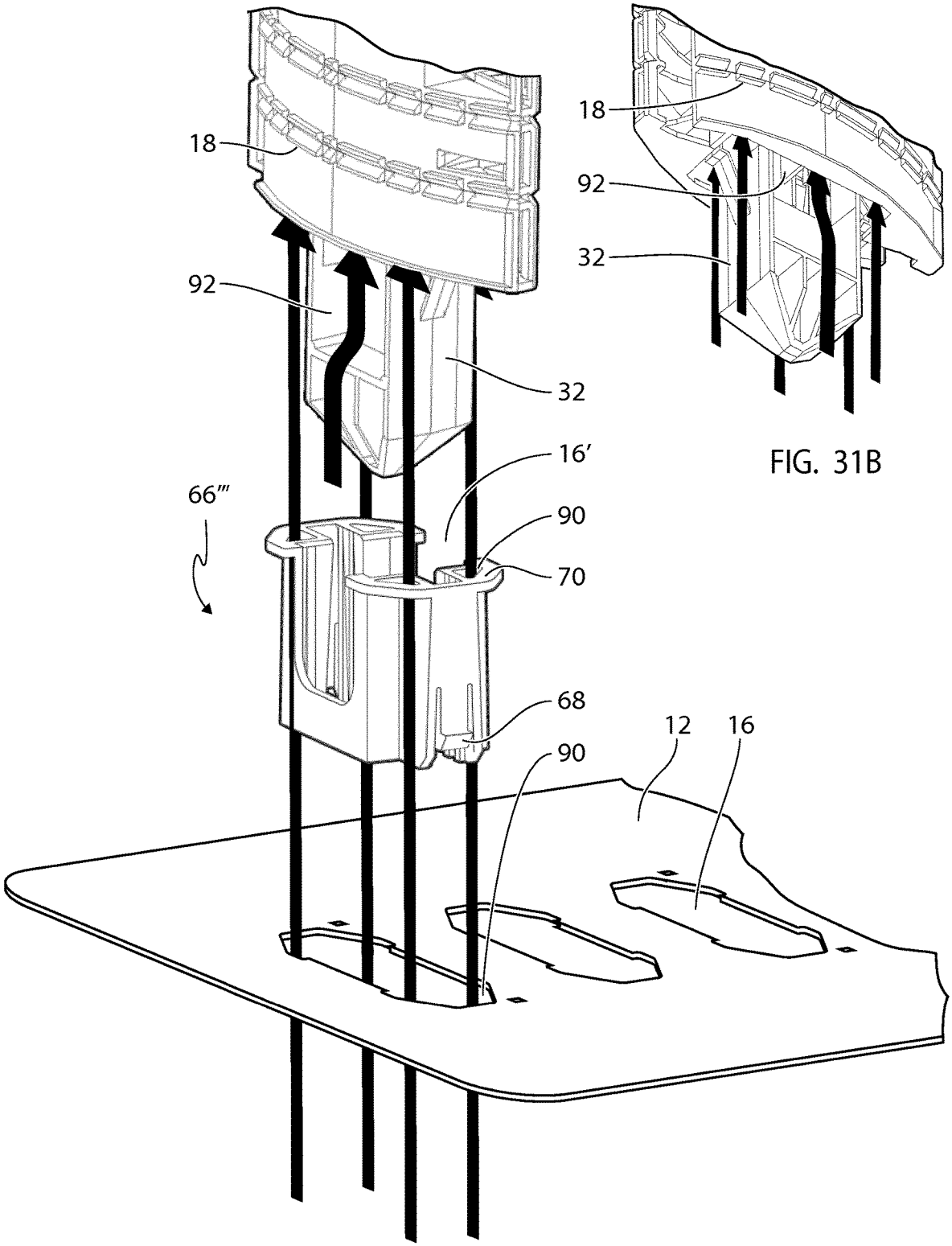
FIG. 31A is a perspective view of the pelt board, the top plate and the adapter.
FIG. 31B is a perspective view of a pelt board.

FIG. 31A shows a perspective view of the pelt board 18, the top plate 12 of the drying unit and the adapter 66'''. The adapter 66''' is fixated in the aperture 16 of the top plate 12 of the drying unit. The connecting element 32 of the pelt board is in turn placed in the aperture 16' of the adapter 66'''. The air, as indicated by the arrows, flows from the interior of the drying unit through the aperture 16 in an unobstructed high velocity stream through each of the entrainment openings 90 and in a partially obstructed lower velocity stream through the aperture 16' into the pelt board 18. The connecting element 32 partially obstruct the flow through the aperture 16' since the connecting element must fit tightly into the aperture 16 for holding the pelt board 18 in a stable position and yet it must contain hollow air passages 92 allowing a sufficient amount of air to flow into the pelt board 18. As explained above, the high velocity flow through the entrainment openings 90 also increases the flow through the aperture 16'.

FIG. 31B shows a perspective view of a pelt board 12. The present view clearly illustrates the flow or air from the aperture (not shown) and the entrainment openings (not shown) into the pelt board 18 by arrows. The connecting element 32 is partially obstructing the central flow path originating from the aperture of the drying unit (not shown) whereas the peripheral flow from the entrainment openings remain unobstructed b the connecting element 32.

Figure 32:
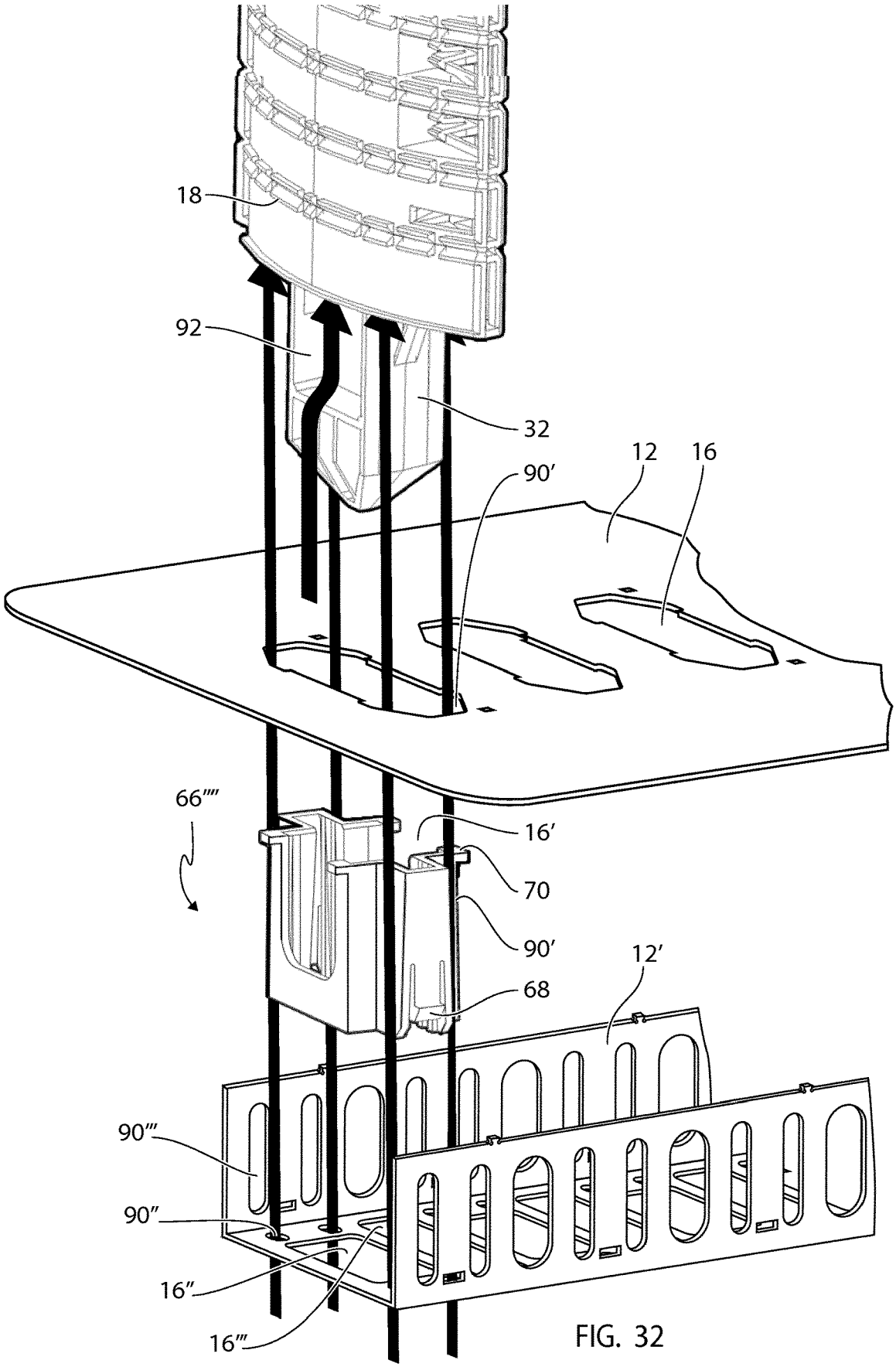
FIG. 32 is a perspective view of an alternate embodiment of a top plate of the drying unit.

FIG. 32 shows a perspective view of an alternative embodiment of a top plate 12 of the drying unit and an adapter 66'''', including the pelt board 18. The present embodiment of the drying unit includes cooperating top plates 12, 12', which together accommodates the adapter 66'''' in cooperating apertures 16, 16''. The connecting element 32 of the pelt board 18 is accommodated in the aperture 16' of the adapter 66''''. The difference with respect to the previous embodiment is that the present adapter does not itself establish the entrainment openings, but the entrainment openings 90' are instead established between the aperture 16 of the top plate 12 and the outer circumference of the top portion 70 of the adapter 66''''. The secondary top plate 12' includes openings 90'' 90''' which supply air to the entrainment openings 90' established between the aperture 16 of the top plate 12 and the outer circumference of the top portion 70 of the adapter 66''''. Optionally, additional apertures 16''' are provided adjacent the aperture 16'' for reducing the effect of the flow obstruction through the apertures 16, 16' and 16''.

Figure 33A:
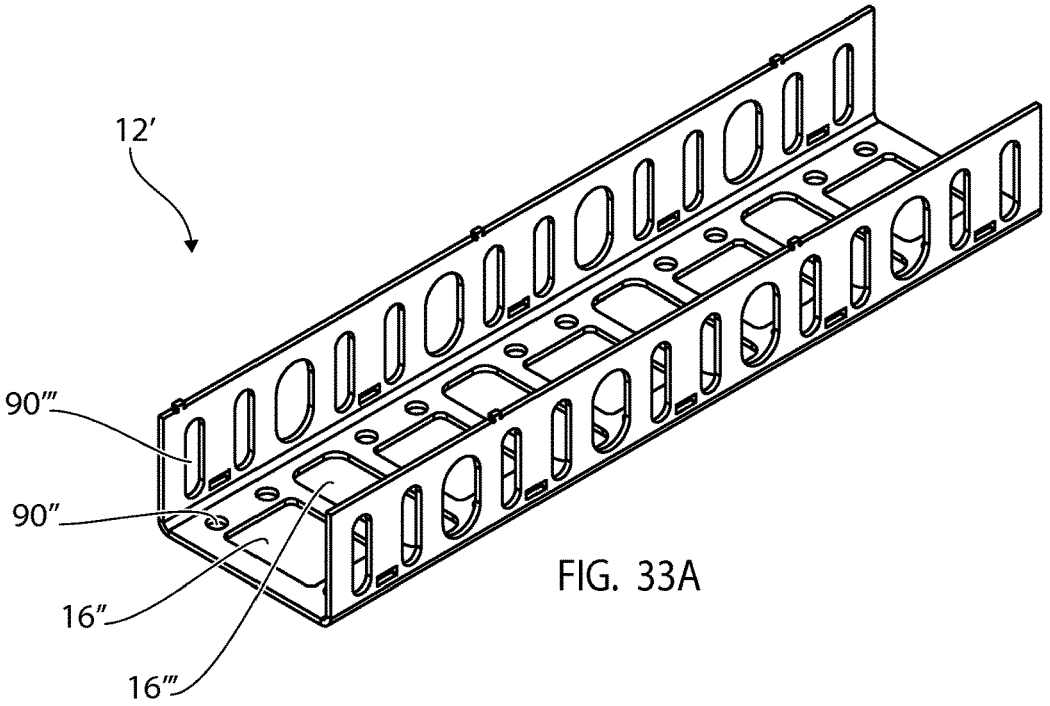
FIG. 33A is a perspective view of a secondary top plate.

FIG. 33A shows a perspective view of a secondary top plate 12'. The illustration clearly shows the aperture 16 for accommodating the adapter (not shown), the additional aperture 16''' for reducing the flow resistance through the other apertures 16 16'', and the openings 90'' 90''' which supplies air to the entrainment openings.

Figure 33B:
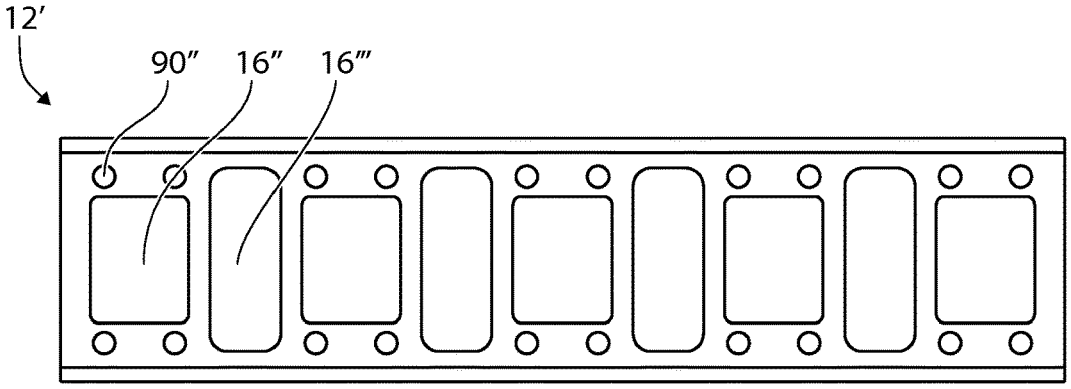
FIG. 33B is a top view of a secondary top plate.

FIG. 33B shows a top view of a secondary top plate 12'.

Figure 33C:
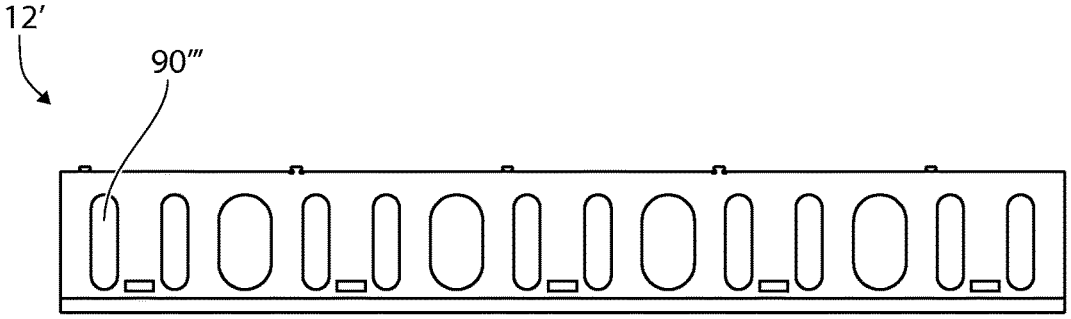
FIG. 33C is a side view of a secondary top plate.

FIG. 33C shows a side view of a secondary top plate 12'.

The following FIGS. 35A-C are self-explanatory proof-of-concept CFD (Computational Fluid Dynamics) simulations made in order to increase the understanding of the alternative adapter according to present invention as described above.

Figure 34A:
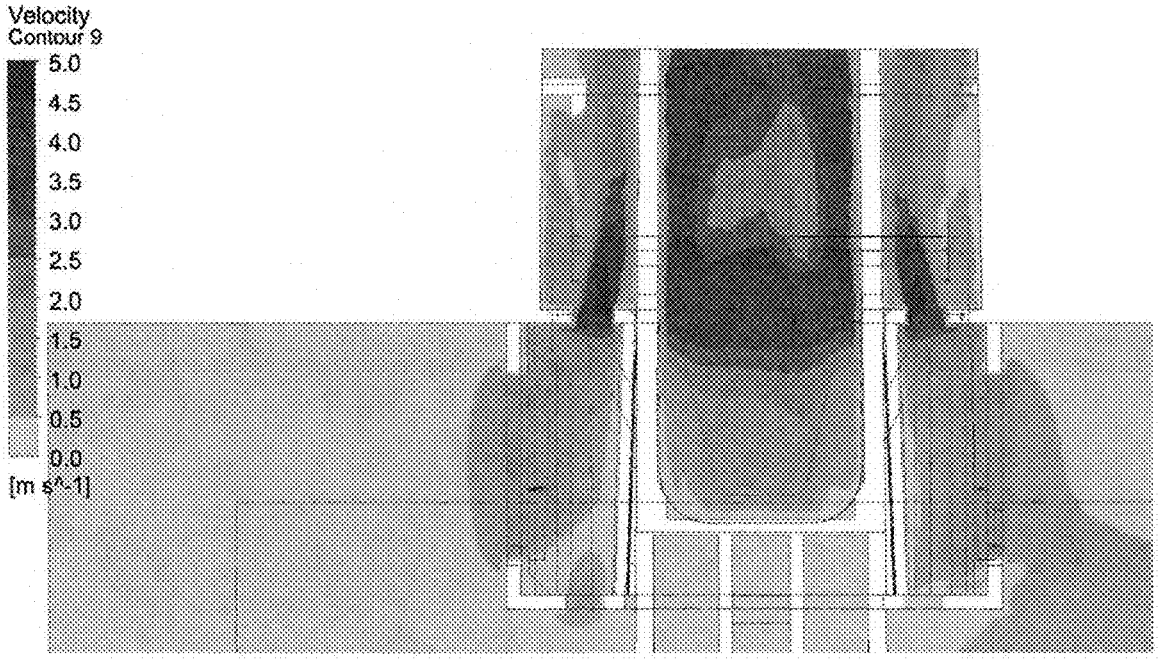
FIG. 34A is a CFD simulation of a drying unit viewed from the side.

FIG. 34A shows a CFD simulation of a drying unit viewed from the side. The simulation shows the flow velocity inside the inner space. As can be seen, the flow velocity is very high in the unobstructed entrainment openings.

Figure 34B:
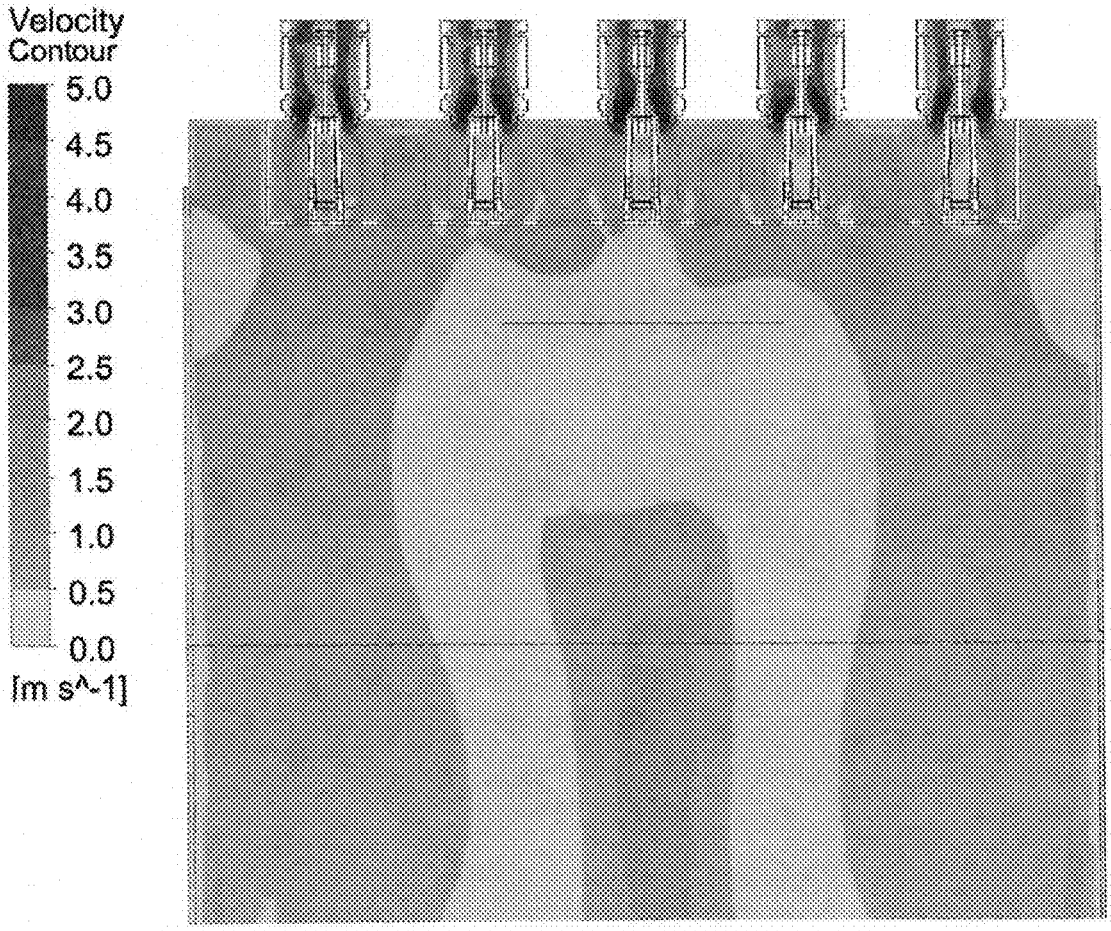
FIG. 34B is another CFD simulation of a drying unit viewed from the side.

FIG. 34B shows a CFD simulation of a drying unit viewed from the side. The simulation is a close-up of the top plate, the adapter, the connecting element and the lower part of the pelt board. As can be seen, the flow velocity is very high in the unobstructed entrainment openings, which in turn increases the velocity of the slower central flow in the aperture.

Figure 34C:
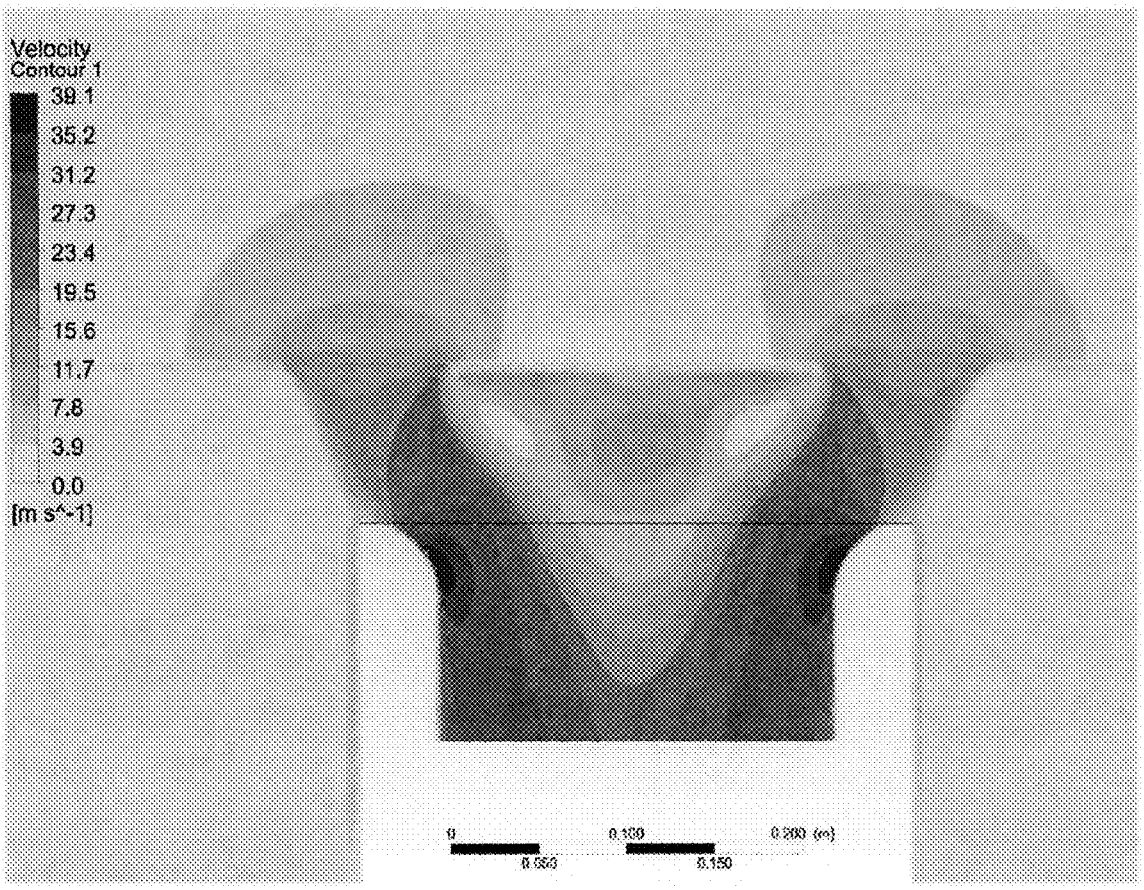
FIG. 34C is a CFD simulation showing the suction effect in the aperture.

FIG. 34C shows a CFD simulation showing the suction effect in the aperture generated by the high velocity flow in the entrainment openings.

Figure 35:
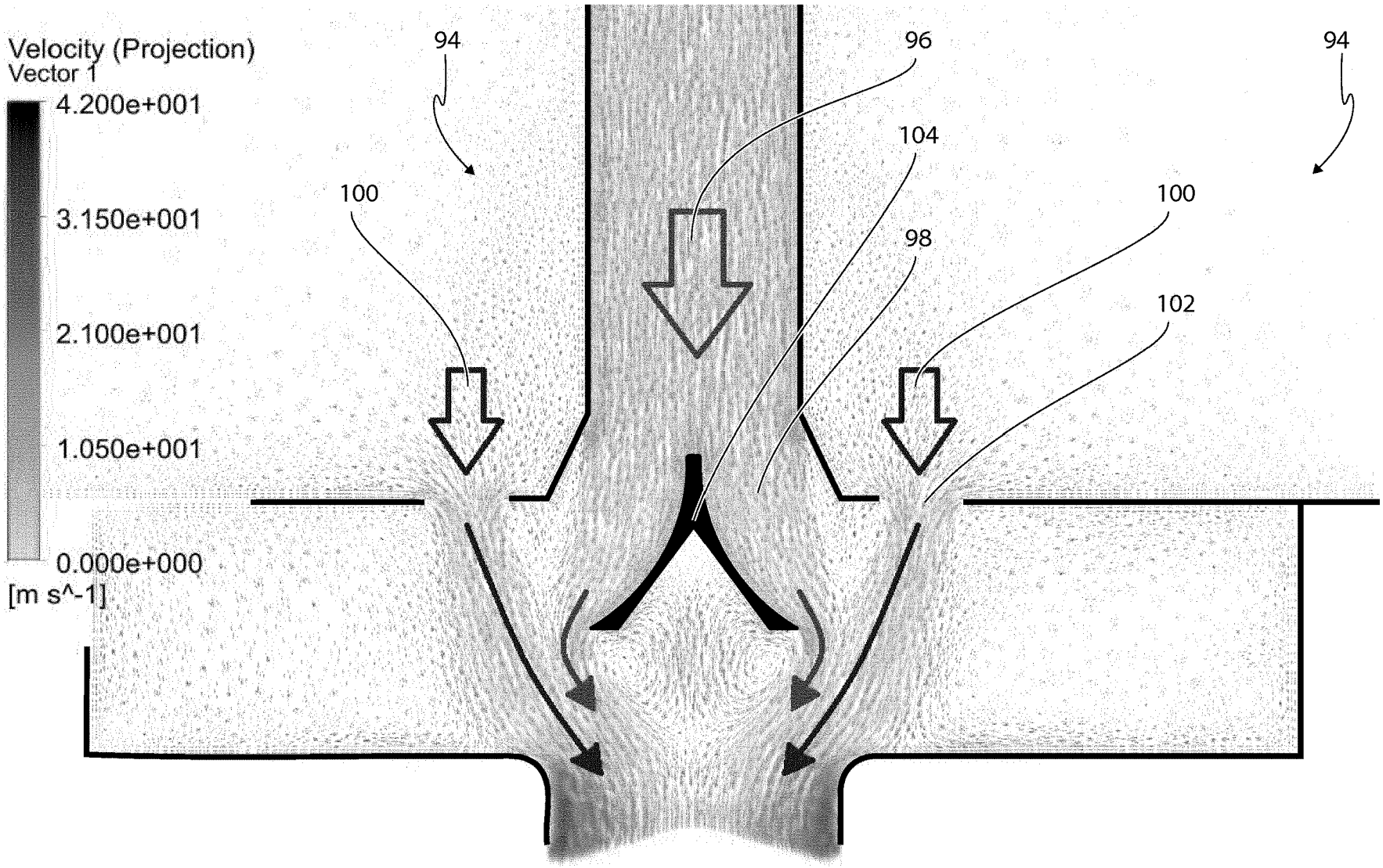
FIG. 35 shows a flow simulation of an air supply part for a drying unit.

FIG. 35 shows a flow simulation of an air supply part 94 for a drying unit. The main flow 96 of drying air enters the air supply part 94 of the drying unit through a central inlet 98, whereas an auxiliary flow 100 of drying air is introduced through a circumferential intel 102. In a preferred embodiment, the main flow 96 constitutes conditioned dry air from an air conditioning system, whereas the auxiliary flow 100 constitutes ambient air from the immediate surroundings, which typically have a higher humidity than the conditioned air.

The main flow 96 enters the central intel 98 of the air supply part 94 driven by a fan and attaches to a flow distribution cone 104 which guides the flow outwards past the circumferential inlet 102. In this way, the auxiliary flow 100 is established via the Coanda effect, i.e. the auxiliary flow 100 is automatically sucked into the circumferential inlet 102 from the passing main flow 96, and the main and auxiliary flows will subsequently mix. The flows are shown by the arrows and are intended to be mixed inside the air supply part 94.

Figure 36:
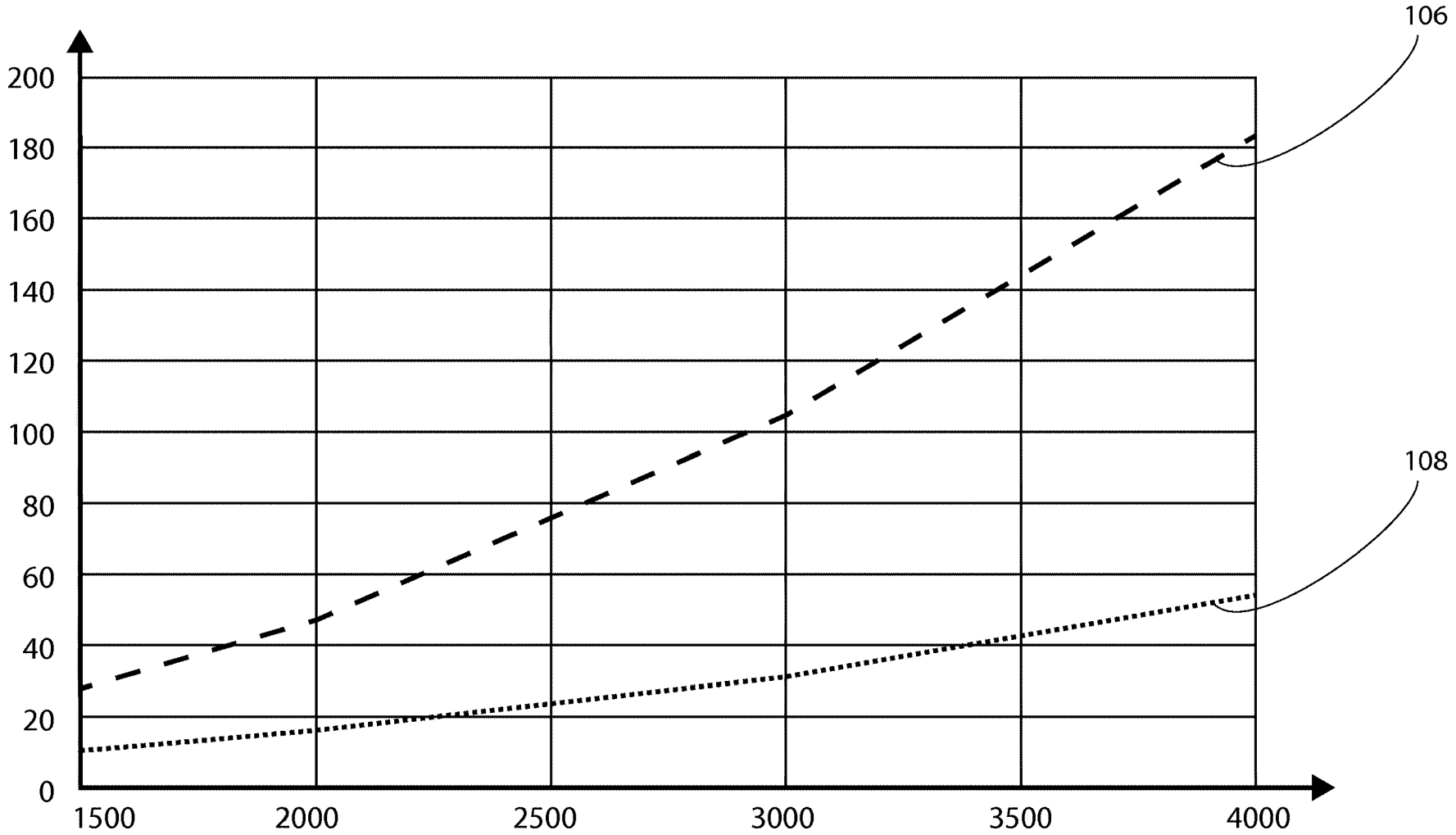
FIG. 36 shows a diagram illustrating the amount of air entering the air supply part.

FIG. 36 shows a diagram illustrating the amount of air entering the air supply part. The ordinate axis defines the pressure difference in Pa and the abscissa axis defines the flow in $m^3/h$. The dashed line 106 represents the inflow of air in a prior art drying unit having an internal blower and a single gas inlet, whereas the dotted line represents the inflow of air in the above drying unit having a main inlet and a circumferential inlet utilizing the Coanda effect.

Figure 37:
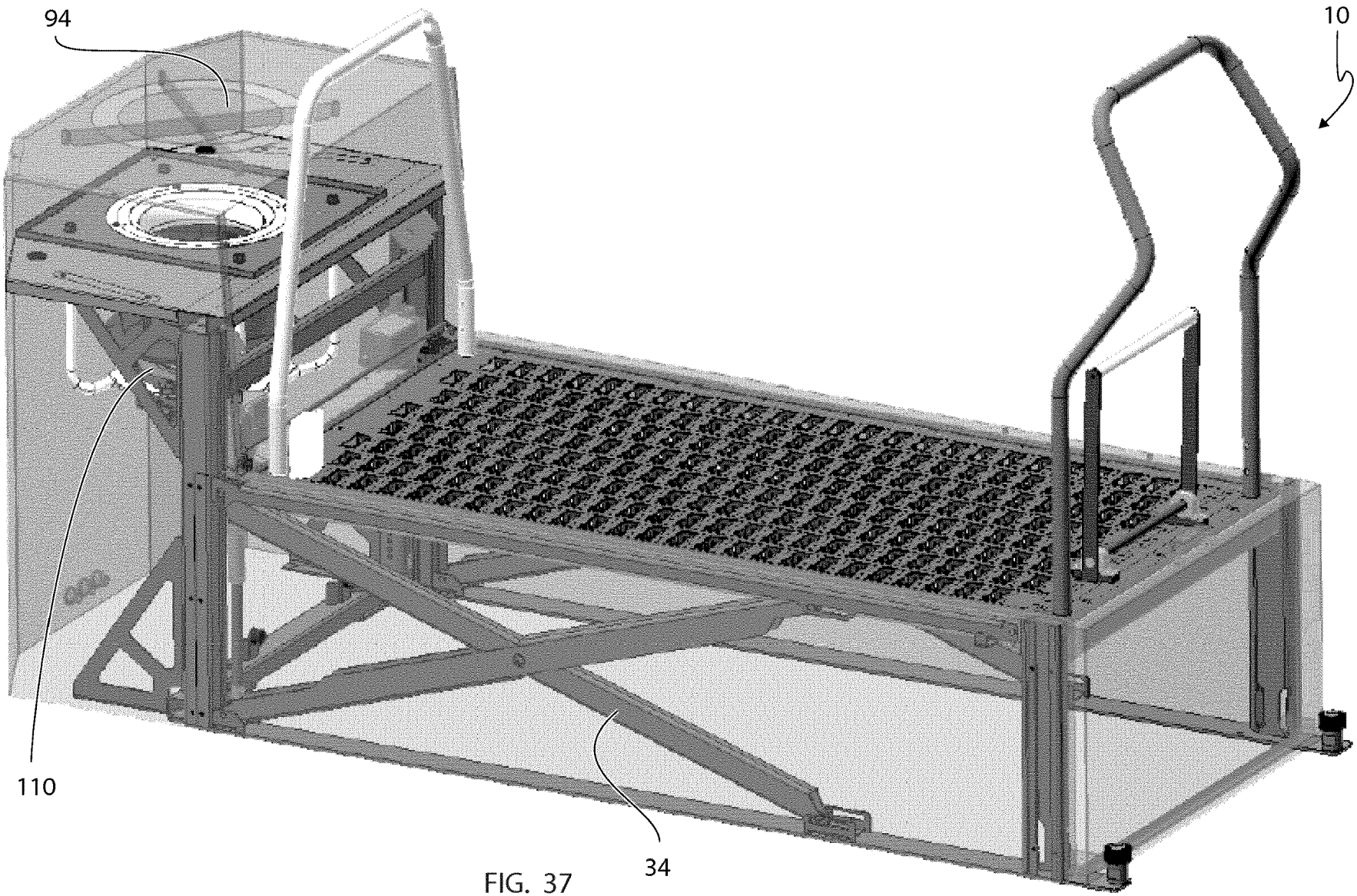
FIG. 37 shows a perspective and partially transparent view of a drying unit.

FIG. 37 shows a perspective and partially transparent view of a drying unit 10 in accordance with the present invention. The present drying unit features the air supply part 94 as described above and further an auxiliary blower 110, which as such is optional however contributes to establish an under pressure in the air supply part in order to force even more air into the drying unit 10.

Figure 38A:
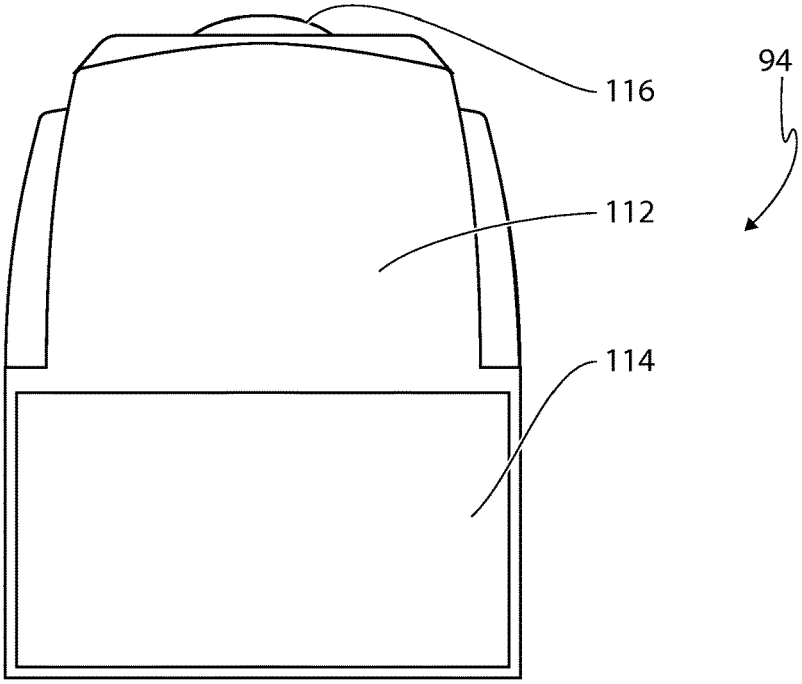
FIG. 38A shows a front view of a universal casing for covering the air supply part.

FIG. 38A shows a front view of an universal casing 112 for covering the air supply part as described above. The casing 112 comprise an interface 114 to the gas inlet of the drying unit. Further, the top of the casing 112 defines a removable dome 116, which will be explained in detail below.

Figure 38B:
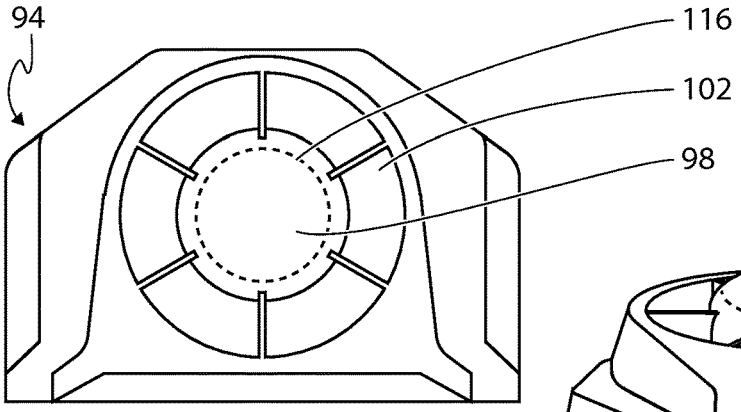
FIG. 38B shows a top view of the universal casing.

FIG. 38B shows a top view of the universal casing 112. The casing defines the dome 116, which is circumferentially enclosed by the circumferential air inlet 102. In case no air conditioning unit is available, all drying air is received from the ambient surroundings and consequently the circumferential air inlet is used for receiving the main flow of drying air, whereas optional side openings (not shown) may be used for receiving the auxiliary flow, if required. One or two internal fans are required for achieving the flow of drying air.

However, in case an air condition unit is available, the dome 116 may be removed and the flow of air is as illustrated above, i.e. the main flow of air thought the central inlet 98 available when the dome 116 is removed, and the auxiliary flow of air thought the circumferential air inlet 102.

Figure 38C:
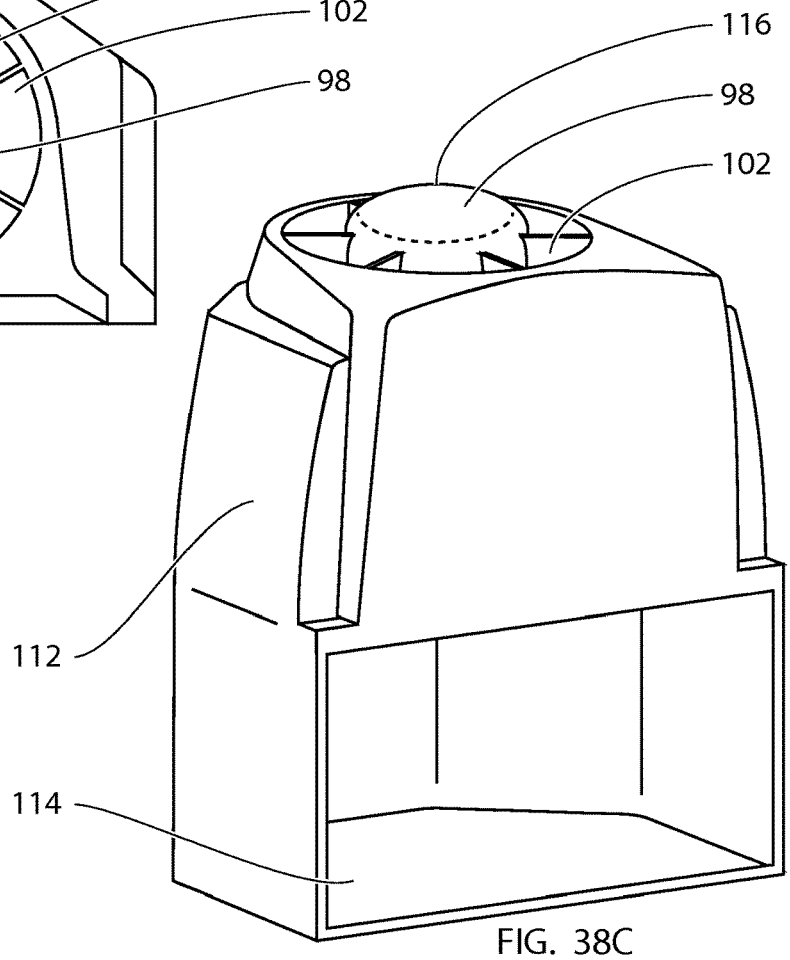
FIG. 38C shows a perspective view of the universal casing.

FIG. 38C shows a perspective view of the universal casing 112, which is intended to vocer the air supply part as described above.

Figure 39:
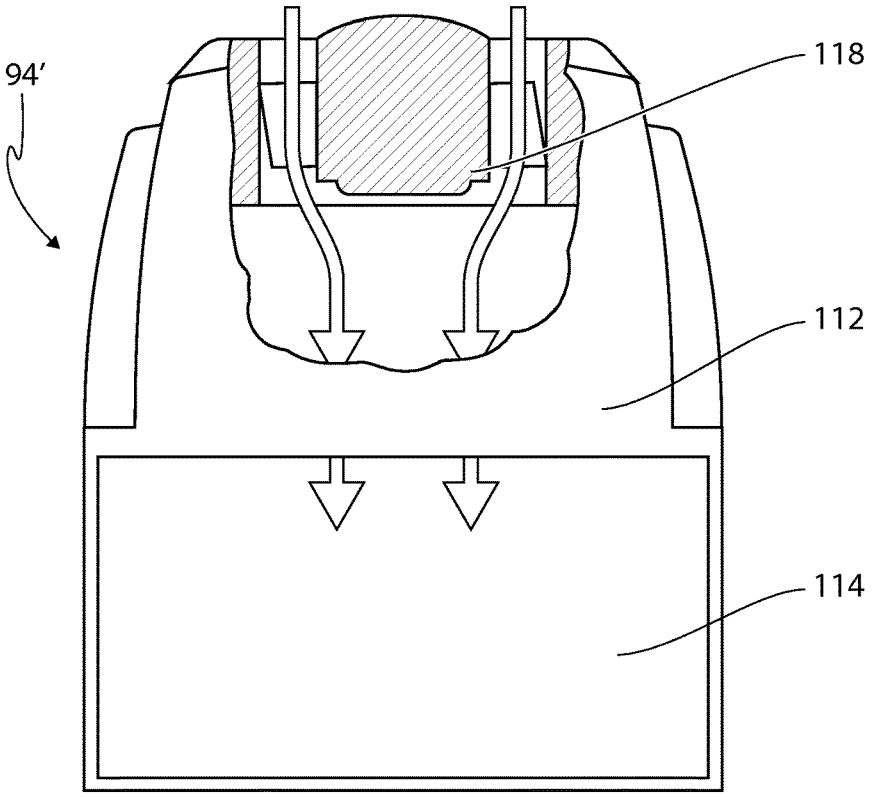
FIG. 39 shows a front view of a basic embodiment of the air supply part.

FIG. 39 shows a front view of a basic embodiment of the air supply part 94', in which the circumferential inlet 102 is used as the sole air inlet, powered by a fan 118. This embodiment is used without any air conditioning unit.

Figure 40:
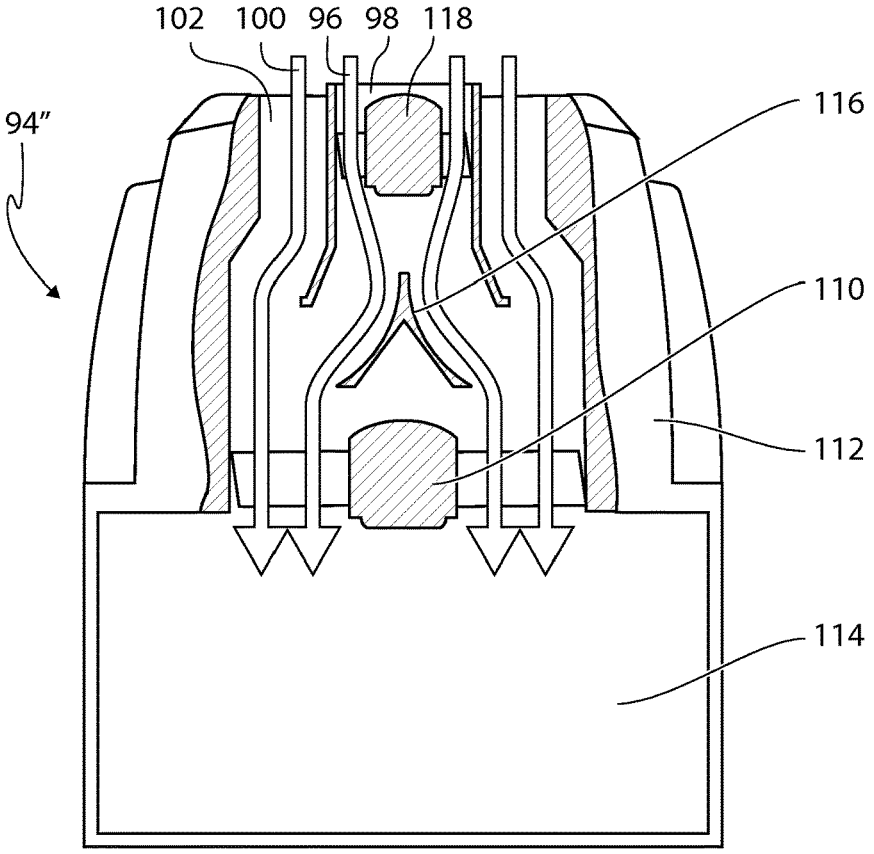
FIG. 40 shows a front view of an embodiment of an air supply part.

FIG. 40 shows a front view of an embodiment of an air supply part 94", in which no air conditioning unit is used, however, an increased amount of drying air is desired. The main flow 96 of air enters at the central inlet 98, adheres to the flow distributing cone 104, flows past the auxiliary air inlet 102 and thereby causes additional drying air 100 to be sucked in via the circumferential opening 102. An auxiliary fan 110 may be used to establish an under pressure within the air supply part 94' for providing additional suction of air.

Figure 41:
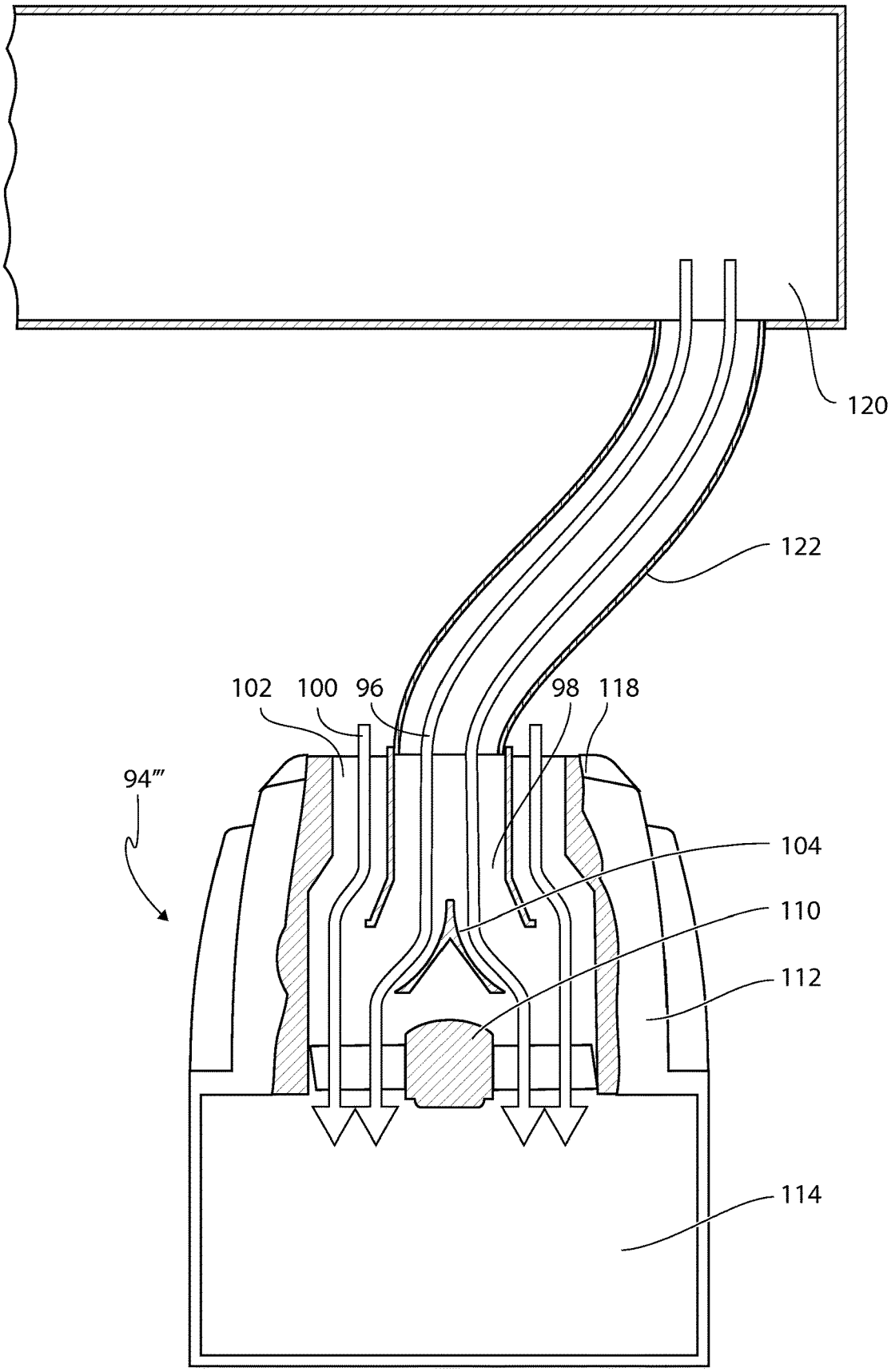
FIG. 41 shows a front view of the preferred embodiment of an air supply part.
Figure 42:
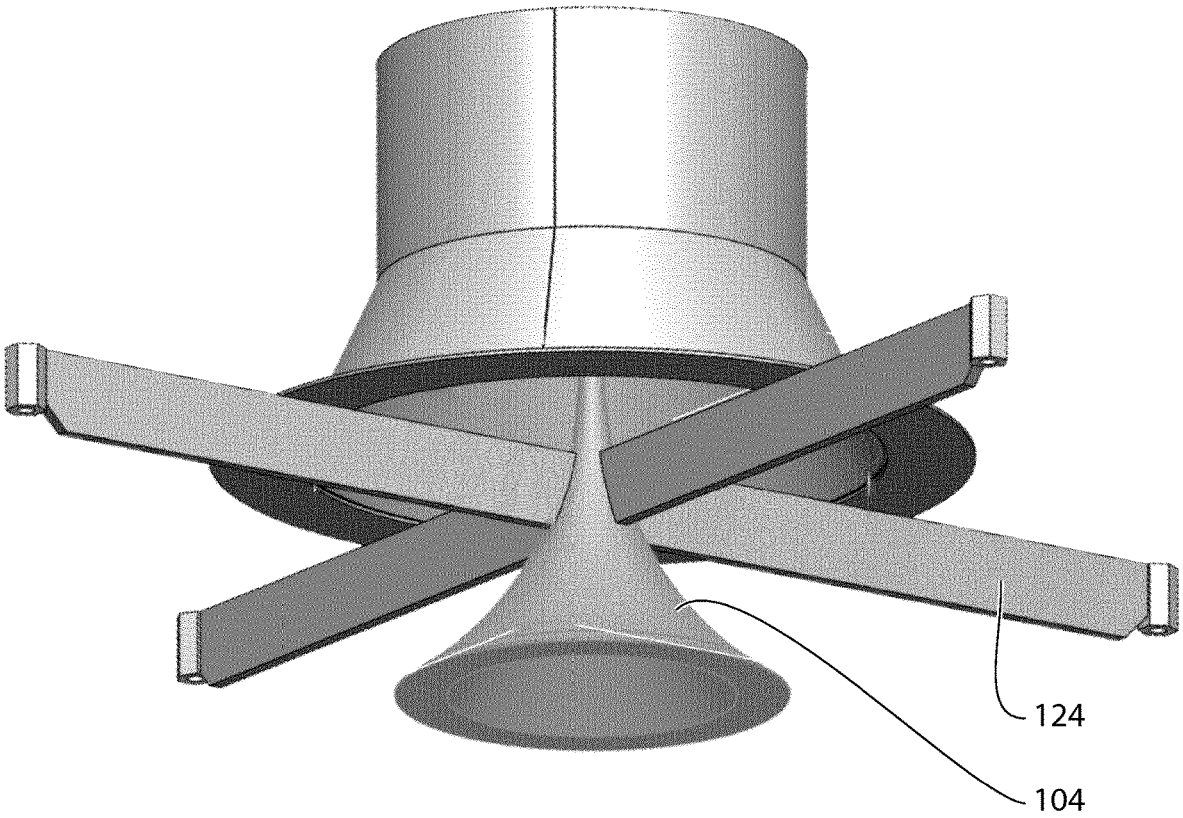
FIGS. 42 to 47 show various designs of the flow distribution cone.
Figure 43A:
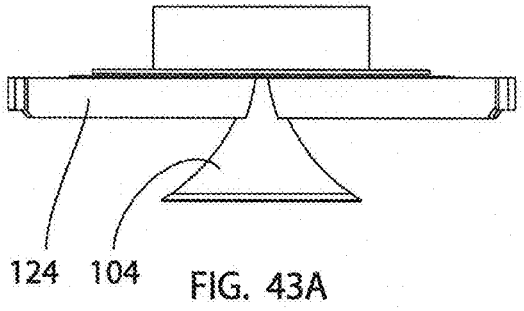
Figure 43B:
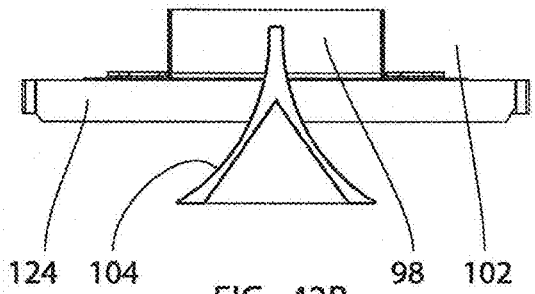
Figure 43C:
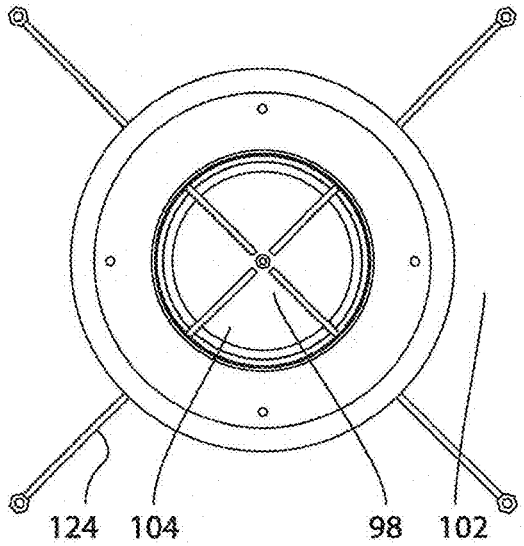
Figure 43D:
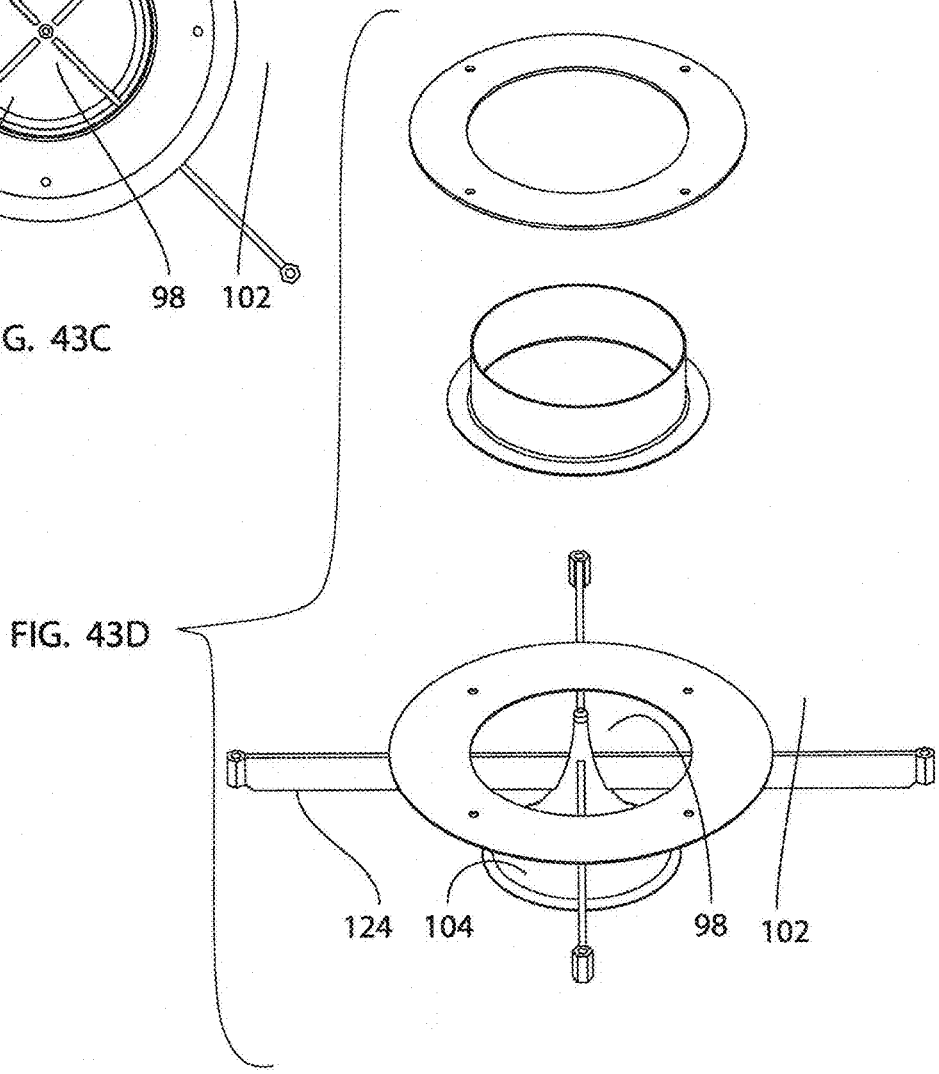
Figure 44A:
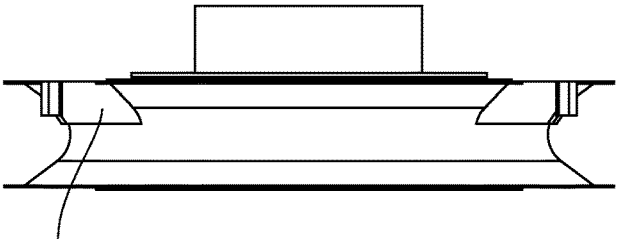
Figure 44B:
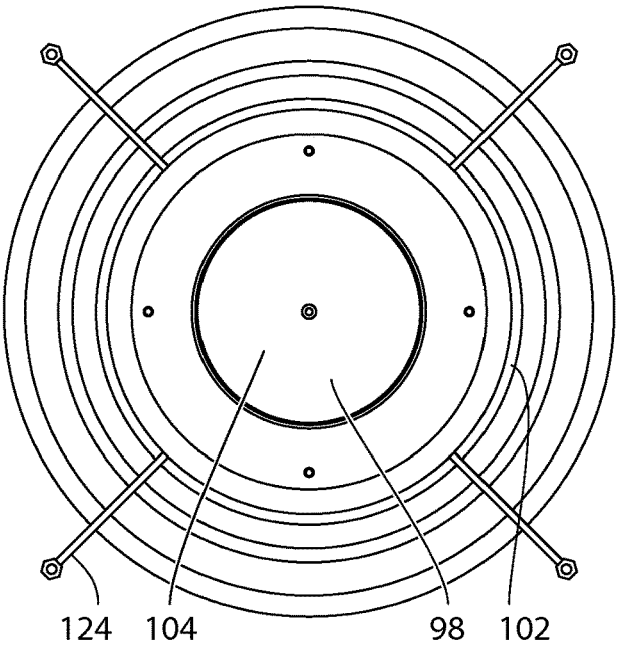
Figure 44C:
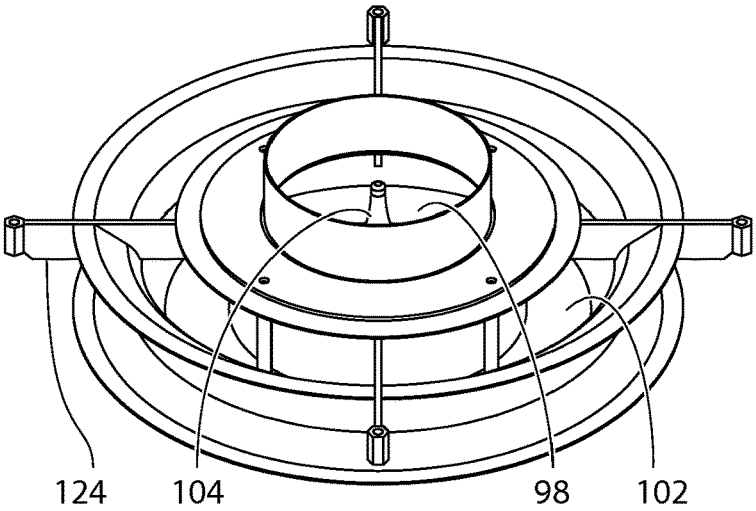
Figure 45A:
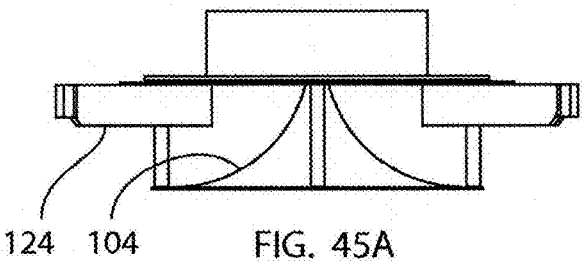
Figure 45B:
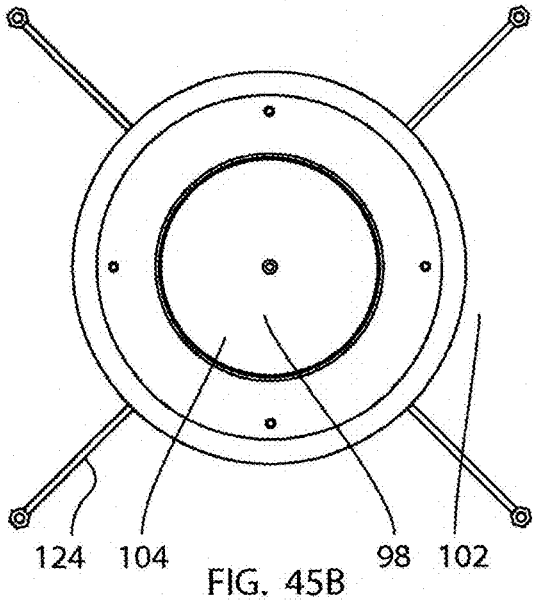
Figure 45C:
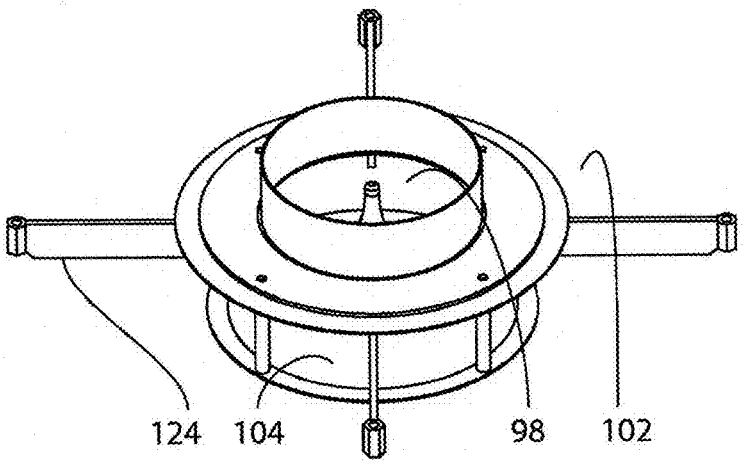
Figure 46A:
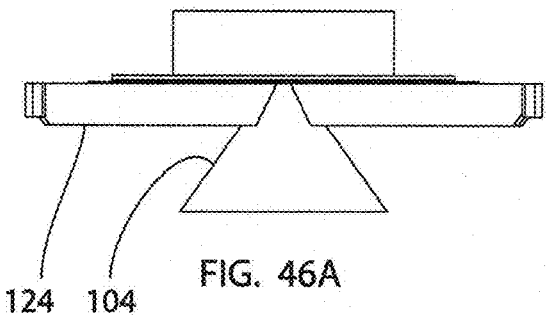
Figure 46B:
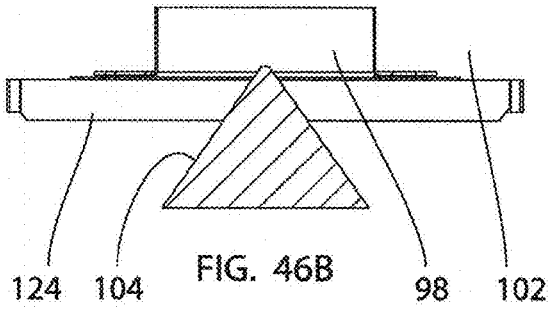
Figure 46C:
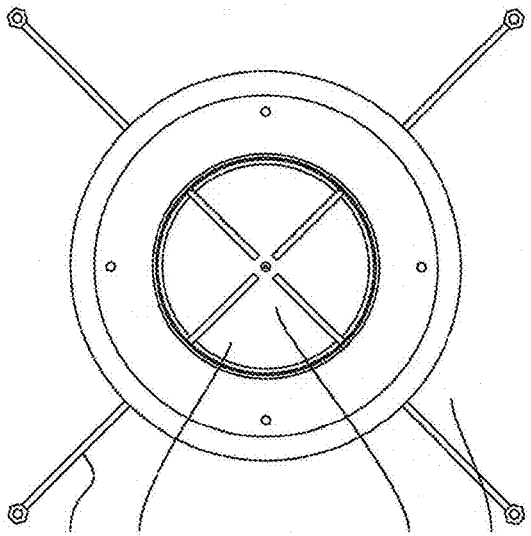
Figure 46D:
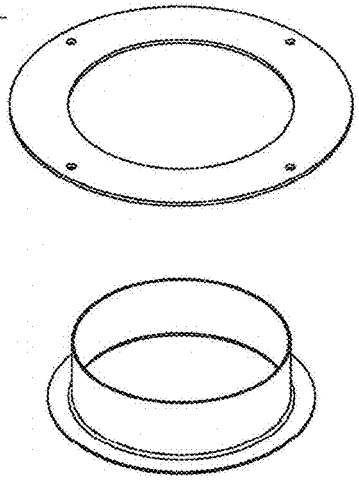
Figure 46D:
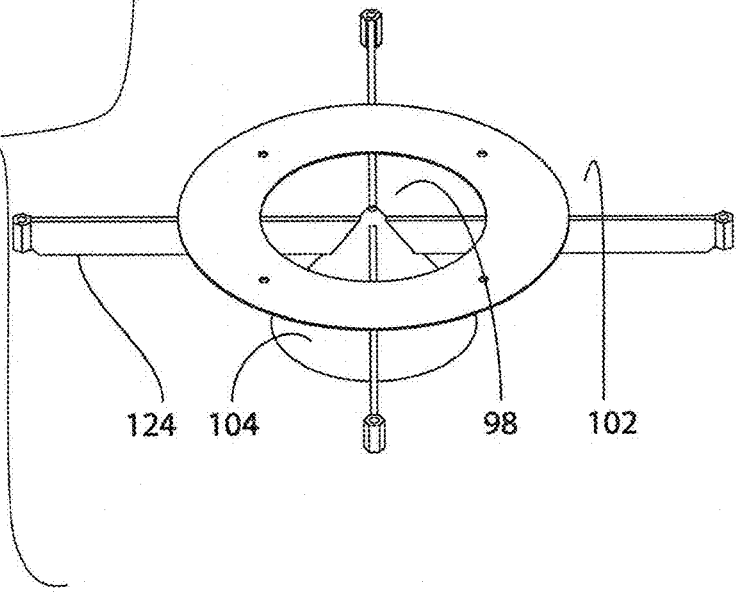
Figure 47A:
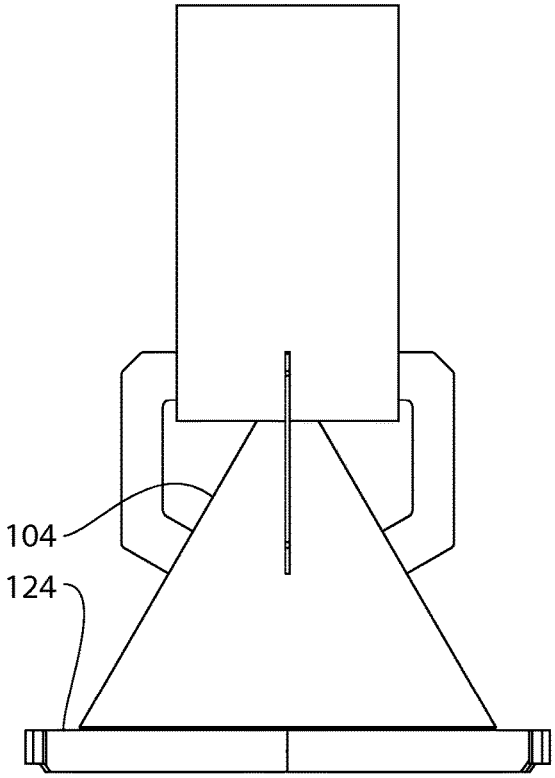
Figure 47B:
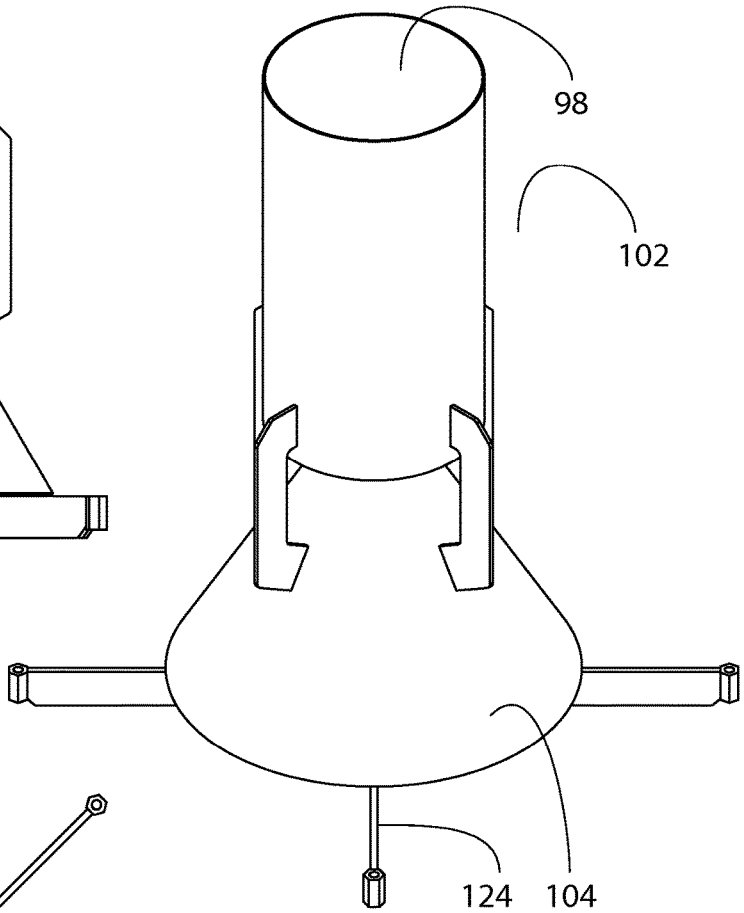
Figure 47C:
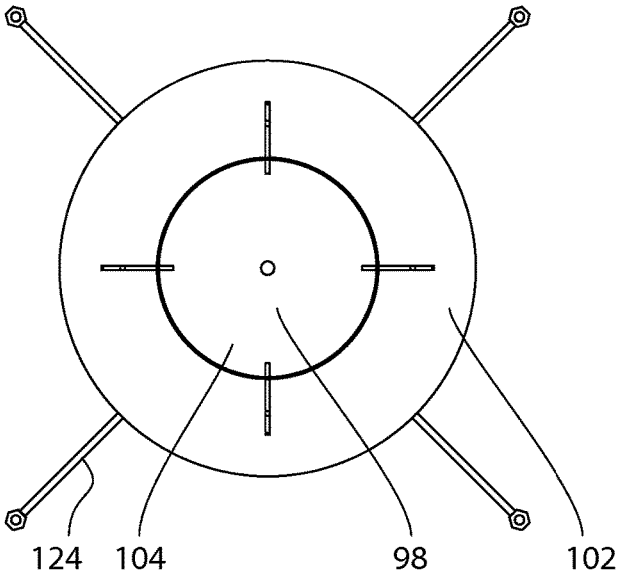

FIG. 41 shows a front view of the preferred embodiment of an air supply part 94'". The present embodiment is used together with an air conditioning unit 120 to add and mix a forced flow of conditioned dry air 96 together with a separate airflow of non conditioned air 100 within the air supply part.

The ambient air is sucked into the air supply part 94'" by the means of suction by negative pressure created by a build in speed controlled ventilator/fan 110 in combination with the conditioned air 96, which is forced into the air supply part 94'" in a tube 122 with a positive pressure by an external ventilation/air condition system. The air mixing system formed by the flow distribution cone 104 mixes these two separate inflows of air efficiently. The air conditioning system may use air from the outside or inside of the building and may include cooling/heating/humidifier/dehumidifier/filter etc., in order to improve the drying efficiency.

The negative pressure created by the built in fan/ventilator 118 create a sucking force/stream and the air suction sucks the conditioned air 96 into the air supply part 94'". The flow distribution cone 104 acts as a flow divider in the air supply part 94'" and ensures that the auxiliary airflow from the ambient surrounding the drying unit enters the air stream and efficiently mixes with the conditioned air. The applicant company had the present layout of the air supply part 94'" designed and optimized by using computer software and computational fluid dynamics (CFD)/numerical analysis and algorithms.

The present layout makes sure that an equal amount of air is feed to the main air cavity distribution channel of the drying system and then to the individual pelts over time. The dual air streams in the air supply part 94'" make the system less dependent or even independent of the external air condition system 120 and the tube 122 because if a smaller amount of conditioned air is forced into the housing by the connected tube, the fan 118 will naturally equalize this and keep the balance by simply drawing in more air from the surrounding air outside the air supply part 94". In this way, the correct amount of drying air is always blown into the station and thereby the pelts no matter how the external air condition are operating. The drying unit will always use the added conditioned air very efficiently and the design of the center cone 104 combined with airflow made by the negative air pressure will always try to draw all the good conditioned air out of the inlet/feeding tube 122.

A sensor package (not shown) and related/connected control system (not shown) may optionally be used inside the air supply part 94'" in order to monitor the air quality. The sensors may include one of or an array of airflow sensors and air humidity sensors in combination with a control box. The values may be used together with valves (not shown), which may be opening and closing in response to the measured values in order to achieve a perfect mixture of conditioned and ambient air. The valves may e.g. be mounted at the central inlet 98 and/or the circumferential inlet 102 in order to regulate the flows thought said passages. For instance, in case the drying air is deemed to be too dry, more ambient air may be drawn in by further opening a valve at the circumferential inlet 102 or vice versa. Further, the RPM (revolutions per minute) of the internal fan 118 and/or air conditioning system 120 could as well be controlled by the sensors.

The airflow may be measured directly at the central inlet 98 and/or the circumferential inlet 102 and/or at the fan 118

The control box may regulate the amount of drawn in ambient air, having a natural high humidity, if the external air-condition system forces a lot of "very dry air" into the tube and into the drying unit. The regulation parameters could be determined by a mathematically algorithm or formula build on experience of how to dry pelts most efficiently, and could as well be adjusted by measuring the surrounding ambient air and temperature inside the drying room, in which the pelt drying takes place etc.

Historically, the air condition systems used at pelting plants are often fluctuating, i.e. the temperature and humidity increases and decreases from the set value. This is due to the external climatic weather conditions (outside temperature and outside humidity), and these systems are often undersized, i.e. too small, to keep a certain set point at all times/all external climatic conditions. Further, these air condition systems are often slow reacting, so that a fast acting control and assist system within the drying stations could assist the drying room air condition system to keep closer to a desired defined setpoint/setpoints.

FIGS. 42 to 47 show various designs of the flow distribution cone 104. The figures show various views of flow distribution cones 104 of slightly different shape but essentially the same functionality and the design may be optimized using CFD calculations and depend on the airflow and how much ambient air is desired to be drawn in by the Coanda effect. The design and the space available within the drying unit also plays a role for the shape of the flow distribution cone 104 and the relates central inlet 98 and circumferential inlet 102. The cone 104 is held in place by a fixation 124.

Figure 48A:
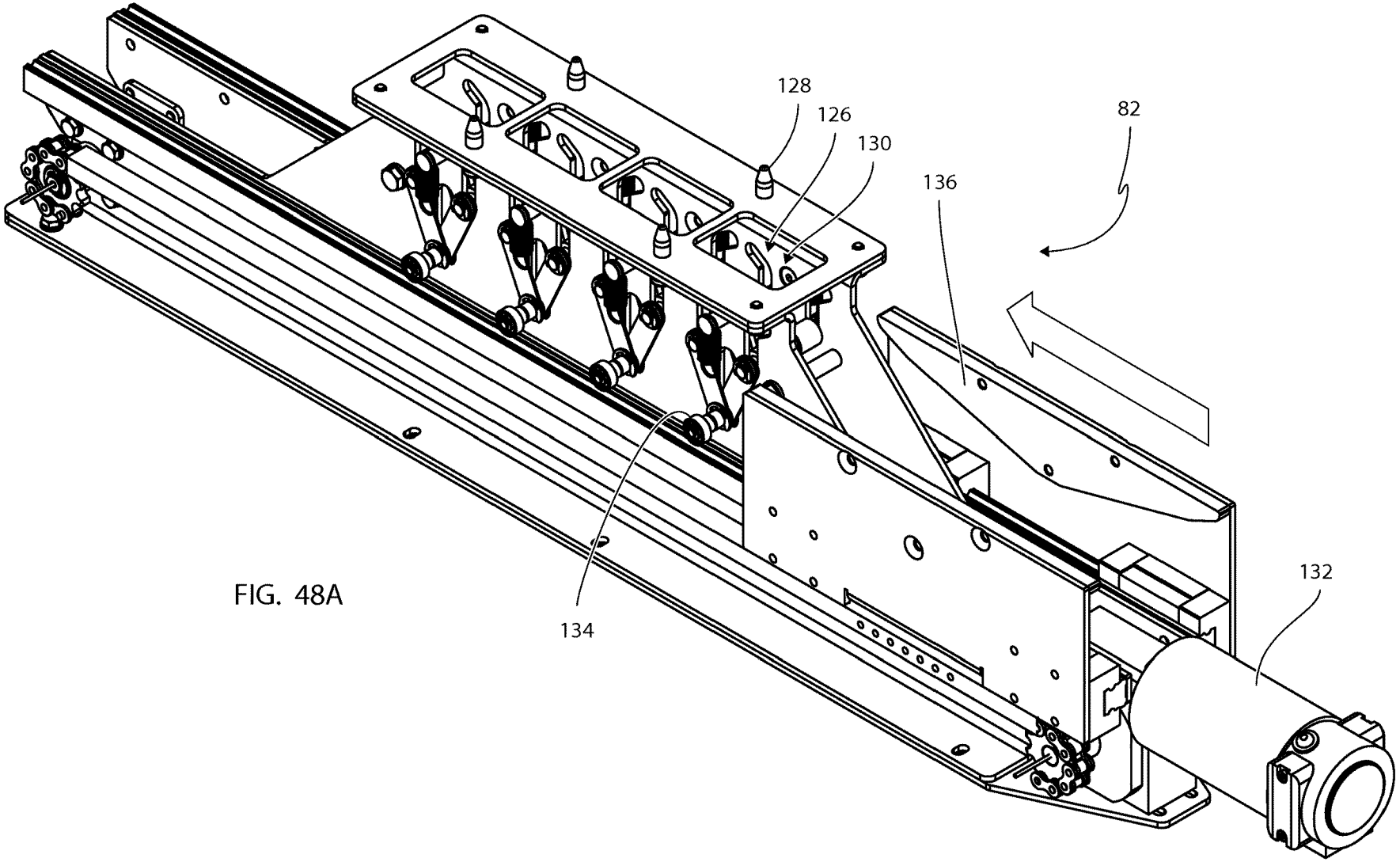
FIG. 48A shows a perspective view of a release mechanism for automatic release.

FIG. 48A shows a perspective view of a presently preferred release mechanism 82 for automatic release of the skins/pelts off the pelt boards (not shown). The pelt board connection element, which is used for expanding and collapsing the pelt boards, extend into a hole 126 of the release mechanism 82, which preferably form part of a stand alone release station, but which may also be incorporated into the drying unit. The pelt board holding unit (not shown) is placed on the release mechanism 82. Pins 128 may be used to keep it in place. Gripping members 130 are used for pulling the connection element of the pelt boards in order to collapse the pelt board, which will allow the pelts to be removed easily. A drive mechanism 132 is used for engaging the gripping members 130. The movement of the gripping members 130 are controlled by tabs 134, which are engaged by an actuator driven along one row of pelt boards in the longitudinal direction by the drive mechanism 132 for collapsing those pelt boards, as will be further explained below in connection with FIGS. 49 and 50.

Figure 48B:
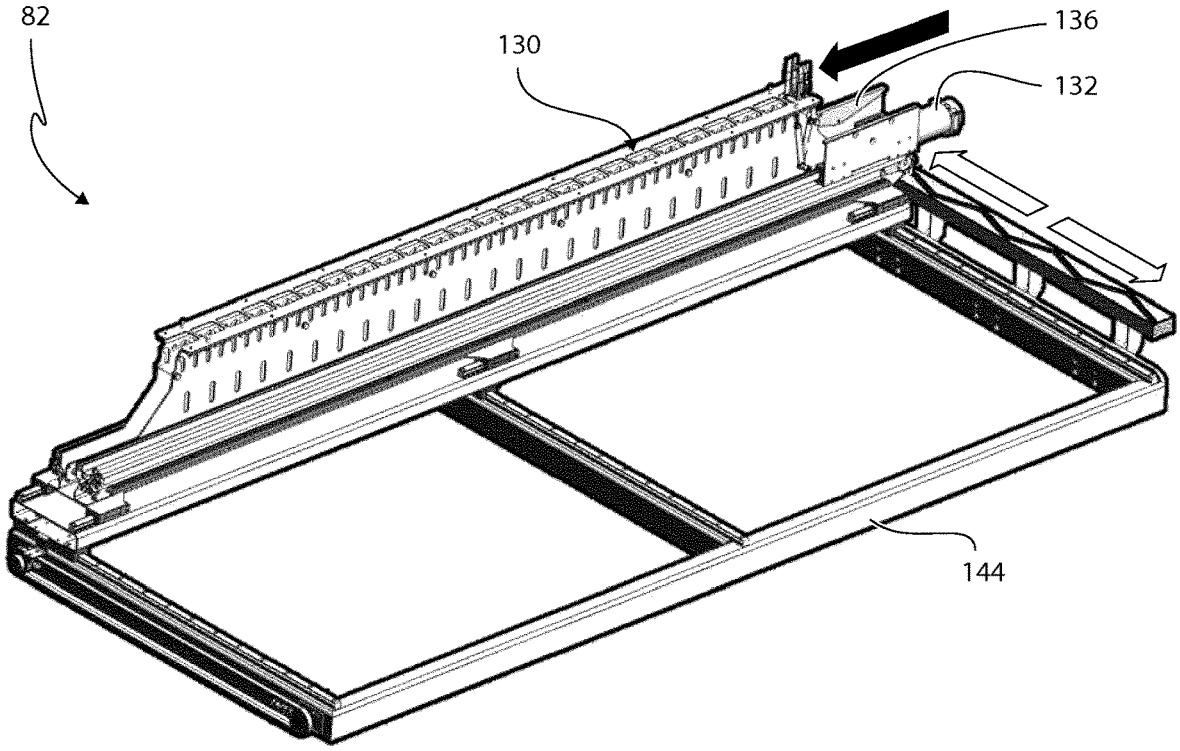
FIG. 48B shows a full perspective view of a release mechanism.

FIG. 48B shows a full perspective view of a release mechanism 82 including a frame 144 and preferably forming part of a release station. The holding unit (not shown) is placed on top of the release mechanism 82 and the release mechanism is movable in a transverse direction on the frame 144 as shown by the two oppositely pointing arrows in order to be able to release one row of pelt boards on the holding unit at a time. The pelts are released by moving the actuator 136 along the longitudinal direction as shown by the filled arrow.

Figure 48C:
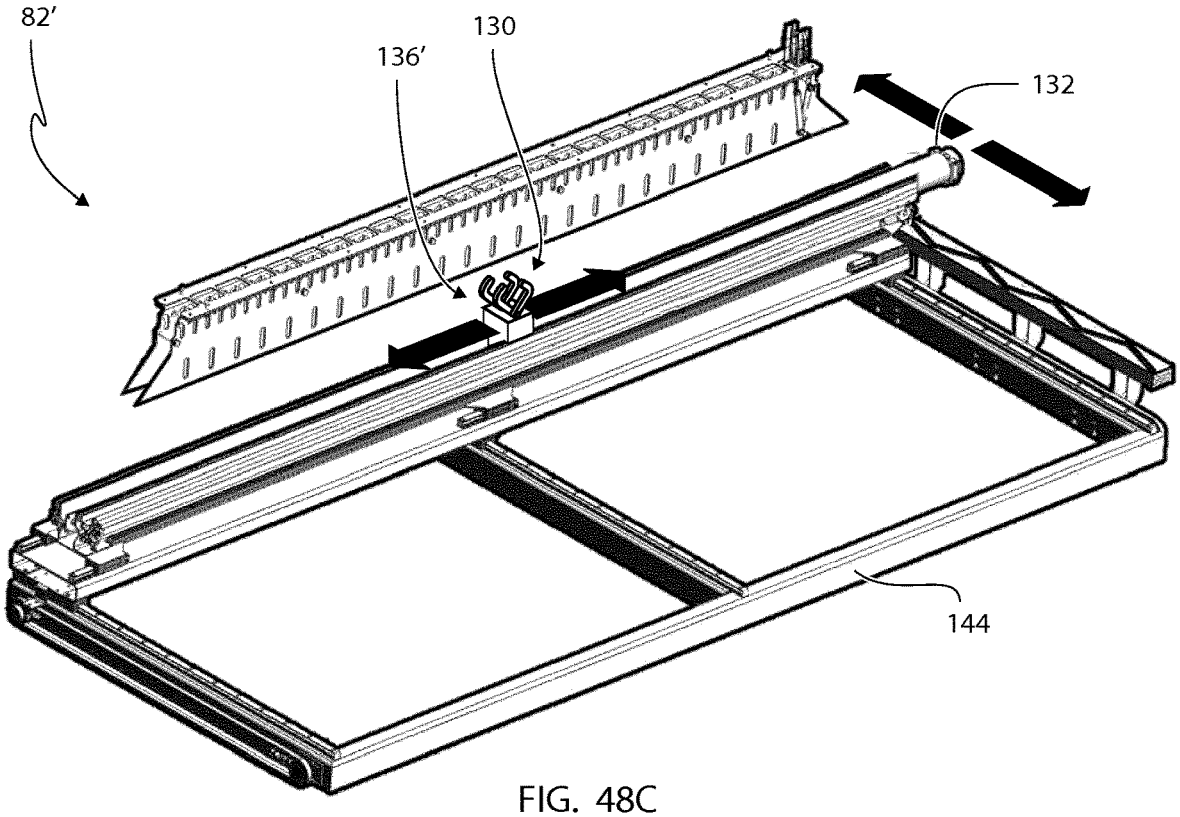
FIG. 48C shows an alternative embodiment of a release mechanism.

FIG. 48C shows an alternative embodiment of a release mechanism 82', which is also movable in a transverse direction on a frame 144. The release mechanism 82' comprises an alternative actuator 136', which is movable in the longitudinal direction as shown by the filled arrows and comprises an alternative gripper 130'. The alternative release mechanism 82' operates similar to a 2D robot and is capable of moving the alternative gripper 130' to any location on the 2D plane below the holding unit, engage a connecting element (not shown) of a pelt board (not shown), and cause the pelt board to collapse thereby allowing the dried pelt to be removed easily.

Figure 49A:
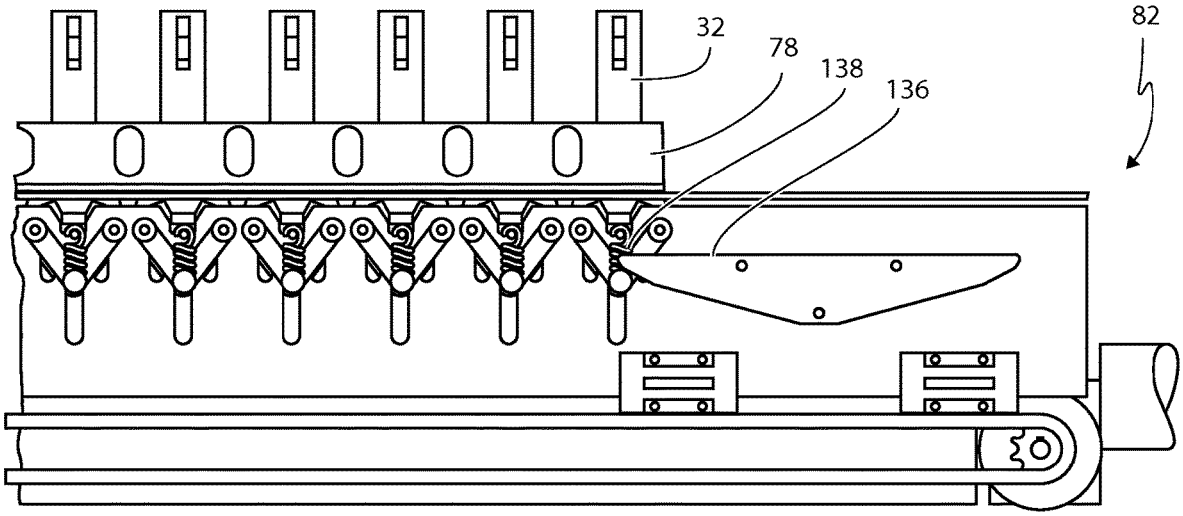
FIG. 49A shows a side view of the release mechanism.

FIG. 49A shows a side view of the release mechanism 82 according to the presently preferred embodiment. A holding unit 78 holding several connecting elements 32 including associated pelt boards are placed on the release mechanism 82. The release mechanism 82 comprise the actuator 136, which is driven by the drive 132 in order to sequentially release the pelts along one row of the release station/holding unit. The actuator 136 is driven along the tabs 134 as will be further explained below. The gripping member 130 is presently in the disengaged position, in which the connection element and the associated pelt board can be removed. A biasing spring 138 ensures that the disengaged position is the default position.

Figure 49B:
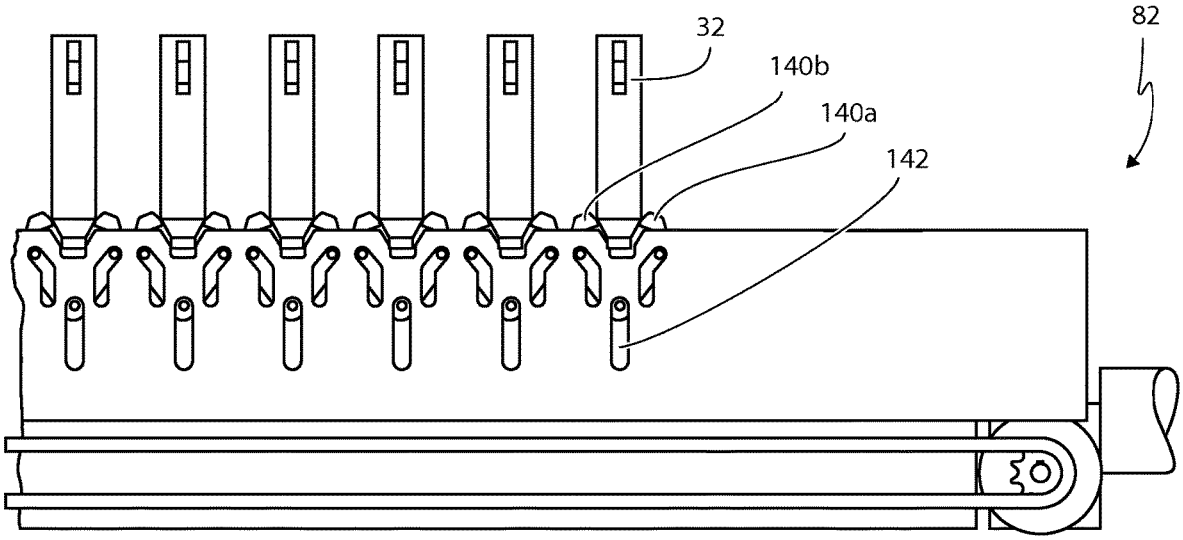
FIG. 49B shows a side view of the release mechanism.

FIG. 49B shows a side view of the release mechanism 82. Each gripping member 132 comprises two opposing jaws 140*a/b*, which are guided by a guide 142.

Figure 49C:
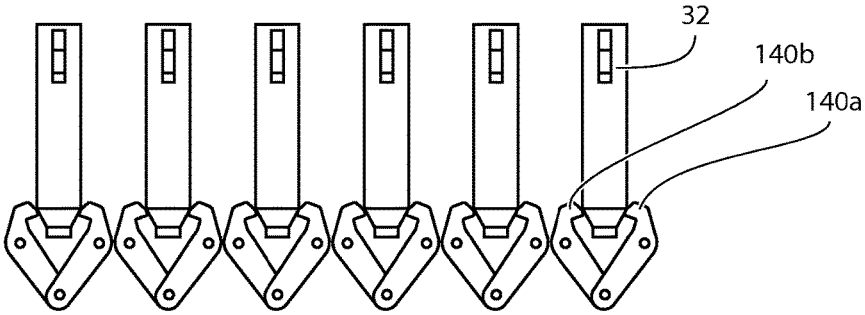
FIG. 49C shows a side view of the gripping member.

FIG. 49C shows a side view of the gripping member 132. It can be seen that the two opposing jaws 140*a/b* grip a dedicated part of the connecting element 32 of the pelt board.

Figure 50A:
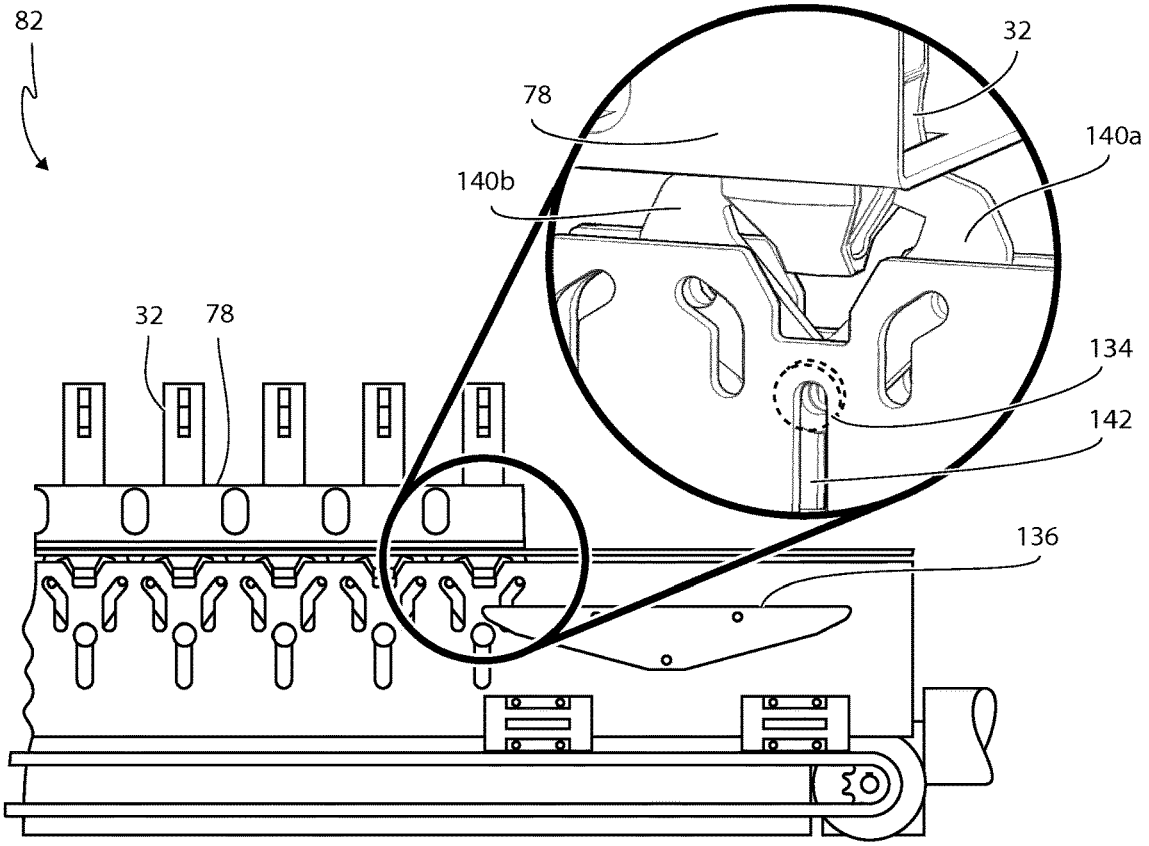
FIG. 50A shows a side view of the release mechanism.

FIG. 50A shows a side view of the release mechanism 82 when the gripping member 130 is still in the disengaged position, i.e. the jaws 140*a/b* are open allowing the connection element and the associated pelt board to be removed.

Figure 50B:
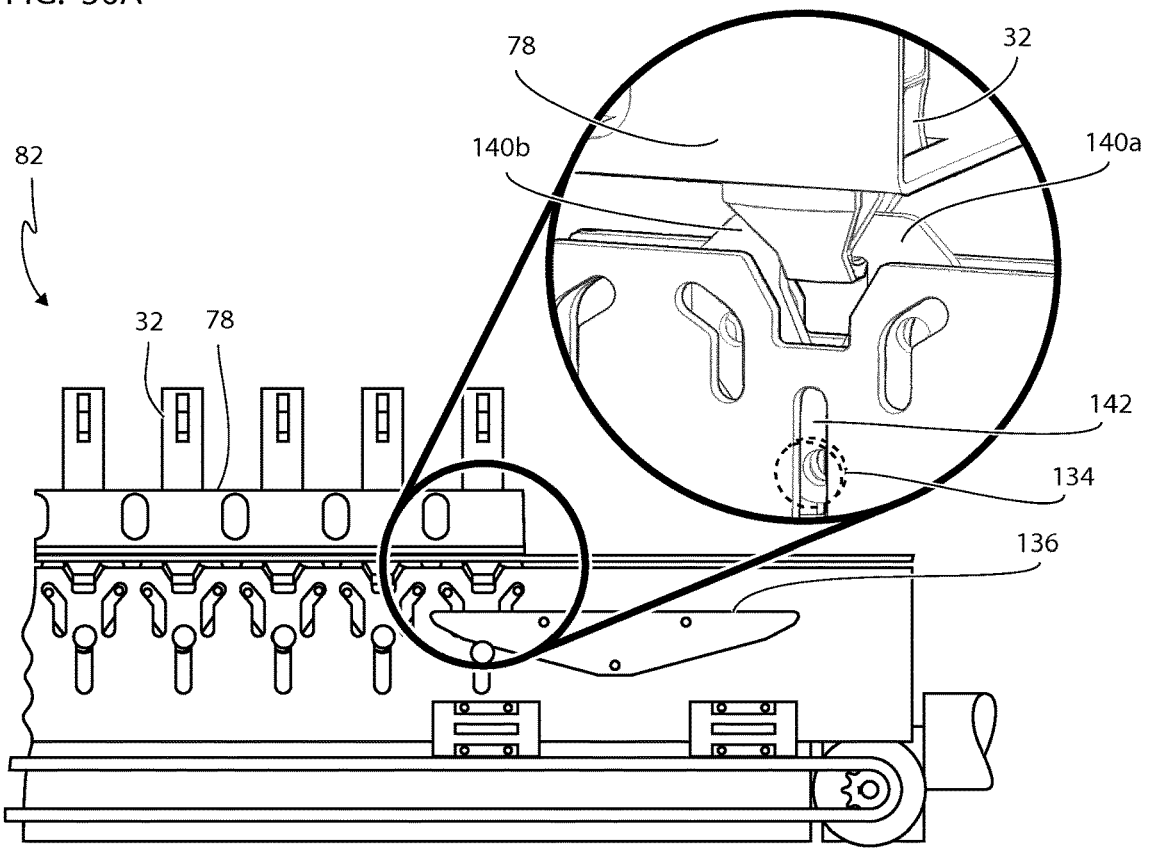
FIG. 50B shows a side view of the release mechanism.

FIG. 50B shows a side view of the release mechanism 82 when the gripping member 130 is in the engaged position. By moving the actuator 136 using the drive 132 towards the tab 134 of the gripping member 130, the shape of the actuator 136 causes the tab 134 to be moved downwards, causing the jaws 140*a/b* which are guided by the guide 142 to move together to a closed position in which the connection element 32 is engaged at a location which is useful or dedicated for pulling.

Figure 50C:
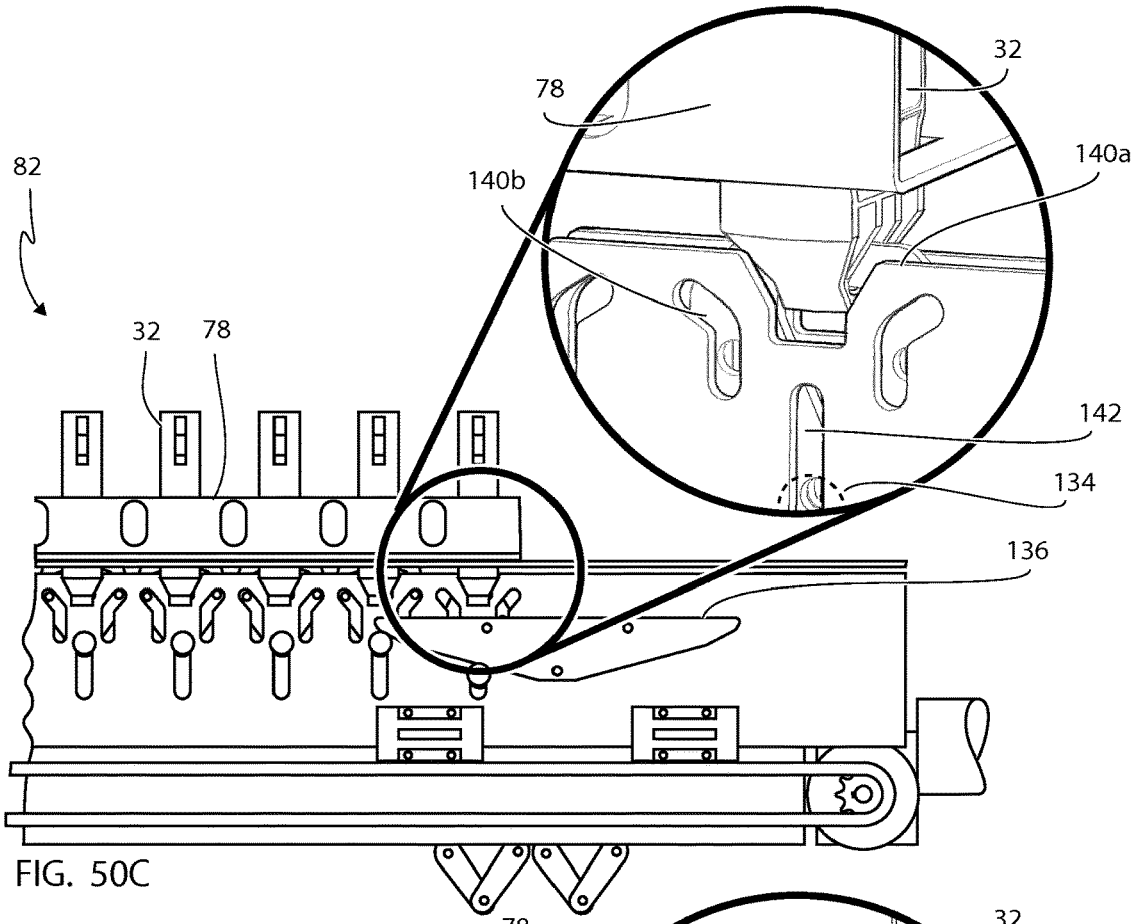
FIG. 50C shows a side view of the release mechanism.

FIG. 50C shows a side view of the release mechanism 82 when the gripping member 132 is moving towards the released position, the shape of the actuator 136 causes the tab 134 to be moved downwards, causing the jaws 140*a/b* which are guided by the guide 142 to move downwards thereby pulling the connection element 32 to which the gripping element is engaged. The associated pelt board is kept stationary by the holding unit and the pelt board is thereby caused to collapse or contract.

Figure 50D:
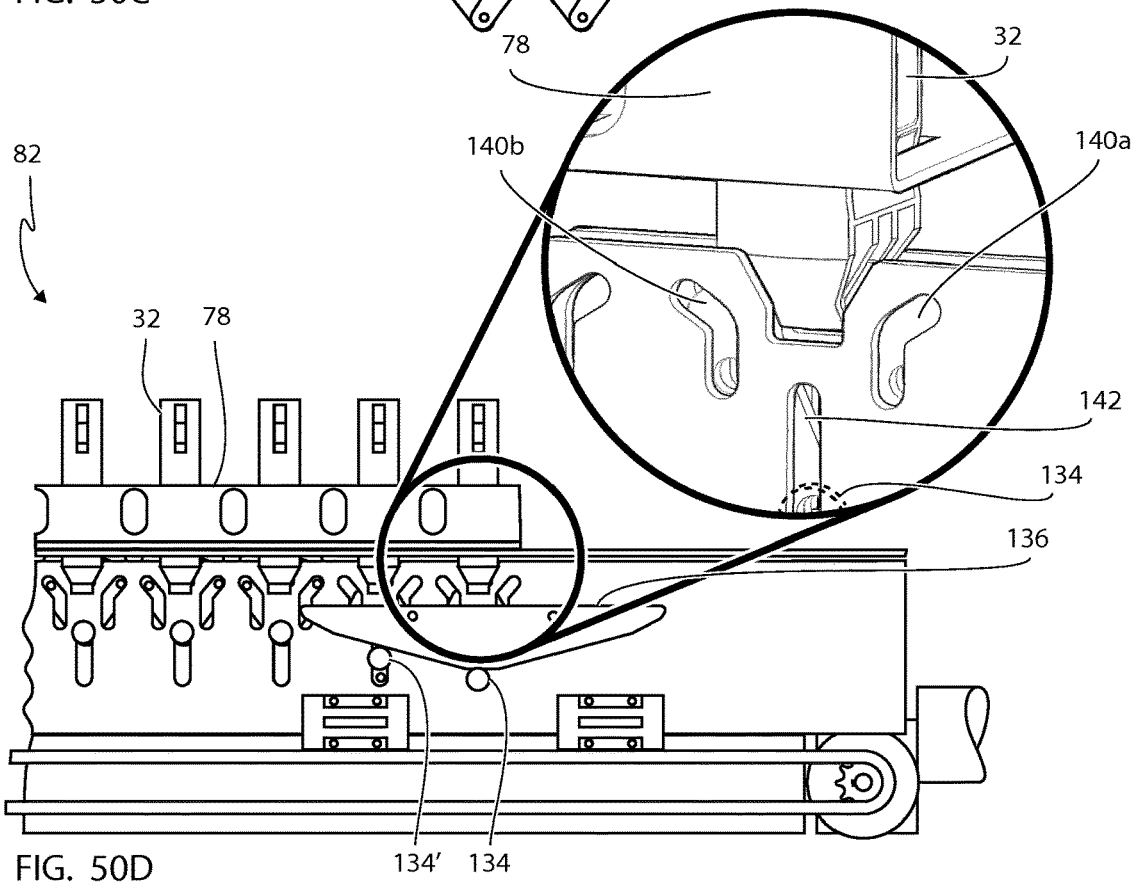
FIG. 50D shows a side view of the release mechanism.

FIG. 50D shows a side view of the release mechanism 82 when the gripping member 132 is in the released position, the shape of the actuator 136 causes the tab 134 to be further moved downwards to an end position, in which the pelt board is collapsed or contracted. At the same time, the subsequent tab 134' is caused to move downward by the actuator 136, thereby causing the subsequent gripping member 132' to engage the subsequent connecting element 32. Thereafter, when the actuator moves yet further, the first gripping member 132 is caused to return to the default position by the spring bias, whereas the subsequent gripping member 132 releases the subsequent pelt.

Figure 51A:
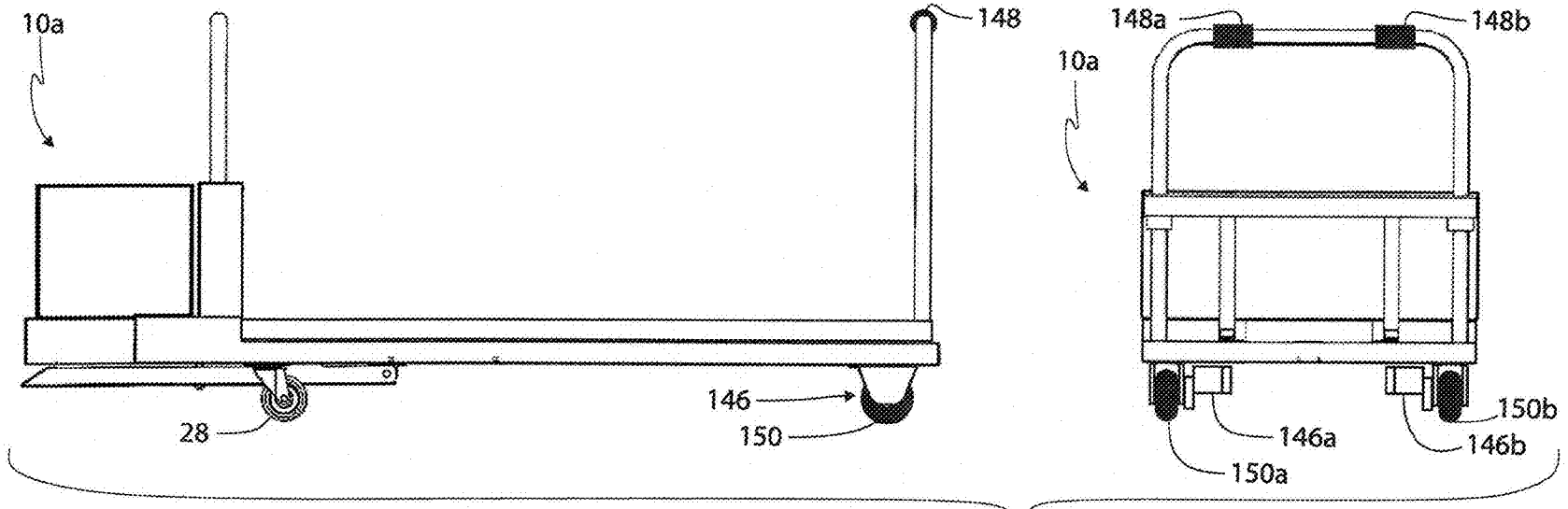
FIG. 51A-D show various motorized drying units similar to the previous drying units.

FIG. 51A shows a motorized drying unit 10*a* similar to the previous drying units, however, including motors 146*a* 146*b* powering a respective rear drive wheel 150*a* 150*b*. The motors are controlled by controls 148*a* 148*b* located on the handle 26 such that the motorized drying unit 10*a* may be moved forward by driving both motors 146*a* 146*b* in forward direction, backward by driving both motors 146*a* 146*b* in backward direction, and turning by driving the motors 146*a* 146*b* in different directions. The front wheels 28 are swivel wheels.

Figure 51B:
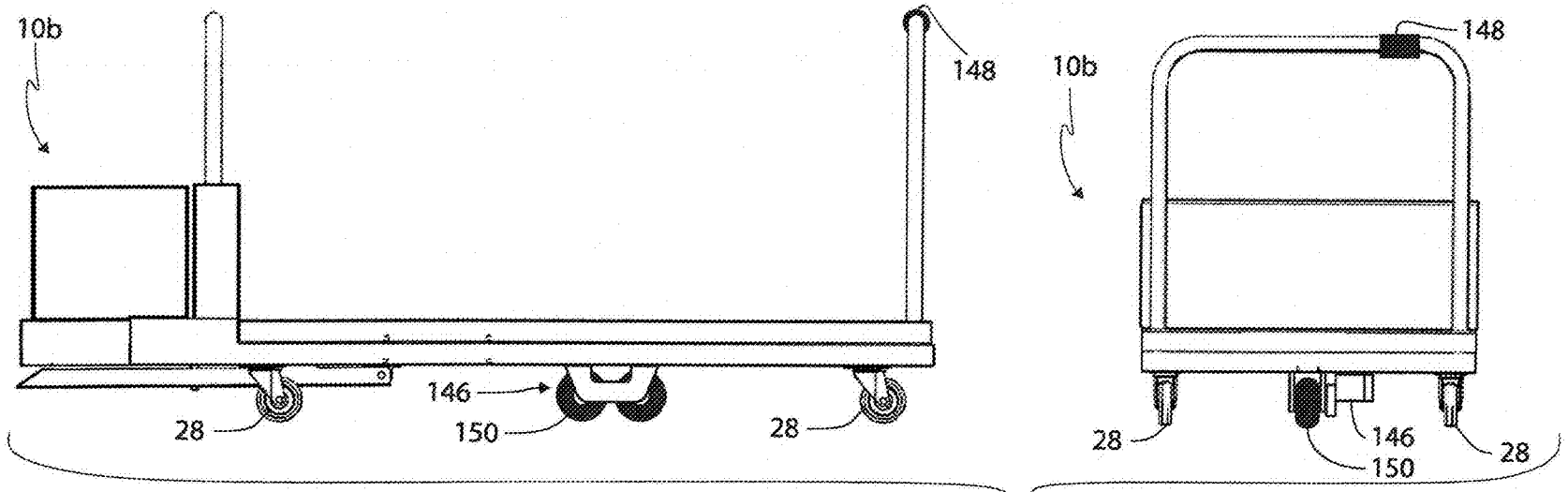

FIG. 51B shows an alternate motorized drying unit 10*b* similar to the previous drying units, however, including a single motor 146 powering a central drive wheel 150, which may be a single wheel or as in the present embodiment two wheels in an inline configuration. The motor 146 is controlled by a single control 148 such that the motorized drying unit 10*b* may be moved forward by driving the motor 146 in forward direction and backward by driving the motors 146 in backward direction. Turning may be done manually by simply operating the handle 26 in the desired direction and turn the motorized drying unit 10*b* about the central drive wheel 148. The other wheels 28 are swivel wheels.

Figure 51C:
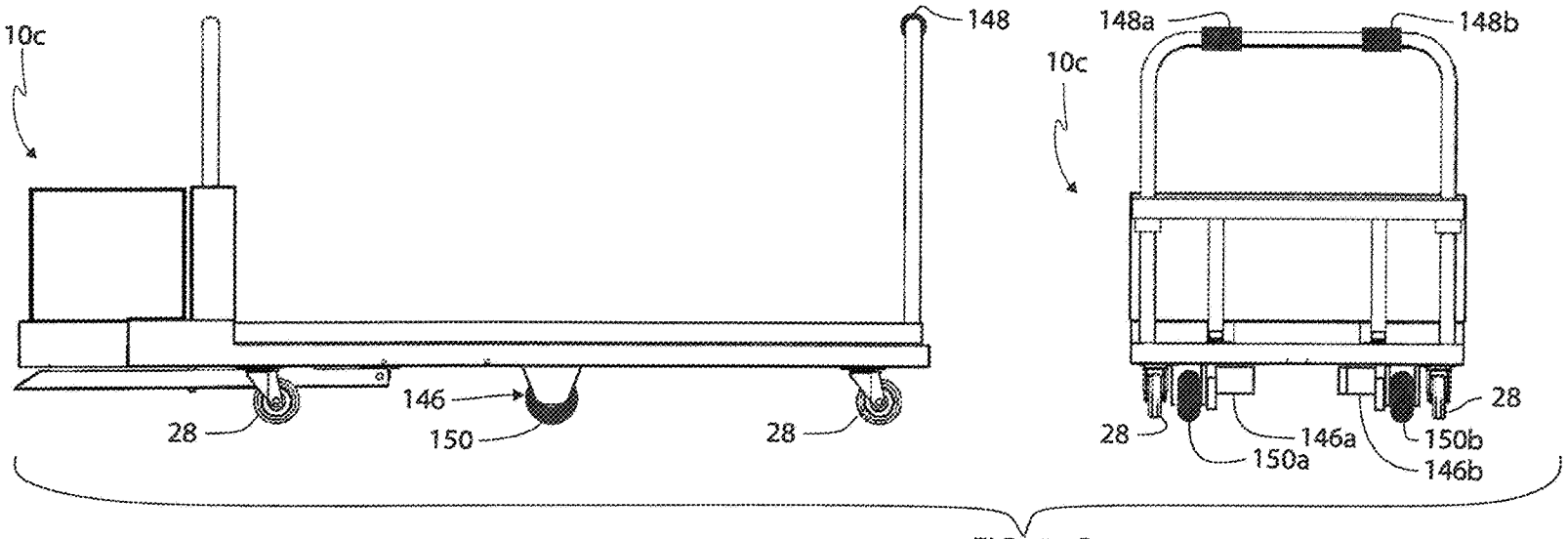

FIG. 51C shows a motorized drying unit 10*c* similar to the previous drying units, however, including motors 146*a* 146*b* powering a respective middle drive wheel 150*a* 150*b*. The motors are controlled by controls 148*a* 148*b* located on the handle 26 such that the motorized drying unit 10*a* may be moved forward by driving both motors 146*a* 146*b* in forward direction, backward by driving both motors 146*a* 146*b* in backward direction, and turning by driving the motors 146*a* 146*b* in different directions. The front and rear wheels 28 are swivel wheels.

Figure 51D:
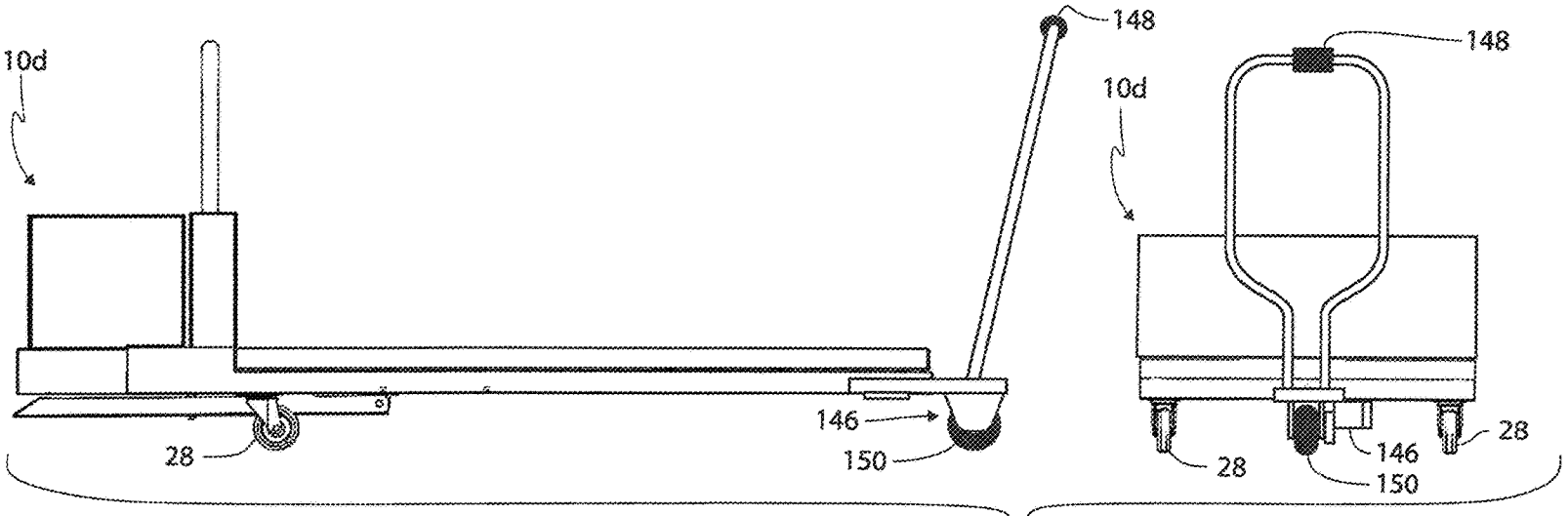

FIG. 51D shows an alternate motorized drying unit 10*b* similar to the previous drying units, however, including a single motor 146 powering a rear drive wheel 150, which may be a single wheel as in the present embodiment or a pair or wheels in a close parallel configuration. The motor 146 is controlled by a single control 148 such that the motorized drying unit 10*b* may be moved forward by driving the motor 146 in forward direction and backward by driving the motors 146 in backward direction. Turning may be done manually by simply operating the handle 26 in the desired direction and turn the motorized drying unit 10*b* about the rear drive wheel 148. The front wheels 28 are swivel wheels.

Figure 52:
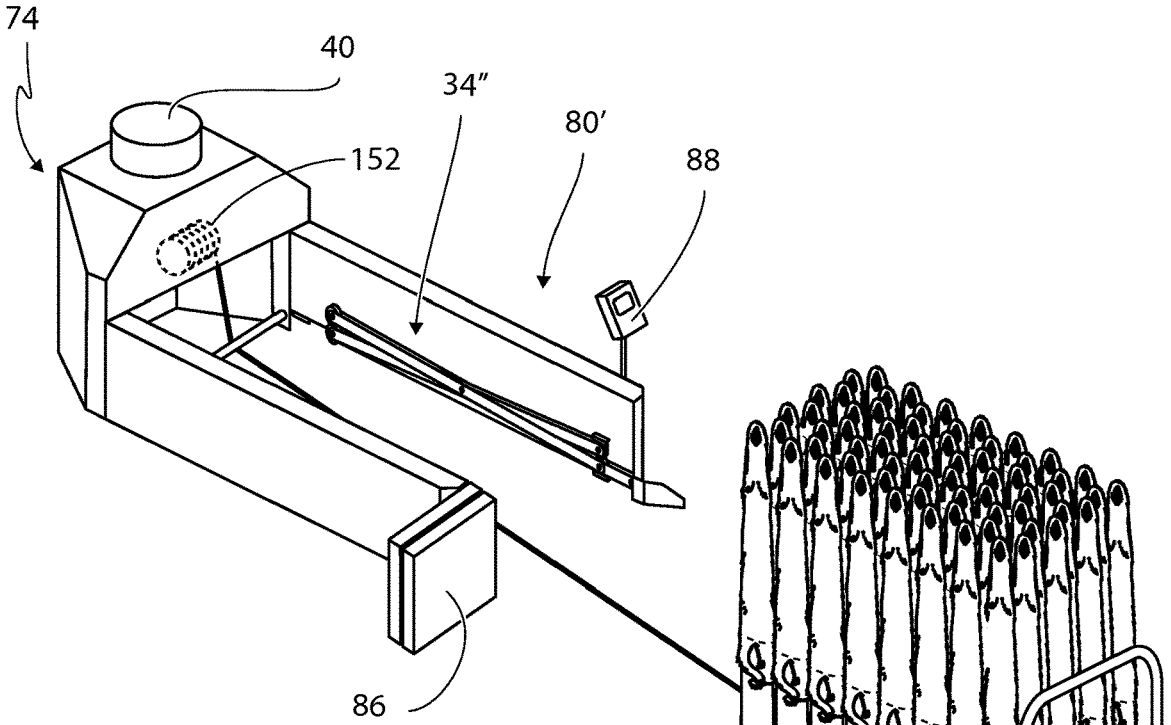
FIG. 52 shows a pelt processing system including a winch.

FIG. 52 shows a pelt processing system 74 including a winch 152. The winch 152 connects the holding unit 12 and the drying unit 10 by a wire such that the holding unit 78 may be pulled into the drying unit.

Figure 53A:
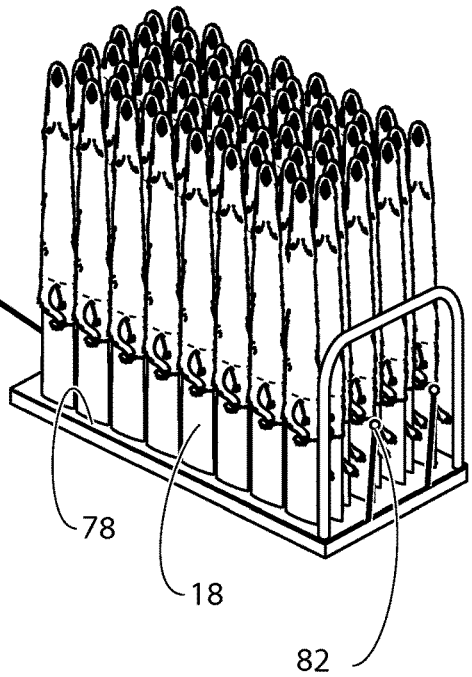
FIG. 53A shows a holding unit having a towing bar and a mover.
Figure 53A:
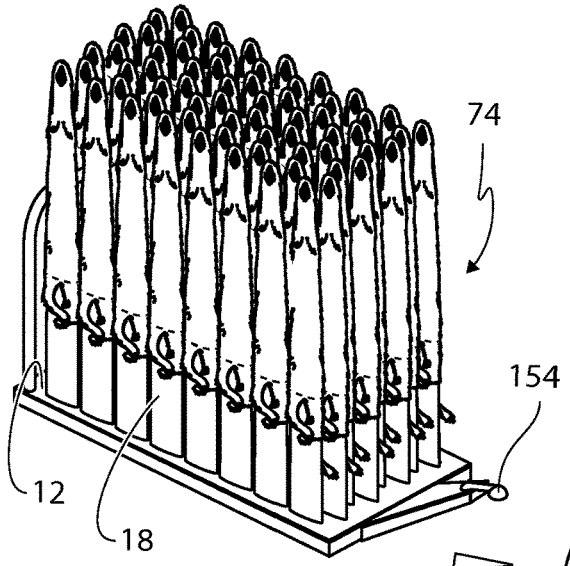

FIG. 53A shows a holding unit 78 having a towing bar 154 and a mover 156.

Figure 53B:
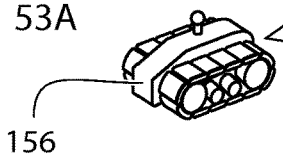
FIG. 53B shows a holding unit having a towing bar.
Figure 53B:
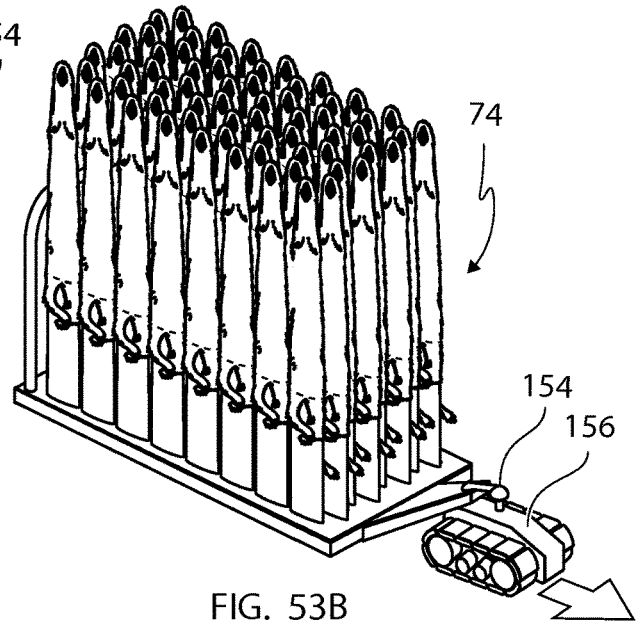

FIG. 53B shows a holding unit 78 having a towing bar 154 connected to the mover 156. The mover 156 is remote controlled and is used for pulling the holding unit 78. The mover may even be autonomous allowing the holding unit to be moved between stations without user involvement.

The above drying system is highly modular and it is understood that the features of the embodiments presented above are exchangeable. The modularity allows for a very efficient use of the equipment and allows a pelting plant to operate very economical and effective.

The above described embodiments describe specific realizations according to the present invention showing specific features, however, it is apparent to the skilful individual that the above described embodiments may be modified, combined or aggregated to form numerous further embodiments.

For instance, the air blower may optionally include a heater or be replaced by a bottle of compressed gas.

| Reference numerals with reference to the figures |
|---|
| 10. Drying unit |
| 12. Top plate |
| 14. Sidewall |
| 16. Aperture |
| 18. Pelt board |
| 20. Top of pelt board |
| 22. Bottom of pelt board |
| 24. On board blower |
| 26. Handle |
| 28. Wheels |
| 30. Inner space |
| 32. Connecting element |
| 34. Lifting device |
| 35. Roll-up mechanism |
| 36. Bottom plate |
| 37. Cylinder |
| 38. Gas inlet |
| 40. External blower |
| 42. Outside unit |
| 44. Feet |
| 46. Floor jack |
| 48. Hose |
| 50. Guiding plate |
| 52. Vent |
| 54. Openings |
| 56. Fan |
| 58. Bar |
| 60. Roller |
| 62. Axle |
| 64. Guide element |
| 66. Adapter |
| 68. Clip mechanism |
| 70. Top portion |
| 72. Check valve |
| 74. Pelt processing system |
| 76. Tanning unit |
| 78. Holding unit |
| 80. Blowing unit |
| 82. Release mechanism |
| 84. Compressor |
| 86. Port |
| 88. Controller |
| 90. Entrainment openings |
| 92. Air passage |
| 94. Air supply part |
| 96. Main flow |
| 98. Central inlet |
| 100. Auxiliary flow |
| 102. Circumferential inlet |
| 104. Flow distribution cone |
| 106. Prior art curve |
| 108. New curve |
| 110. Auxiliary blower |
| 112. Casing |
| 114. Interface |
| 116. Dome |
| 118. Fan/Blower |
| 120. Air conditioning unit |
| 122. Tube |
| 124. Fixation |
| 126. Hole |
| 128. Pin |
| 130. Gripper |
| 132. Drive |
| 134. Control tabs |
| 136. Actuator |
| 138. Spring |
| 140. Jaw |
| 142. Guide |
| 144. Frame |
| 146. Motor |
| 148. Control |
| 150. Drive wheel(s) |
| 152. Winch |

-continued

| Reference numerals with reference to the figures |
|---|
| 154. Towing bar |
| 156. Mover |

Points Describing Some Further Aspects of the Present Invention:

1. A drying unit for accommodating a plurality of elongated hollow pelt boards, each of said pelt boards having a pelt board top, a pelt board bottom and a connecting element at said pelt board bottom, said drying unit defining:
   - a top plate having a number of apertures, each of said apertures being adapted for accommodating said connecting element,
   - a bottom plate being parallel to and spaced apart from said top plate,
   - a gas inlet for receiving a stream of gas, preferably air, and a sidewall interconnecting said top plate and said bottom plate in a fluid-tight manner for establishing an inner space between said top plate, said bottom plate, said gas inlet and said sidewall, said drying unit comprising a flow distributor disposed within said inner space between said gas inlet and said top plate.

2. The drying unit according to point 1, wherein said flow distributor comprises one or more flexible and gas permeable hoses, or alternatively said flow distributor comprises a rigid or semi rigid plate including one or more flexible vent members, or alternatively said flow distributor comprises rigid or semi rigid flow guiding elements, or alternatively said flow distributor comprises walls within said inner space defining enclosed cells between said gas inlet and said top plate, each of said cells preferably comprising a fan.

3. A drying unit for accommodating a plurality of elongated hollow pelt boards, each of said pelt boards having a pelt board top, a pelt board bottom and a connecting element at said pelt board bottom, said drying unit defining:
   - an top plate having a number of apertures, each of said apertures being adapted for accommodating said connecting element,
   - a bottom plate being parallel to and spaced apart from said top plate,
   - a gas inlet for receiving a stream of gas, preferably air, and
   - a sidewall interconnecting said top plate and said bottom plate in a fluid-tight manner for establishing an inner space between said top plate, said bottom plate, said gas inlet and said sidewall, said sidewall having an extent such that said top plate and said bottom plate being capable of defining a distance between themselves of at least 200 mm, such as between 200 mm and 2500 mm, preferably between 250 mm and 1000 mm, more preferably between 300 mm and 800 mm, most preferably between 400 mm and 600 mm.

4. A drying unit according to any of the preceding points, wherein said sidewall is flexible and wherein said drying unit further comprising a lifting device interconnecting said bottom plate and said top plate, said lifting device being capable of moving said top plate and said bottom plate relative to one another between a first position in which said top plate and said bottom plate being adjacent each other, and a second position in which said top plate and said bottom plate being distant each other, said lifting device optionally being lockable by a locking device.

5. The drying unit according to point 4, wherein said flexible sidewall comprise a first sidewall element being connected to said top plate and a second sidewall element connected to said bottom element, said first sidewall element and said second sidewall element being fluid tightly interconnected in a telescopic configuration and/or said flexible sidewall comprise an elastic and/or pleated and/or rolled up element.

6. The drying unit according to any of the points 4-5, wherein said lifting device being located within said inner space and/or said lifting device comprising a guiding element extending from said bottom plate and through said top plate, and/or said lifting device constitutes a hydraulic or pneumatic lifting device or a mechanical lifting device, such as a pantograph having a mechanical advantage between 1 and 10, preferably between 2 and 5 and preferably driven by an electrical motor, hydraulic cylinder or alternatively including a gear mechanism for being manually operated by a user.

7. The drying unit according to any of the point 1-6, wherein said gas inlet is connected to an on board air blower capable of transporting air from outside said drying unit into said inner space and out through said apertures, said air blower preferably including a dehumidifier, and/or gas inlet being connectable to an external air blower capable of communicating with said gas inlet, said external air blower being capable of transporting air from outside said drying unit into said inner space and out through said apertures, said external air blower preferably being capable of transporting air from an outdoor location into said inner space and out through said apertures, said air blower preferably including a dehumidifier.

8. The drying unit according to any of the points 1-7, wherein said gas inlet being located in said sidewall, preferably adjacent said bottom plate and/or said bottom plate being fitted with wheels and/or wherein said bottom plate being fitted with feet such that said drying unit may be moved by the use of a floor conveyor, such as a forklift, jack lift or pallet jack.

9. The drying unit according to any of the preceding points, wherein said drying unit comprises a plurality of gas inlets disposed at said bottom plate and/or said top plate and/or said side plate.

10. The drying unit according to any of the preceding points, wherein said apertures include a nozzle for conditioning said stream of air, and/or said apertures include an adapter made of polymeric material and adapted for interconnecting with said connecting element of said pelt board and/or a nozzle.

11. A method of drying a pelt by providing a drying unit, said drying unit defining:

an top plate having a number of apertures, a bottom plate being parallel to and spaced apart from said top plate, a gas inlet for receiving a stream of gas, preferably air, and a sidewall interconnecting said top plate and said bottom plate in a fluid-tight manner for establishing an inner space between said top plate, said bottom plate, said gas inlet and said sidewall, said sidewall having an extent such that said top plate and said bottom plate being capable of defining a distance between themselves of at least 200 mm, such as between 200 mm and 2500 mm, preferably between 250 mm and 1000 mm, more preferably between 300 mm and 800 mm, most preferably between 400 mm and 600 mm, and said method further comprising the steps of:

accommodating said pelt on an elongated hollow pelt board having a pelt board top, a pelt board bottom and a connecting element at said pelt board bottom, accommodating said connecting element of said pelt board in one of said apertures of said top plate, and introducing gas, preferably air, into said inner space for causing said gas to flow into said pelt board via said one aperture.

12. A method of drying a pelt by providing a drying unit, said drying unit defining:

an top plate having a number of apertures, a bottom plate being parallel to and spaced apart from said top plate, a gas inlet for receiving a stream of gas, preferably air, and a flexible sidewall interconnecting said top plate and said bottom plate in a fluid-tight manner for establishing an inner space between said top plate, said bottom plate, said gas inlet and said flexible sidewall, said sidewall having an extent such that said top plate and said bottom plate being capable of defining a distance between themselves of at least 200 mm, such as between 200 mm and 2500 mm, preferably between 250 mm and 1000 mm, more preferably between 300 mm and 800 mm, most preferably between 400 mm and 600 mm, and a lifting device interconnecting said bottom plate and said top plate, said lifting device being capable of moving said top plate and said bottom plate relative to one another, said method further comprising the steps of:

accommodating said pelt on an elongated hollow pelt board having a pelt board top, a pelt board bottom and a connecting element at said pelt board bottom, moving said lifting device to a first position in which said top plate and said bottom plate are adjacent each other, accommodating said connecting element of said pelt board in one of said apertures of said top plate, moving said lifting device to a second position in which said top plate and said bottom plate are distant each other, and introducing gas, preferably air, into said inner space for causing said gas to flow into said pelt board via said one aperture.

13. A method of drying a pelt by providing a drying unit, said drying unit defining:

a top plate having a number of apertures, a bottom plate being parallel to and spaced apart from said top plate, a gas inlet for receiving a stream of gas, preferably air, and a sidewall interconnecting said top plate and said bottom plate in a fluid-tight manner for establishing an inner space between said top plate, said bottom plate, said gas inlet and said sidewall, said drying unit comprising a flow distributor disposed within said inner space between said gas inlet and said top plate, said method further comprising the steps of:

accommodating said pelt on an elongated hollow pelt board having a pelt board top, a pelt board bottom and a connecting element at said pelt board bottom, accommodating said connecting element of said pelt board in one of said apertures of said top plate, and introducing gas, preferably air, into said inner space for causing said gas to flow into said pelt board via said one aperture.

14. A pelt processing system comprising:

a tanning unit for tanning a pelt which has been fixated to an expanded pelt board having a pelt board top, a pelt board bottom and a connecting element at said pelt board bottom, said pelt board further being operable between an expanded state and a non-expanded state by moving said connecting element relative to said pelt board bottom, a holding unit for accommodating a plurality of said elongated hollow pelt boards, said holding unit defining a top plate having a number of apertures, each of said apertures being adapted for accommodating said connecting element, a blowing unit compatible with said holding unit and comprising a bottom plate being parallel to and spaced apart from said top plate, a gas inlet for receiving a stream of gas, preferably air, and a sidewall for interconnecting with said top plate in a fluid-tight manner for establishing an inner space between said top plate, said bottom plate, said gas inlet and said sidewall, and a release mechanism for causing said pelt boards on said holding unit to assume said non-expanded state.

15. A method of drying a pelt by providing a drying system, said drying system comprising:

a tanning unit for tanning a pelt which has been fixated to an expanded pelt board having a pelt board top, a pelt board bottom and a connecting element at said pelt board bottom, a holding unit defining a top plate having a number of apertures, each of said apertures being adapted for accommodating said connecting element, a blowing unit compatible with said holding unit and comprising a bottom plate being parallel to and spaced apart from said top plate, a gas inlet for receiving a stream of gas, preferably air, and a sidewall interconnecting said top plate and said bottom plate in a fluid-tight manner for establishing an inner space between said top plate, said bottom plate, said gas inlet and said sidewall, and a release mechanism for causing said pelt board on said holding unit to assume said non-expanded state.

said method further comprising the steps of:

providing a pelt board, said pelt board having a pelt board top, a pelt board bottom and a connecting element at said pelt board bottom, said pelt board further being adjustable between an expanded state and a non-expanded state by operating said connecting element, accommodating said pelt on said elongated hollow pelt board being in said expanded state, accommodating said connecting element of said pelt board in one of said apertures of said top plate, interconnecting said holding unit and said blowing unit by optionally lifting said holding unit, introducing gas, preferably air, into said inner space for causing said gas to flow into said pelt board via said one aperture, disconnecting said holding unit and said blowing unit, and operating said release mechanism thereby causing said pelt board to assume said non-expanded state.

16. A drying system for accommodating a plurality of elongated hollow pelt boards, each of said pelt boards having a pelt board top, a pelt board bottom for receiving drying air and a connecting element at said pelt board bottom, said drying system comprising a drying unit, said drying unit defining a top plate having a number of primary apertures, each of said primary apertures accommodating an adapter, each of said adapters defining a secondary aperture, said secondary aperture being capable of accommodating said connecting element of one of said pelt boards and allowing passage of drying air from said drying system to said pelt board, said drying unit defining entrainment openings in said adapter and/or between said top plate and said adapter, said entrainment openings being located adjacent each of said secondary apertures allowing a non-obstructed passage of drying air from said drying unit to said pelt board when said connecting element is accommodated in said secondary aperture of said adapter.

17. The drying system according to point 16, wherein said secondary aperture is associated with more than one entrainment opening, such as 2-20 entrainment openings, preferably 2, 3, 4, 5, 6, 7 or 8 entrainment openings.

18. The drying system according to point 17, wherein each of said secondary apertures are surrounded by entrainment openings.

19. The drying system according to any of the points 16-18, wherein the distance between any entrainment opening and an adjacent secondary aperture is less than 10 mm, such as 1-5 millimeters.

20. The drying system according to any of the points 16-18, wherein said top plate comprise an primary top plate and a secondary top plate, said adapter being fixated between said primary top plate and said secondary top plate.

21. The drying system according to any of the points 16-19, wherein said secondary top plate includes additional openings for supplying said aperture and/or said entrainment openings.

22. The drying system according to any of the points 16-20, wherein said adapter is made of a polymeric material, such as plastic.

23. The drying system according to any of the points 16-22, wherein said drying unit further including a bottom plate being parallel to and spaced apart from said top plate, a gas inlet for receiving a stream of gas, preferably air, and a sidewall interconnecting said top plate and said bottom plate in a fluid-tight manner for establishing an inner space between said top plate, said bottom plate, said gas inlet and said sidewall.

24. The drying system according to point 23, further comprising any of the features of points 4-10.

25. The drying system according to any of the points 16-24, wherein further flow channels are provided in the connecting element.

26. The drying system according to any of the points 16-25, wherein further flow channels are provided in the adapter.

27. A method of drying a pelt by providing a drying unit, said drying unit defining a top plate having a number of primary apertures, each of said primary apertures accommodating an adapter defining a secondary aperture, said drying unit define entrainment openings adjacent each of said secondary apertures in said adapter, and/or, between said top plate and said adapter, said method further comprising the steps of:

accommodating said pelt on an elongated hollow pelt board having a pelt board top, a pelt board bottom for receiving drying air and a connecting element at said pelt board bottom, accommodating said connecting element of said pelt board in one of said secondary apertures of said top plate, and introducing gas, preferably air, into said pelt board bottom via said one secondary aperture partially obstructed by said connecting element and unobstructed via said adjacent entrainment openings.

28. A drying unit for accommodating a plurality of elongated hollow pelt boards, each of said pelt boards having a pelt board top, a pelt board bottom and a connecting element at said pelt board bottom, said drying unit defining:

an top plate having a number of apertures, each of said apertures being adapted for accommodating said connecting element, a bottom plate being parallel to and spaced apart from said top plate, a gas inlet for receiving a stream of gas, preferably air, and a sidewall interconnecting said top plate and said bottom plate in a fluid-tight manner for establishing an inner space between said top plate, said bottom plate, said gas inlet and said sidewall, said inner space defining a volume of at least 10 litres per aperture, preferably between 20 and 200 litres, more preferably between 50 and 100 litres.

29. The drying unit according to point 28, further comprising any of the features of points 4-10.

30. A method of drying a pelt by providing a drying unit, said drying unit defining:

a top plate having a number of apertures, a bottom plate being parallel to and spaced apart from said top plate, a gas inlet for receiving a stream of gas, preferably air, and a flexible sidewall interconnecting said top plate and said bottom plate in a fluid-tight manner for establishing an inner space between said top plate, said bottom plate, said gas inlet and said flexible sidewall, said inner space defining a volume of at least 10 litres per aperture, preferably between 20 and 200 litres, more preferably between 50 and 100 litres, and a lifting device interconnecting said bottom plate and said top plate, said lifting device being capable of moving said top plate and said bottom plate relative to one another, said method further comprising the steps of:

accommodating said pelt on an elongated hollow pelt board having a pelt board top, a pelt board bottom and a connecting element at said pelt board bottom, moving said lifting device to a first position in which said top plate and said bottom plate are adjacent each other, accommodating said connecting element of said pelt board in one of said apertures of said top plate, moving said lifting device to a second position in which said top plate and said bottom plate are distant each other, and introducing gas, preferably air, into said inner space for causing said gas to flow into said pelt board via said one aperture.

31. It is further contemplated that any of the above mentioned gas inlets may have a central inflow, a circumferential inflow and a cone adjacent said central inflow for directing inflowing gas from said central inflow past said circumferential inflow thereby generating an entrainment effect at said circumferential inflow, preferably, said central inflow and/or said circumferential inflow comprise one or more valves, more preferably said drying unit comprise sensors for controlling said valves.

The invention claimed is:

1. A pelt processing system comprising:

a plurality of expandable pelt boards, each of the pelt boards having a pelt board top, a pelt board bottom and a connecting element at the pelt board bottom, each of the pelt boards being operable between an expanded state and a non-expanded state by moving the connecting element relative to the pelt board bottom;

a holding unit configured for accommodating the plurality of pelt boards, the holding unit defining a top plate having a number of apertures, each of the apertures being configured for accommodating one of the connecting elements;

a blowing unit operatively connected to the holding unit and comprising a bottom plate parallel to and spaced apart from the top plate, a gas inlet configured for receiving a stream of gas, and a sidewall interconnecting the top plate and the bottom plate in a fluid-tight manner for establishing an inner space between the top plate, the bottom plate, the gas inlet, and the sidewall; and a release mechanism operable for causing the pelt boards on the holding unit to assume the non-expanded state.

2. The pelt processing system of claim 1, wherein the release mechanism forms part of one of the blowing unit and the holding unit.

3. The pelt processing system of claim 1, further comprising a pelt release station comprising the release mechanism, wherein the pelt release station is configured to accommodate the holding unit.

4. The pelt processing system of claim 1, wherein the release mechanism comprises a gripping member configured to engage the connecting elements when accommodated in one of the apertures of the holding unit and to move the connecting elements relative to the pelt board bottoms of each of the pelt boards.

5. The pelt processing system of claim 4, wherein the gripping member is biased to a non-engaged position in which the gripping member is located adjacent the holding unit and is configured to receive the connecting elements, the release mechanism further comprising an actuator operable for moving the gripping member to an engaged position engaging the connecting elements, and subsequently to a released position in which the connecting elements have moved relative to the pelt board bottoms, and the pelt boards have assumed a non-expanded state.

6. The pelt processing system of claim 5, wherein the actuator is operable to move the gripping member away from the holding unit.

7. The pelt processing system of claim 5, wherein the release mechanism comprises a multitude of gripping members, and wherein the actuator is movable between the gripping members for moving the gripping members in sequence.

8. The pelt processing system of claim 7, wherein the release mechanism is elongated, and wherein the multitude of gripping members corresponds to a row of apertures of the holding unit.

9. The pelt processing system of claim 8, wherein the release mechanism is mounted on a frame, wherein the holding unit comprises a plurality of rows of apertures, and wherein the release mechanism is movable between rows of apertures of the holding unit.

10. The pelt processing system of claim 5, wherein the actuator is driven by a drive selected from the group consisting at least one of a manual drive, an electrical drive, a hydraulic drive, and a pneumatic drive.

11. The pelt processing system of claim 5, wherein the gripping member comprises a first jaw and an opposite second jaw movable within respective guides between the non-engaged position in which the jaws are open, the engaged position in which said jaws are closed, and the release position in which the jaws are moved away from the holding unit.

12. The pelt processing system of claim 1, wherein at least one of the holding unit and the blowing unit comprises transportation means including wheels.

13. The pelt processing system of claim 12, wherein the wheels of transportation means are driven by a motor.

14. The pelt processing system of claim 12, wherein the transportation means includes a user interface mounted on one of the holding unit and the blowing unit.

15. The pelt processing system of claim 12, wherein the transportation means are controllable via wireless communication.

16. The pelt processing system of claim 1, wherein the gas inlet includes a central inflow, a circumferential inflow, and a cone adjacent the central inflow configured for directing inflowing gas from the central inflow past the circumferential inflow, thereby generating an entrainment effect at the circumferential inflow.

17. The pelt processing system of claim 16, wherein at least one of the central inflow and the circumferential inflow comprises one or more valves.

18. The pelt processing system of claim 17, wherein the blowing unit includes sensors configured for controlling the one or more valves.

19. A method of drying a pelt, comprising:

(a) providing a drying system, comprising:

(i) a pelt board having a pelt board top, a pelt board bottom, and a connecting element at the pelt board bottom configured for adjusting the pelt board between an expanded state and a non-expanded state;

(ii) a holding unit defining a top plate having a number of apertures, each of the apertures being configured for accommodating the connecting element;

(iii) a blowing unit operatively connected to the holding unit and comprising a bottom plate parallel to and spaced apart from the top plate, a gas inlet configured for receiving a stream of gas, and a sidewall interconnecting the top plate and the bottom plate in a fluid-tight manner for establishing an inner space between the top plate, the bottom plate, the gas inlet, and the sidewall; and (iv) a release mechanism operable for causing the pelt board on the holding unit to assume the non-expanded state;

(b) accommodating a pelt on the pelt board with the pelt board in the expanded state;

(c) accommodating the connecting element of the pelt board in one of the apertures of the top plate;

(d) interconnecting the holding unit and the blowing unit by lifting the holding unit vertically relative to the bottom plate;

(e) introducing gas into the inner space, causing the gas to flow into the pelt board via the one of the apertures;

(f) disconnecting the holding unit and the blowing unit, and moving the holding unit to a pelt release station including the release mechanism; and (g) operating the release mechanism, thereby causing the pelt board to assume the non-expanded state.

20. A pelt processing system comprising:

a plurality of expandable pelt boards, each of the pelt boards having a pelt board top, a pelt board bottom, and a connecting element at the pelt board bottom that is movable relative to the pelt board bottom to adjust the pelt board between an expanded state and a non-expanded state;

a drying unit including (a) a top plate having a number of apertures, each of the apertures being configured for holding one of the pelt boards by accommodating the connecting element of the one of the pelt boards; (b) a bottom plate spaced apart from the top plate; (c) a gas inlet configured for receiving a stream of gas, and (d) a sidewall movable between a low position and a high position and interconnecting the top plate and the bottom plate in a fluid-tight manner so as to define a volume-adjustable inner space between the top plate, the bottom plate, the gas inlet, and the sidewall; and a release mechanism operably connected to the connecting element of each of the pelt boards held in the top plate so as to cause the pelt boards held in the top plate to assume the non-expanded state from the expanded state.

* * * * *